US007354036B2

(12) United States Patent
Hayashi et al.

(10) Patent No.: US 7,354,036 B2
(45) Date of Patent: Apr. 8, 2008

(54) SHEET PROCESSING APPARATUS AND IMAGE FORMING APPARATUS INCLUDING THE SHEET PROCESSING APPARATUS

(75) Inventors: Kenichi Hayashi, Chiba (JP); Tomokazu Nakamura, Chiba (JP); Naoto Watanabe, Chiba (JP); Yusuke Obuchi, Chiba (JP); Hitoshi Kato, Ibaraki (JP); Shunsuke Nishimura, Ibaraki (JP); Tetsuya Terada, Ibaraki (JP); Yasutaka Iwasa, Kanagawa (JP); Daisuke Matsukura, Ibaraki (JP); Norio Motoi, Ibaraki (JP); Masayoshi Kubo, Ibaraki (JP)

(73) Assignees: Canon Finetech Inc., Ibaraki-Ken (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/560,466

(22) Filed: Nov. 16, 2006

(65) Prior Publication Data

US 2007/0102860 A1 May 10, 2007

Related U.S. Application Data

(63) Continuation of application No. 10/789,985, filed on Mar. 2, 2004, now Pat. No. 7,192,020.

(30) Foreign Application Priority Data

Mar. 7, 2003 (JP) ..... 2003-108394

(51) Int. Cl.
*B65H 37/04* (2006.01)

(52) U.S. Cl. ..... 270/58.12; 270/58.01; 270/58.08; 270/58.09; 270/59; 270/58.11; 270/58.18; 270/58.14; 270/58.16; 270/58.17; 270/58.27; 399/410; 271/189

(58) Field of Classification Search ..... 270/58.01, 270/58.08, 58.09, 59, 58.11, 58.12, 58.14, 270/58.16, 58.17, 58.18, 58.27; 399/410; 271/189

See application file for complete search history.

(56) References Cited

U.S. PATENT DOCUMENTS

| | | | | |
|---|---|---|---|---|
| 5,112,034 | A | 5/1992 | Uto et al. | 270/58.12 |
| 5,289,251 | A | 2/1994 | Mandel et al. | 399/407 |
| 5,765,824 | A | 6/1998 | Kawano et al. | 270/58.11 |
| 5,897,250 | A | 4/1999 | Hirai et al. | 399/404 |

(Continued)

FOREIGN PATENT DOCUMENTS

| | | |
|---|---|---|
| JP | 05286619 | 11/1993 |

(Continued)

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

A sheet processing apparatus includes: a buffer unit which stores plural supplied sheets with upstream edges in a conveying direction thereof aligned; a processing tray on which sheets discharged from the buffer unit are stacked; and an oscillation roller pair and a return roller which convey the sheet stacked on the processing tray to bring the sheet into abutment against a stopper for receiving the upstream edge of the sheet. The buffer unit is adapted to align the upstream edges of only sheets to be stored before a sheet to be supplied last among the sheets to be stored.

8 Claims, 55 Drawing Sheets

U.S. PATENT DOCUMENTS

| | | | | |
|---|---|---|---|---|
| 5,911,414 | A | 6/1999 | Kato et al. | 270/58.07 |
| 6,176,480 | B1 * | 1/2001 | Yonenuma et al. | 270/58.08 |
| 6,241,234 | B1 | 6/2001 | Saitoh et al. | 270/58.12 |
| 6,264,194 | B1 | 7/2001 | Hayashi et al. | 271/220 |
| 6,315,288 | B1 | 11/2001 | Sugishima et al. | 271/303 |
| 6,332,606 | B1 | 12/2001 | Seki | 270/59 |
| 6,908,078 | B2 * | 6/2005 | Suzuki et al. | 270/15 |
| 2003/0044186 | A1 | 3/2003 | Kato et al. | 399/16 |
| 2003/0049063 | A1 | 3/2003 | Suzuki et al. | 399/407 |
| 2003/0184010 | A1 | 10/2003 | Kato et al. | 271/207 |
| 2004/0175217 | A1 | 9/2004 | Nakamura et al. | 399/407 |
| 2005/0067777 | A1 * | 3/2005 | Ilda et al. | 271/303 |

FOREIGN PATENT DOCUMENTS

| | | |
|---|---|---|
| JP | 9-48545 | 2/1997 |
| JP | 9-301573 | 11/1997 |
| JP | 11-60054 | 3/1999 |
| JP | 2002-347949 | 12/2002 |
| JP | 2003-081517 | 3/2003 |

* cited by examiner

SHEET PROCESSING APPARATUS AND IMAGE FORMING APPARATUS INCLUDING THE SHEET PROCESSING APPARATUS

This application is a continuation of U.S. patent application Ser. No. 10/789,985, filed Mar. 2, 2004 now U.S. Pat. No. 7,192,020.

BACKGROUND OF THE INVENTION

1. Field of the Invention

The present invention relates to a sheet processing apparatus, which is provided, for example, in an apparatus main body of an image forming apparatus such as a copying machine or a printer, and applies processing to sheets to be sent from the apparatus main body. In particular, the present invention relates to a sheet processing apparatus, which can store sheets to be sent while processing is applied to the sheets, and an image forming apparatus including the sheet processing apparatus.

2. Related Background Art

In recent years, a sheet processing apparatus such as a sorter for sorting sheets, on which an image has been formed, as an option for an image forming apparatus such as an electrophotographic copying machine or a laser beam printer. This kind of sheet processing apparatus is adapted to apply one of sort processing, stitch processing, alignment processing, and the like to sheets.

For example, a sheet processing apparatus including a stapler for stitching sheets with needles is adapted to, after causing sheets, which are conveyed into a sheet processing apparatus main body, to pass through a conveyance path formed in the inside of the main body and stacking the sheets on a processing tray, perform a stitching action.

A sheet processing apparatus for stitching a sheet stack is adapted to stack sheets on a processing tray in bundles and move a stapler serving as stitching means to perform one position stitch or multiple-position stitch (usually two-position stitch). While a stitching action is performed, sheets of the next job cannot be stacked on the processing tray. Consequently, sheets are required to be supplied on the basis of job unit in which the stitching action is performed.

In a sheet processing apparatus which performs stitch processing other than the needle stitch processing, sheets are required to be supplied at intervals on the basis of job unit while the processing is applied to the sheets.

However, when the sheets are supplied at intervals, productivity declines. In other words, the number of sheets to be processed per unit time decreases. As a sheet processing apparatus for preventing the decline in productivity, there is a sheet processing apparatus which includes a sheet holding portion (buffer portion) for storing to cause sheets to stand by in a conveyance path in the course of conveyance of the sheets to a processing tray.

This sheet processing apparatus is adapted to, while processing is applied to plural sheets stacked on the processing tray, store subsequent plural sheets in the sheet holding portion and, at the point when the processing ends, stack the sheets stored in the sheet holding portion on the processing tray and supply the subsequent sheets to the processing tray until the sheets on the processing tray reach a desired number (e.g., see Japanese Patent Application Laid-Open No. H9-48545).

A conventional sheet processing apparatus 10 shown in FIG. 46 includes a buffer roller path 14, which winds sheets around a rotating buffer roller 13 to cause the sheets to stand by for conveyance to a post-processing tray 11, in a conveyance path 12 in the course of conveyance of the sheets to the post-processing tray 11.

With such a structure, the conventional sheet processing apparatus 10 stores sheets, which are conveyed from a discharge roller pair 17 in an apparatus main body 16 of an image forming apparatus 15, in the buffer roller path 14. After a preceding sheet stack has undergone, for example, a stitch action on the post-processing tray 11, and an upper roller 18*a* and a lower roller 18*b* of an oscillation roller pair 18 have nipped to discharge sheets, while rotating, from the post-processing tray 11, the sheet processing apparatus 10 conveys the sheet stack stored in the buffer roller 13 to the post-processing tray 11 to thereby prevent the decline in productivity without increasing conveyance intervals among the sheets during the stitch action.

However, since the conventional sheet processing apparatus 10 includes the buffer roller path 14 and requires a space for setting the buffer roller 13 and the buffer roller path 14, which stop conveyance of subsequent sheets to the post-processing tray 11 to cause sheets to stand by during a stitch action, a size of the sheet processing apparatus itself increases to cause an increase in costs.

In addition, since the conventional sheet processing apparatus 10 discharges sheets with the oscillation roller pair 18, a discharge action of sheets is irregular to cause unevenness of time required for sheet discharge.

Moreover, although the conventional sheet processing apparatus 10 is adapted to stack sheets, which are stored in the buffer roller path, on the post-processing tray 11 after discharging sheets on the post-processing tray 11, the sheet processing apparatus 10 is not suitable for the recent actual situation in which high-speed processing is required. Thus, an apparatus with shorter processing time has been expected.

In addition, in the sheet processing apparatus, the number of sheets to be stored in the sheet holding portion is fixed regardless of time required for processing sheets. For example, in the case of a sheet processing apparatus for stitching sheets, as the number of positions to be stitched increases, longer time is required for the processing. Thus, sheets of a number corresponding to longest required time for processing are stored in the sheet holding portion. Consequently, in the sheet processing apparatus for stitching sheets, in the case in which there are a small number of positions to be stitched, the sheet holding portion continues an action for storing sheets regardless of the fact that the processing has ended, and sheet processing efficiency is low. The sheet processing efficiency is also low in sheet processing apparatuses which perform other sheet processing.

SUMMARY OF THE INVENTION

It is an object of the present invention to provide a sheet processing apparatus with increased sheet processing efficiency.

It is another object of the present invention to provide an image forming apparatus which includes the sheet processing apparatus with increased sheet processing efficiency to increase image processing efficiency.

In order to attain the above-mentioned objects, according to an aspect of the present invention, there is provided a sheet processing apparatus, including: a sheet holding portion which stores plural supplied sheets with upstream edges in a conveying direction thereof aligned; sheet stacking means for stacking the sheets discharged from the sheet holding portion; and sheet conveying means for conveying the sheets discharged to the sheet stacking means, bringing the upstream edges of the sheets into abutment against a receiving stopper for receiving the upstream edges to align the upstream edges, and discharging the sheets from the sheet stacking means, in which the plural supplied sheets are discharged to the sheet stacking means from the sheet holding portion when a downstream edge in a conveying direction of a sheet to be supplied last has preceded the downstream edges in the conveying direction of the sheets stored in the sheet holding portion by a predetermined amount.

In order to attain the above-mentioned objects, in further another aspect of the sheet processing apparatus, the sheet processing apparatus further includes sheet processing means for applying processing to the sheets stacked on the sheet stacking means, and a subsequent sheet stored in the sheet holding portion and a preceding sheet stacked on the sheet stacking means are conveyed together by the sheet conveying means in a state in which a downstream edge of the preceding sheet projects further than a downstream edge of the subsequent sheet by a predetermined amount and, after the preceding sheet has been discharged from the sheet stacking means, the subsequent sheet is stacked on the sheet stacking means.

In order to attain the above-mentioned objects, in further another aspect of the sheet processing apparatus, the sheet processing apparatus further includes control means for controlling the number of sheets to be stored in the sheet holding portion according to a processing time of the sheet processing means.

In order to attain the above-mentioned objects, in further another aspect of the sheet processing apparatus, the sheet processing apparatus further includes control means for performing: a first action in a case in which the sheet is an ordinary sheet, the first action including subjecting a preceding sheet stacked on the sheet stacking means to processing with the sheet processing means and simultaneously causing a subsequent sheet to be held in the sheet holding portion and, after the processing of the preceding sheet ends, conveying the subsequent sheet and the preceding sheet together using the sheet conveying means to discharge the preceding sheet from the sheet stacking means, and then stacking the subsequent sheet on the sheet stacking means; and a second action in a case in which the sheet is a specific sheet, the second action including not causing the specific sheet to be held in the sheet holding portion but causing the specific sheet to pass through the sheet holding portion to be stacked on the sheet stacking means, processing the sheet with the sheet processing means, and then discharging the sheet from the sheet stacking means with the sheet conveying means.

In order to attain the above-mentioned objects, according to another aspect of the present invention, there is provided an image forming apparatus including: image forming means for forming an image on a sheet; and the sheet processing apparatus according to any one of the aspects described above, which applies processing to the sheet on which the image is formed by the mage forming means.

The sheet processing apparatus of the present invention is adapted not to apply an alignment action to a sheet to be supplied last in the sheet holding portion. Thus, productivity can be improved. In addition, a return alignment property can also be improved.

The sheet processing apparatus of the present invention can change the number of sheets to be stored in the sheet holding portion according to post-processing time, whereby productivity can be maintained. In addition, the number of sheets stored in the sheet holding portion, which are stacked on the sheet stacking means, may be reduced, whereby an alignment property of sheets in the sheet stacking means can be improved. In the case in which the sheet processing means is a stapler, it is possible to accurately stitch sheets.

The image forming apparatus of the present invention includes the sheet processing apparatus with increased sheet processing efficiency. Thus, sheets can be processed efficiently, whereby image processing efficiency can be improved.

DESCRIPTION OF THE PREFERRED EMBODIMENTS

A sheet processing apparatus of an embodiment of the present invention and a copying machine, which is an example of an image forming apparatus including this sheet processing apparatus, will be hereinafter described with reference to the accompanying drawings. Note that examples of the image forming apparatus include a copying machine, a facsimile apparatus, a printer, and a multifunction machine of these apparatuses, and the image forming apparatus including the sheet processing apparatus is not limited to a copying machine.

Further, dimensions, numerical values, materials, shapes, a relative arrangement of the components described in this embodiment, and the like are not meant to limit a scope of the present invention only to them unless specifically described otherwise.

In the description of the embodiments, a case in which the sheet processing apparatus is an optional apparatus, which is constituted to be detachably mountable to an apparatus main body of the image forming apparatus as an independent apparatus, will be described as an example. Note that it is needless to mention that the sheet processing apparatus of the present invention is also applied to a case in which the sheet processing apparatus is integrally provided in the image forming apparatus. However, since this case is not particularly different in function from the case of a sheet processing apparatus, which is described later, a description of the case will be omitted.

Figure 1:
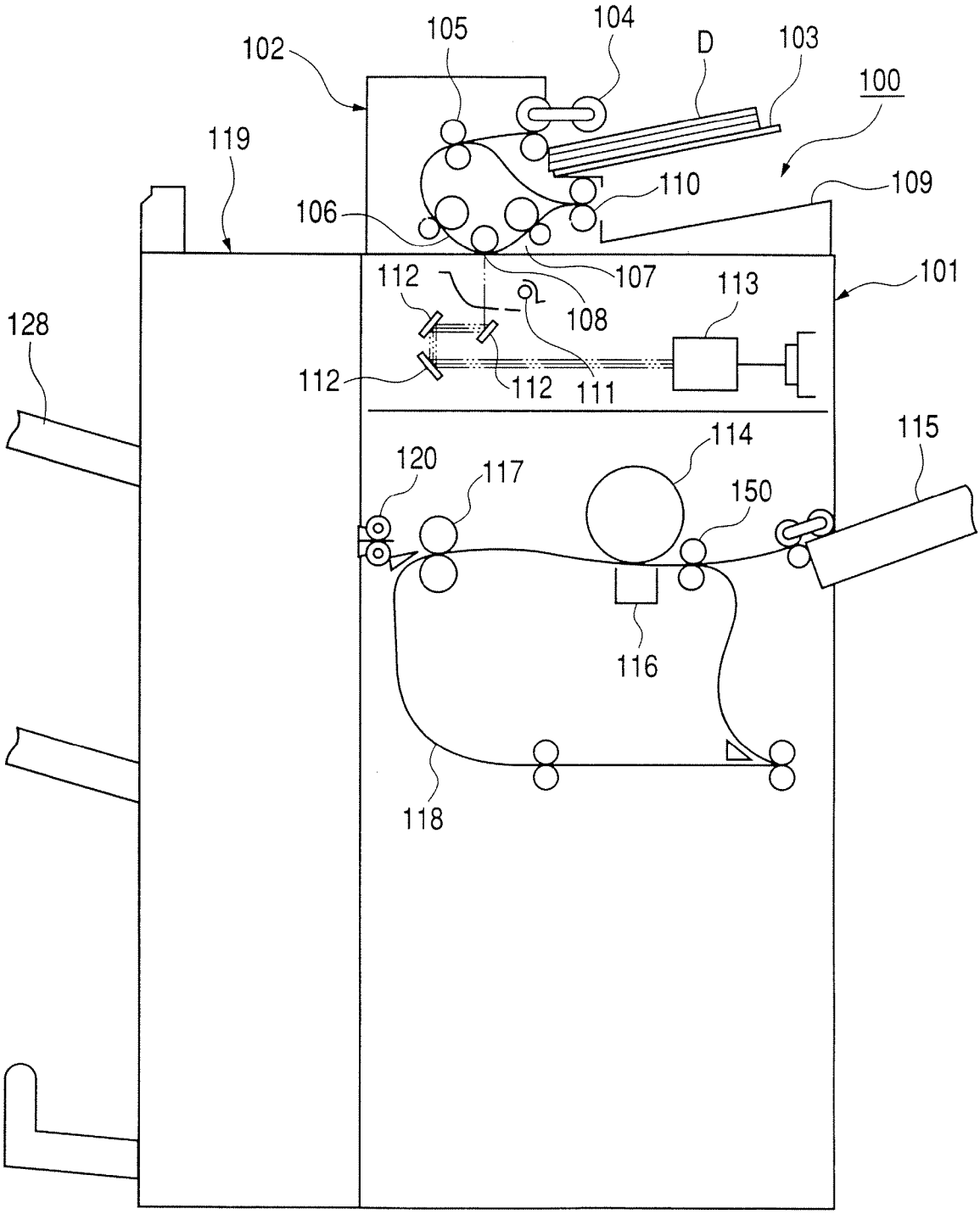
FIG. 1 is a front schematic sectional view of a copying machine which is an image forming apparatus including a sheet processing apparatus according to an embodiment of the present invention in an apparatus main body.

FIG. 1 is a schematic sectional view showing a state in which a sheet processing apparatus is mounted to a copying machine. Note that the sheet processing apparatus is specifically, for example, a finisher.

Image Forming Apparatus

A copying machine 100 is constituted by an apparatus main body 101 and a sheet processing apparatus 119. An original feeding apparatus 102 is mounted above the apparatus main body 101. Originals D are mounted on an original mounting portion 103 and are sequentially separated one by one by a feeding portion 104 to be supplied to a registration roller pair 105. Subsequently, the original D is stopped by the registration roller pair 105 once and looped to correct skew feeding. Thereafter, the original D passes on an introduction path 106 to pass through a reading position 107, whereby an image formed on the surface of the original is read. The original D having passed through the reading position 108 passes on a discharge path 107 to be discharged on a discharge tray 109.

In addition, in the case in which both sides of an original is read, first, the original D passes through the reading position 108, whereby an image on one side of the original is read. Thereafter, the original D passes on the discharge path 107 and is conveyed by a reverse roller pair 110 in a switch-back manner and sent to the registration roller pair 105 again in a state in which the sides are reversed.

Then, skew feeding of the original D is corrected in the registration roller pair 105 in the same manner as reading the image on the one side. The original D passes on the introduction path 106, and an image on the other side is read in the reading position 108. Then, the original D passes on the discharge path 107 to be discharged to the discharge tray 109.

On the other hand, light of a lighting system 111 is applied on an image of an original passing through the reading position 108. Reflected light from the original is guided to an optical element 113 (CCD or other elements) by mirrors 112, and image data is obtained. Then, a laser beam based upon this image data is applied on, for example, a photosensitive drum 114 serving as image forming means to form a latent image. Note that, although not shown in the figure, it is also possible to constitute the image forming apparatus such that the reflected light is directly applied on the photosensitive drum 114 by the mirrors 112 to form a latent image.

A toner image is formed from the latent image formed on the photosensitive drum 114 by a toner supplied from a toner supply apparatus (not shown). Recording media, which are sheets of paper or plastic film, are stacked on a cassette 115. A sheet is fed from the cassette 115 in response to a recording signal and enters between the photosensitive drum 114 and a transfer apparatus 116 with timing for entering adjusted by a registration roller pair 150. Then, a toner image on the photosensitive drum 114 is transferred onto the sheet by transfer apparatus 116. The sheet having the toner image transferred thereon is heated and pressurized by a fixing apparatus 117 while the sheet passes through the fixing apparatus 117, whereby the toner image is fixed.

In the case in which images are formed on both sides of a recording medium, a sheet, on one side of which an image is fixed by the fixing apparatus 117, passes on a two-side path 118 provided on a downstream side of the fixing apparatus 117, fed into between the photosensitive drum 114 and the transfer apparatus 116 again, and a toner image is transferred onto a back side as well. Then, the toner image is fixed by the fixing apparatus 117, and the sheet is discharged to the outside (a finisher 119 side).

Figure 2:
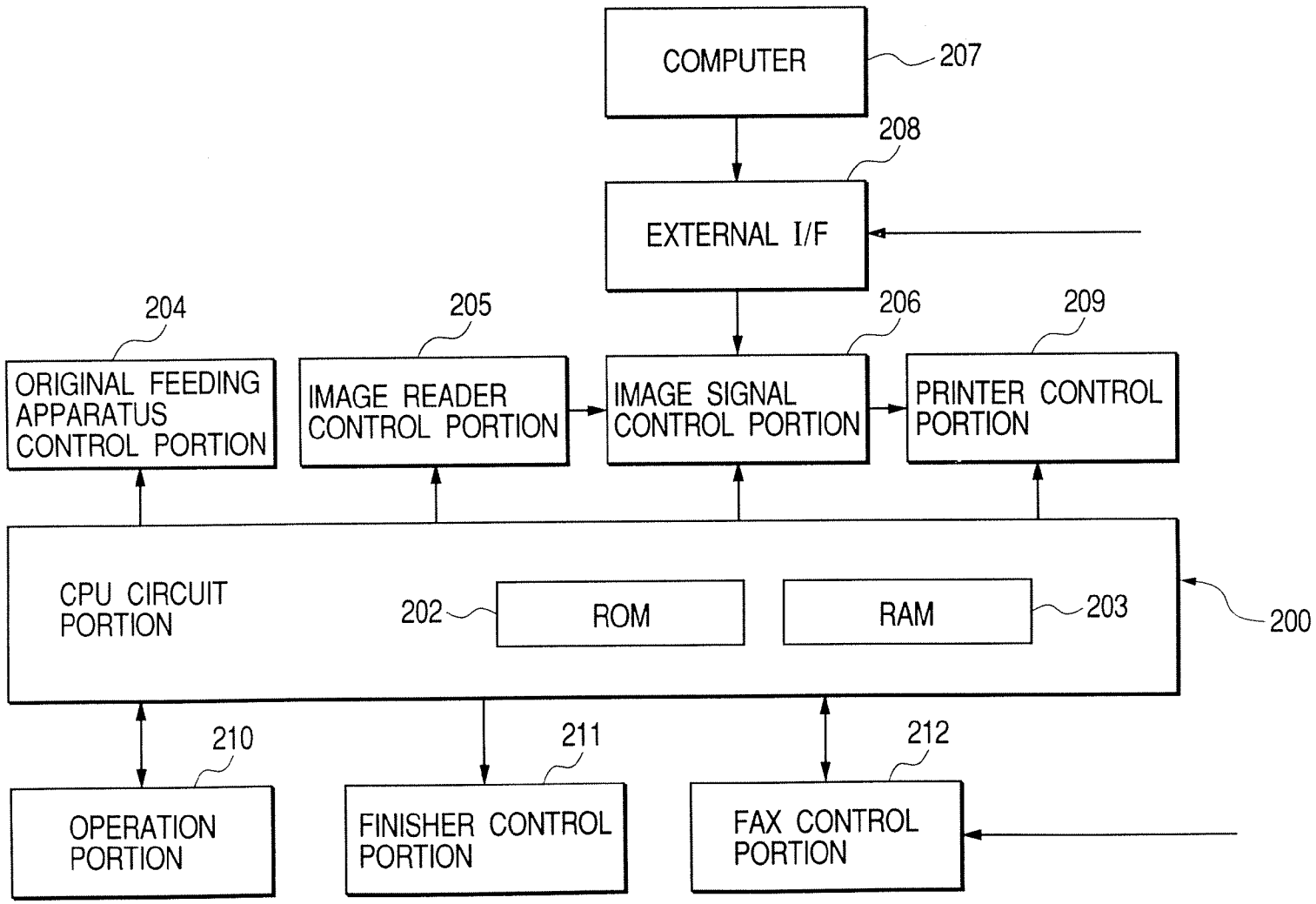
FIG. 2 is a control block diagram of the copying machine of FIG. 1.

FIG. 2 is a control block diagram of the entire copying machine. The entire copying machine 100 is adapted to be controlled by a CPU circuit portion 200. A ROM 202, which has stored therein sequences for each portion, that is, control procedures of respective portions, and a RAM 203, in which various kinds of information are temporarily stored as required, are provided in the CPU circuit portion 200. An original feeding apparatus control portion 204 is adapted to control an original feeding action of an original deeding apparatus 102. An image reader control portion 205 is adapted to control a lighting system 111 or the like to control reading of an original. An image signal control portion 206 is adapted to receive reading information of the image reader control portion 205 or image information, which is sent from an external computer 207, via an external I/F 208, process the information, and send a processing signal to a printer control portion 209. The printer control portion 209 is adapted to control the photosensitive drums 114 and the like on the basis of the image processing signal from the image signal control portion 206 to make it possible to form an image on a sheet.

An operation portion 210 is adapted to be able to input information on what kind of processing is applied to a sheet, for example, information for performing staple processing. In addition, the operation portion 210 is adapted to be able to display information on an action state or the like of the apparatus main body 101 of the copying machine and the finisher 119 serving as a sheet post-processing apparatus. A finisher control portion 21 is adapted to control actions in the finisher 119 serving as a sheet post-processing apparatus. A FAX control portion 212 is adapted to control the copying machine such that the copying machine can be used as a facsimile apparatus to transmit/receive signals with other facsimile apparatuses.

Sheet Processing Apparatus

Figure 3:
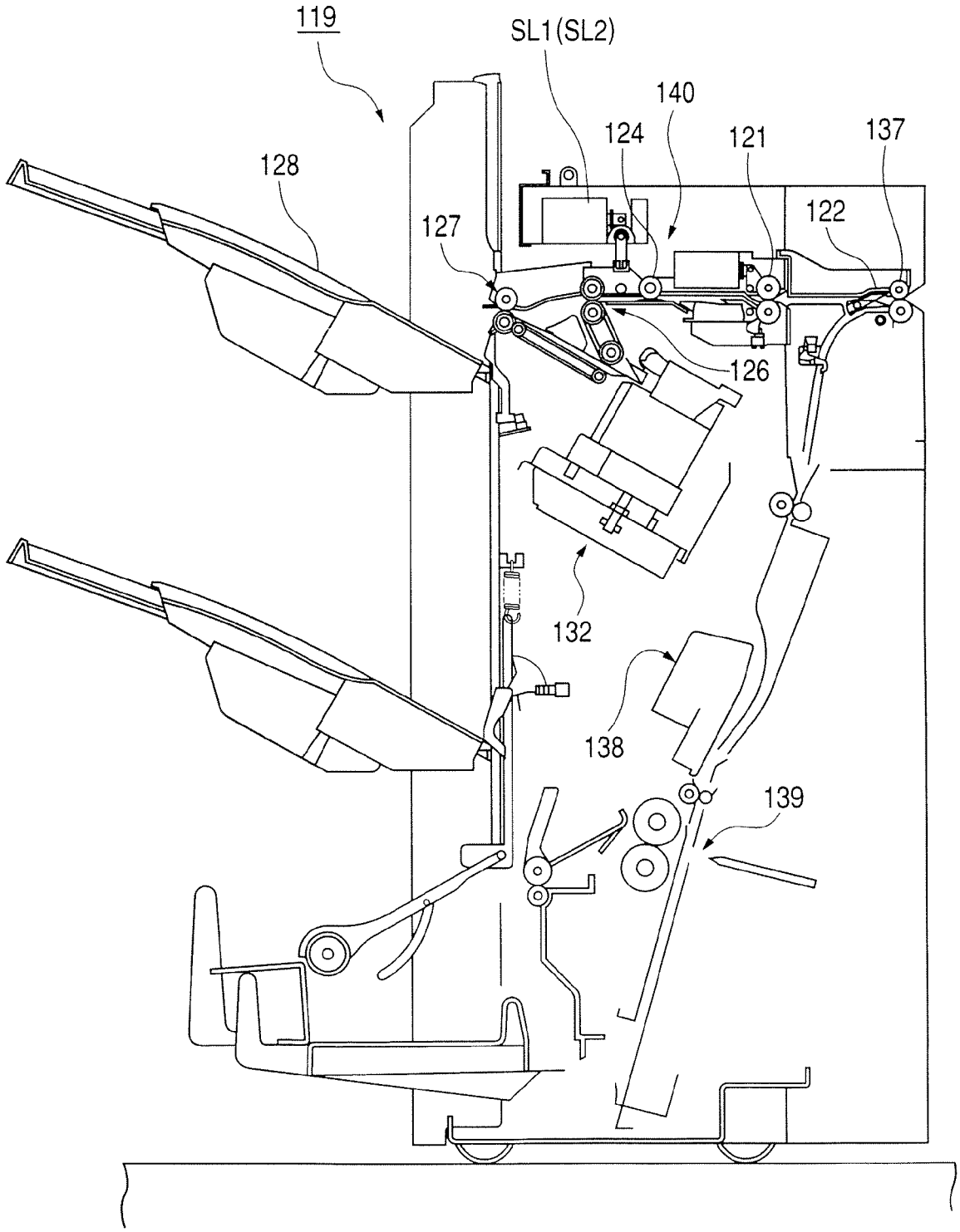
FIG. 3 is a front schematic sectional view of the sheet processing apparatus according to the embodiment of the present invention.
Figure 4:
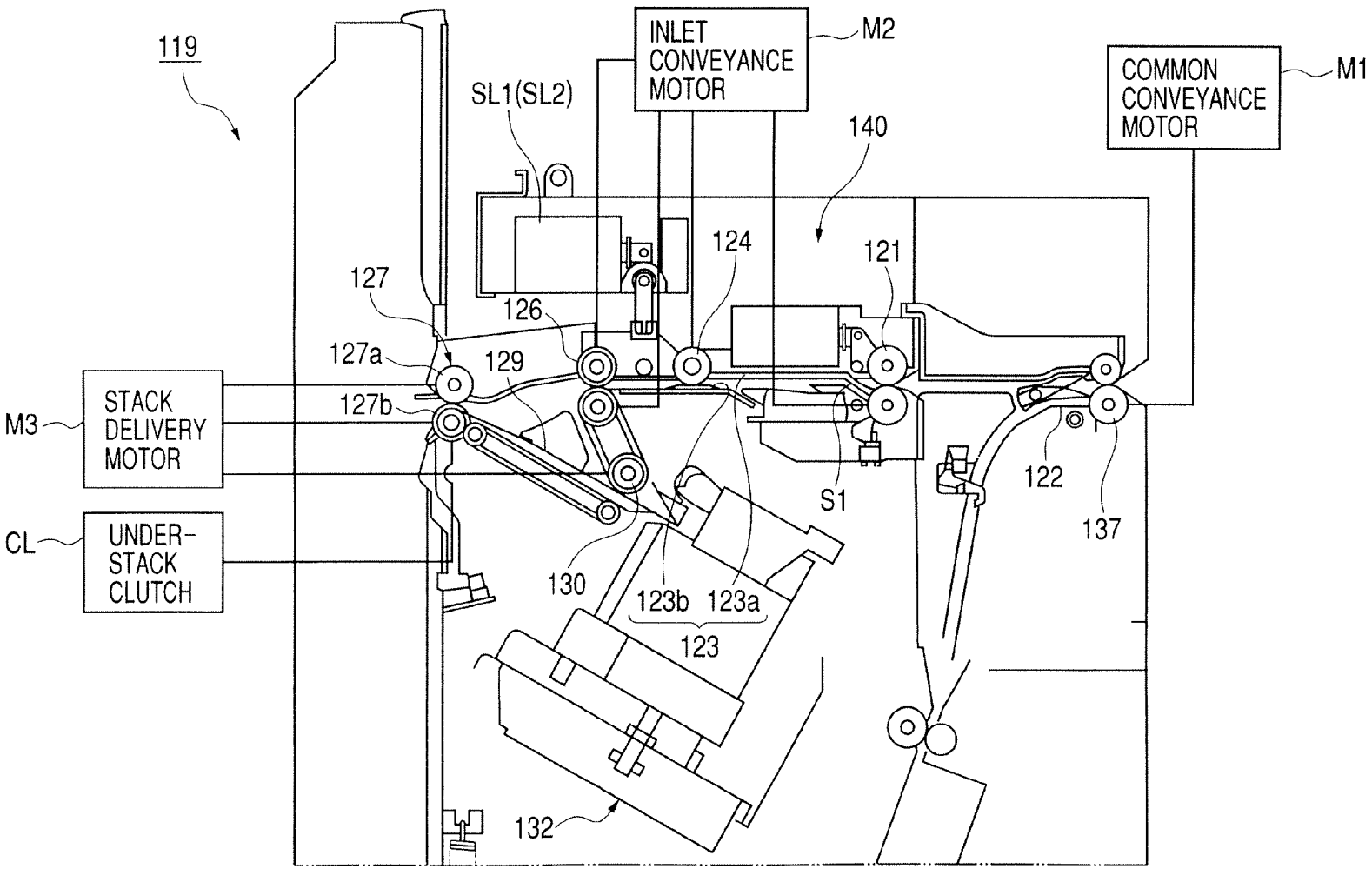
FIG. 4 is a front schematic sectional view showing respective drive systems of the sheet processing apparatus according to the embodiment of the present invention.
Figure 8:
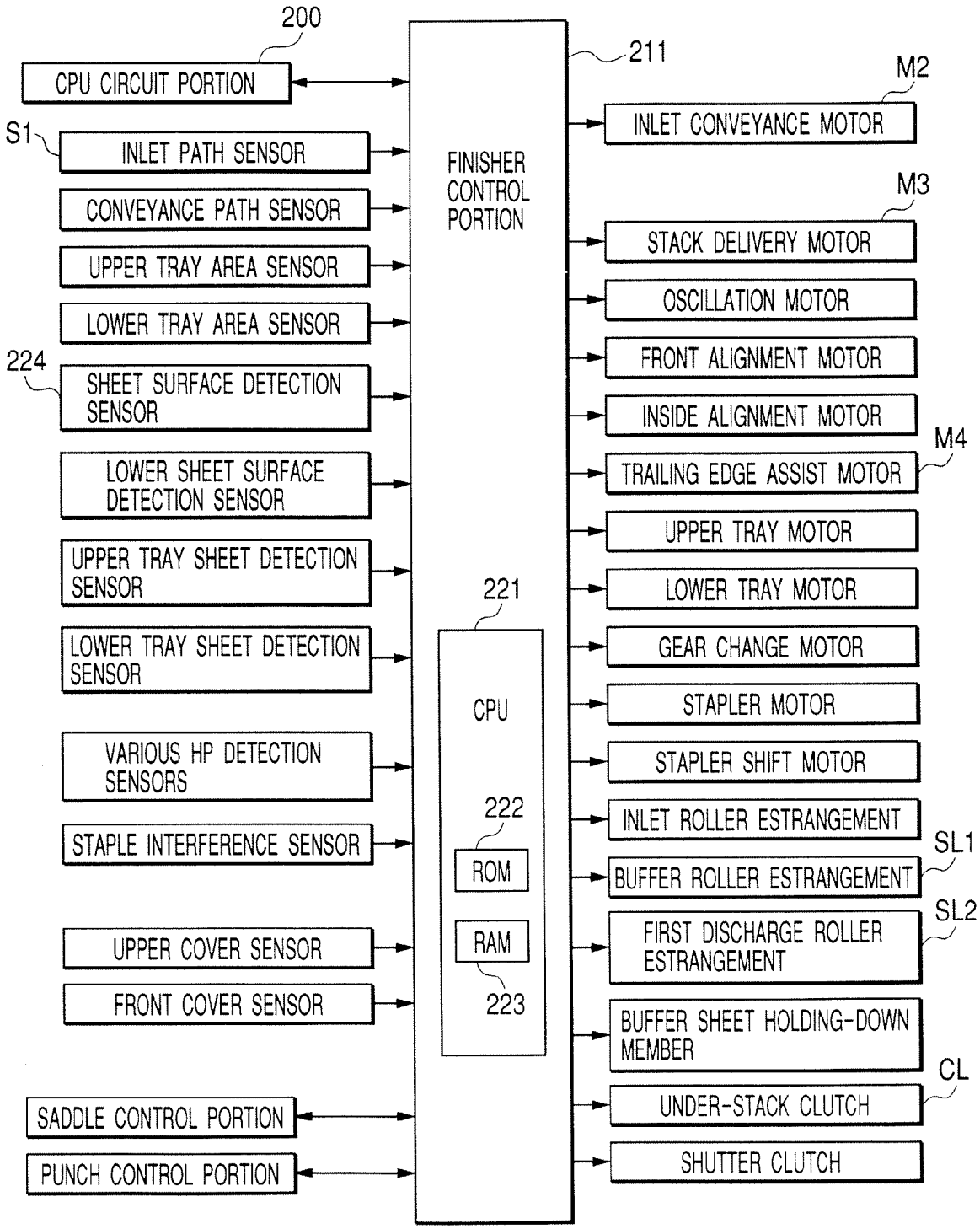
FIG. 8 is a control block diagram of the sheet processing apparatus of FIG. 3.
Figure 9:
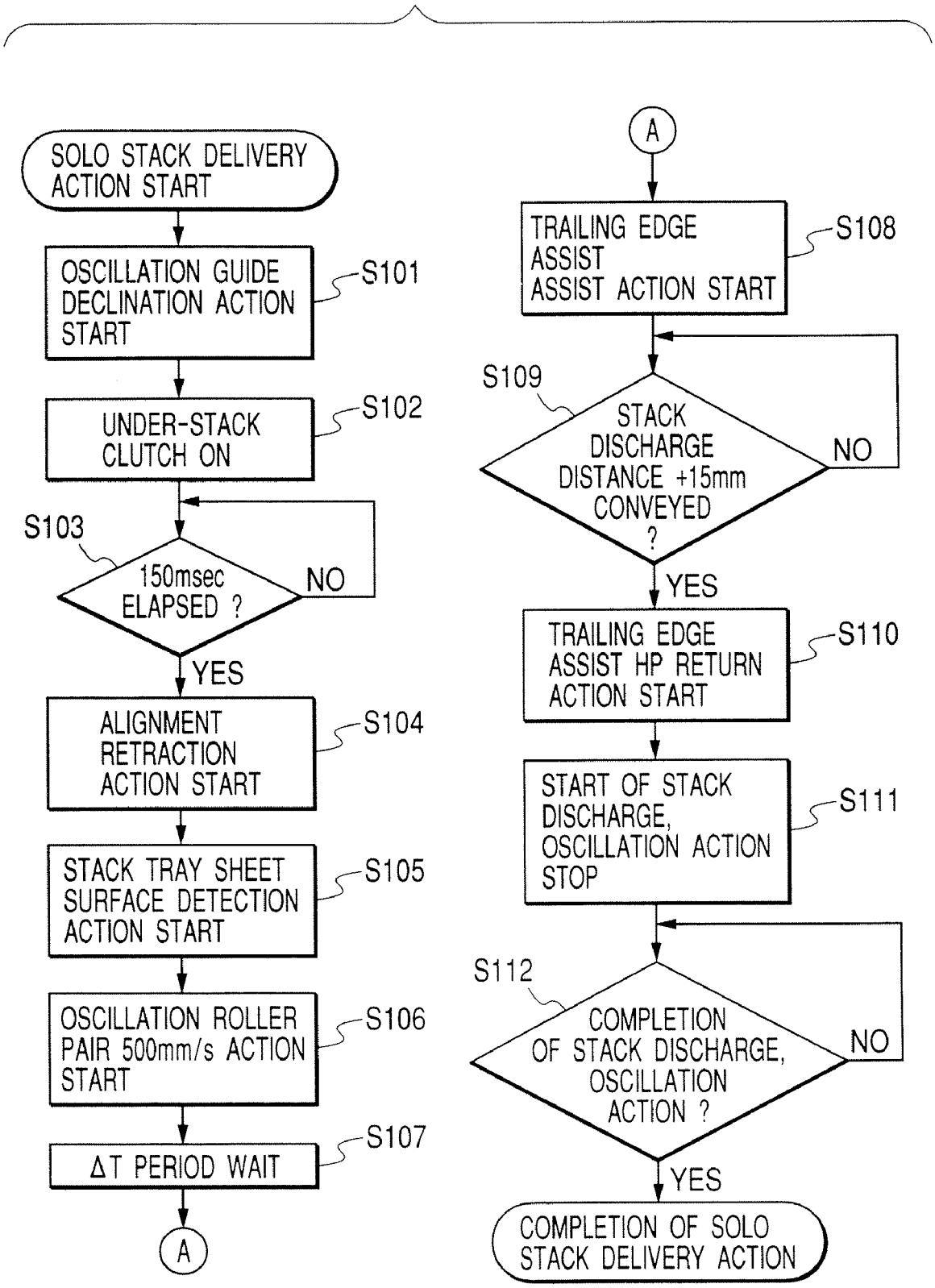
FIG. 9 is a flowchart for explaining an action at the time when a sheet stack is discharged in the sheet processing apparatus of FIG. 3.
Figure 10:
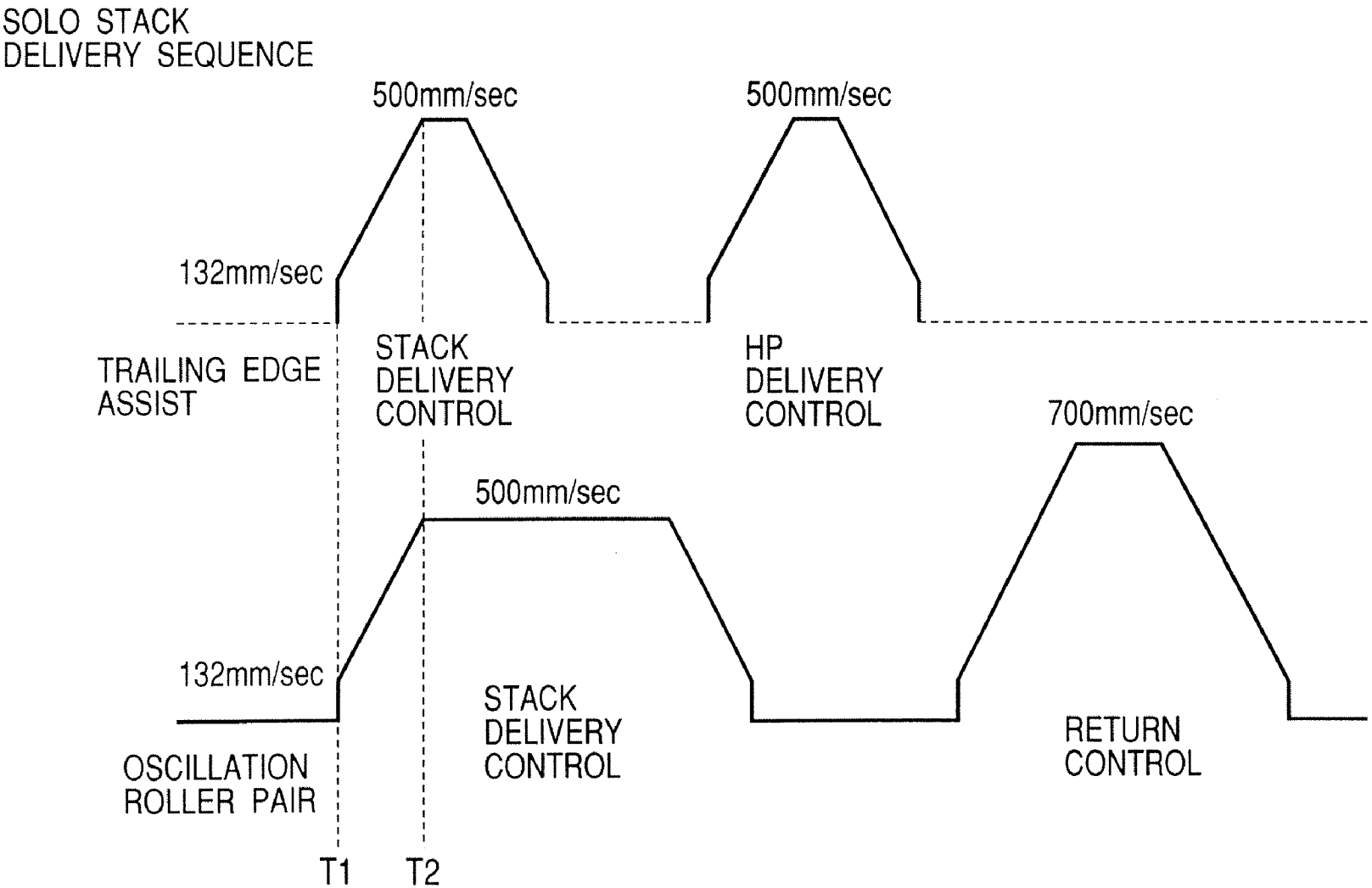
FIG. 10 is a diagram for explaining action timing of the trailing edge assist and an oscillation roller pair.
Figure 11:
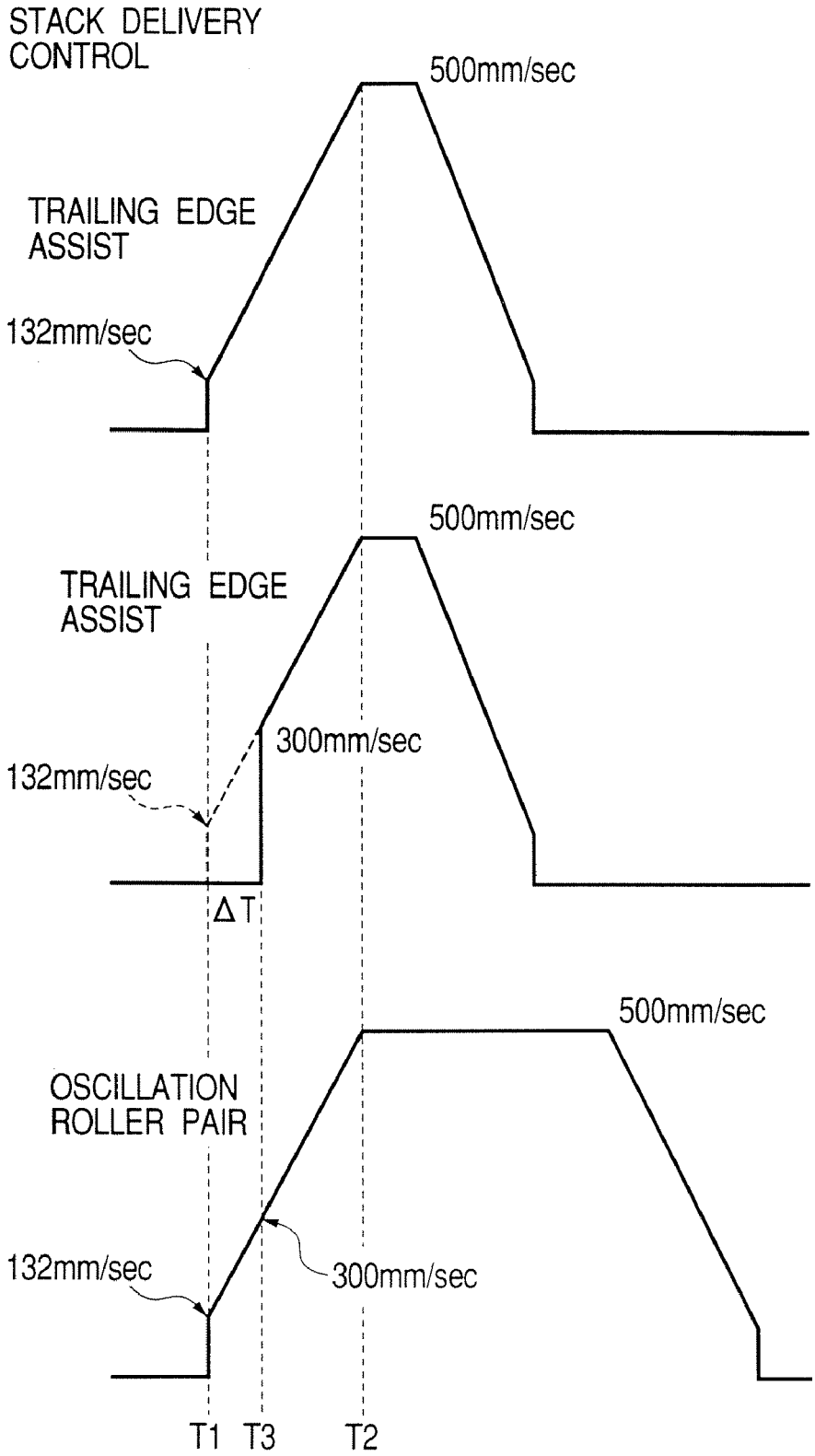
FIG. 11 is a diagram for explaining action timing of the trailing edge assist and the oscillation roller pair.
Figure 12:
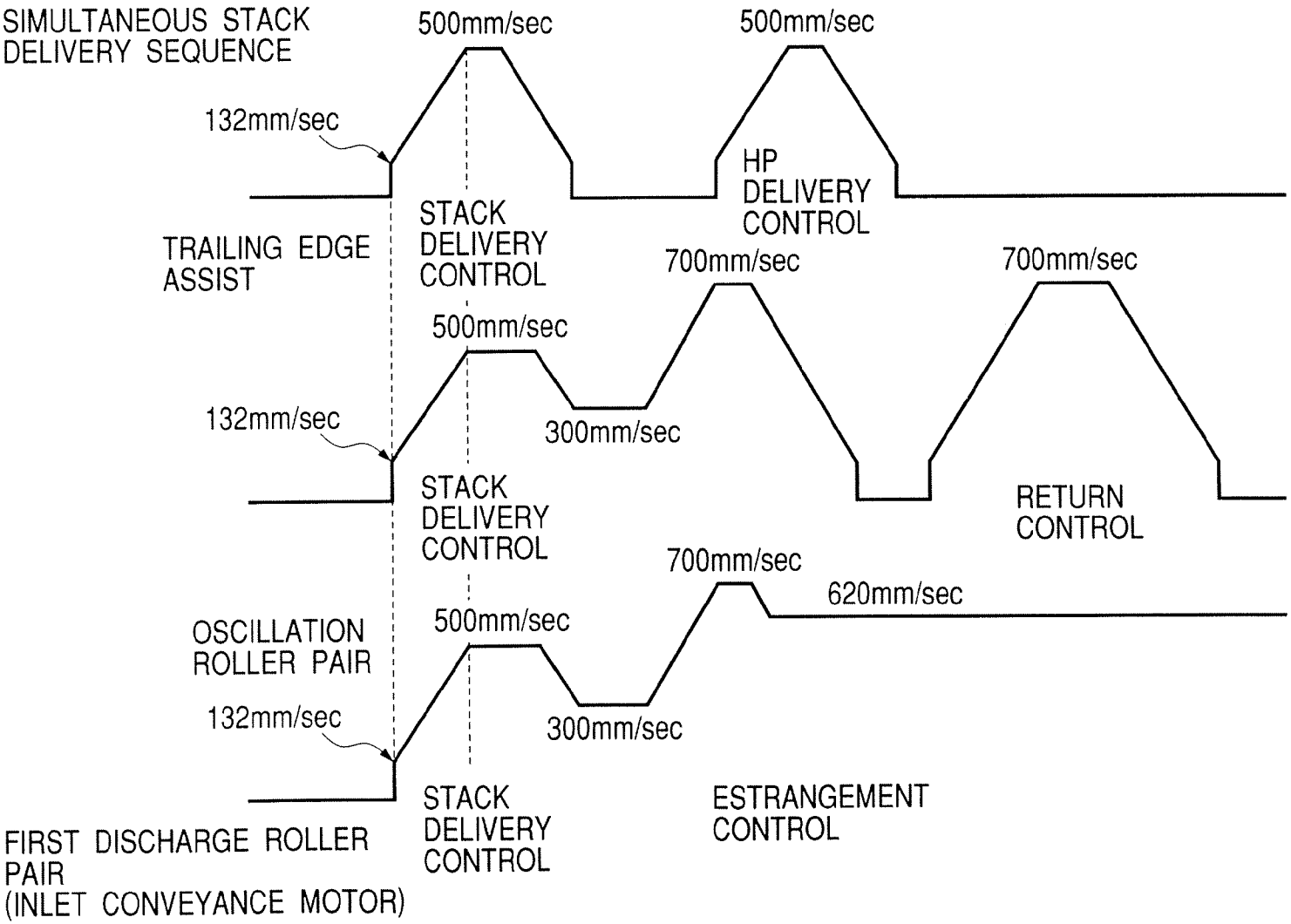
FIG. 12 is a diagram for explaining action timing of the trailing edge assist, the oscillation roller pair, and a first discharge roller pair.

FIG. 3 is a longitudinal sectional view of a sheet processing apparatus. FIG. 4 is a longitudinal sectional view showing respective drive systems. FIG. 8 is a control block diagram of the sheet processing apparatus. FIG. 9 is a flowchart for explaining actions of the sheet processing apparatus. FIGS. 10 to 12 are diagrams showing a relation between a moving speed of a trailing edge assist 134 and a sheet conveyance speed of an oscillation roller pair 127 with respect to an elapsed time. FIG. 10 is a solo discharge sequence for feeding a sheet stack with the trailing edge assist 134 and the oscillation roller pair 127. FIG. 11 is a diagram of stack delivery control in the case in which start speeds of the trailing edge assist 134 and the oscillation roller pair 127 are different. FIG. 12 is a diagram of a simultaneous discharge sequence for simultaneously conveying a sheet stack and a buffer sheet stored in a buffer unit 140 with the trailing edge assist, the oscillation roller pair, and the first conveyance roller pair.

The sheet processing apparatus 119 is provided with a function for bookbinding a sheet stack and includes a stapler unit 132 which stitches parts near the edge of the sheet stack, a stapler 138 which stitches the center of the sheet stack, a folding unit 139 which folds the parts of stitch positions of the sheet stack stitched by the stapler 138 to form the sheet stack in a book shape, and the like.

The sheet processing apparatus 119 of this embodiment includes the buffer unit 140 serving as a sheet holding portion which stacks and stores plural sheets, which will be processed next, on a lower conveyance guide plate 123*b* in a straight state during operation of the stapler unit 132.

Figure 46:
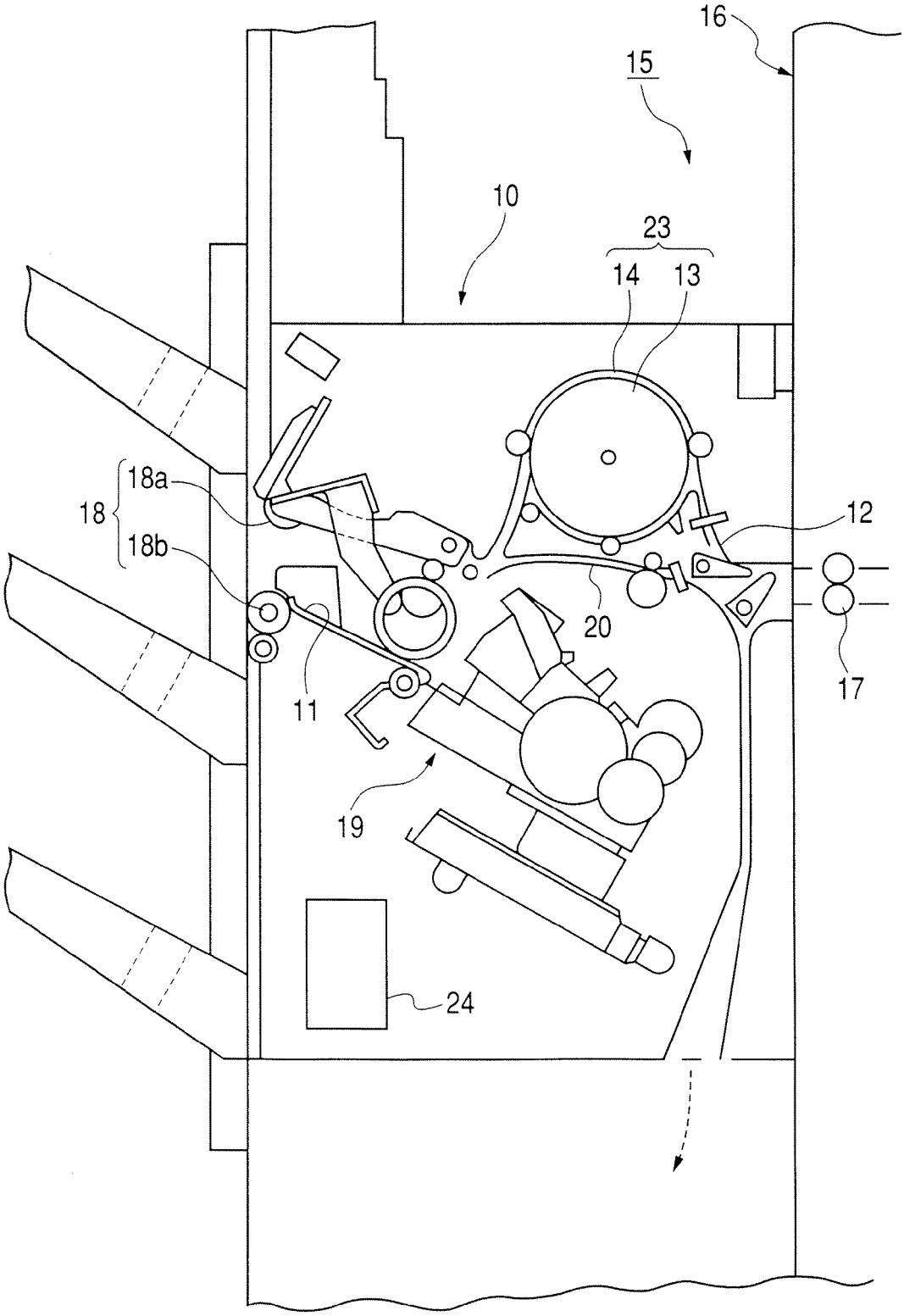
FIG. 46 PRIOR ART
FIG. 46 is a schematic front view of a conventional sheet processing apparatus.

Since this buffer unit 140 is adapted to stack and store plural sheets in a straight state, unlike the conventional mechanism having the buffer roller 13 shown in FIG. 46, the sheets can be made flat along a guide 123 constituted linearly, and a size and a weight of the sheet processing apparatus can be reduced. Moreover, since the sheets can be stored in a straight state, unlike the case of the buffer roller, the sheets are not rolled up. Thus, since the sheets can be easily handled, a processing time for the sheets of the sheet processing apparatus can be reduced.

Figure 6:
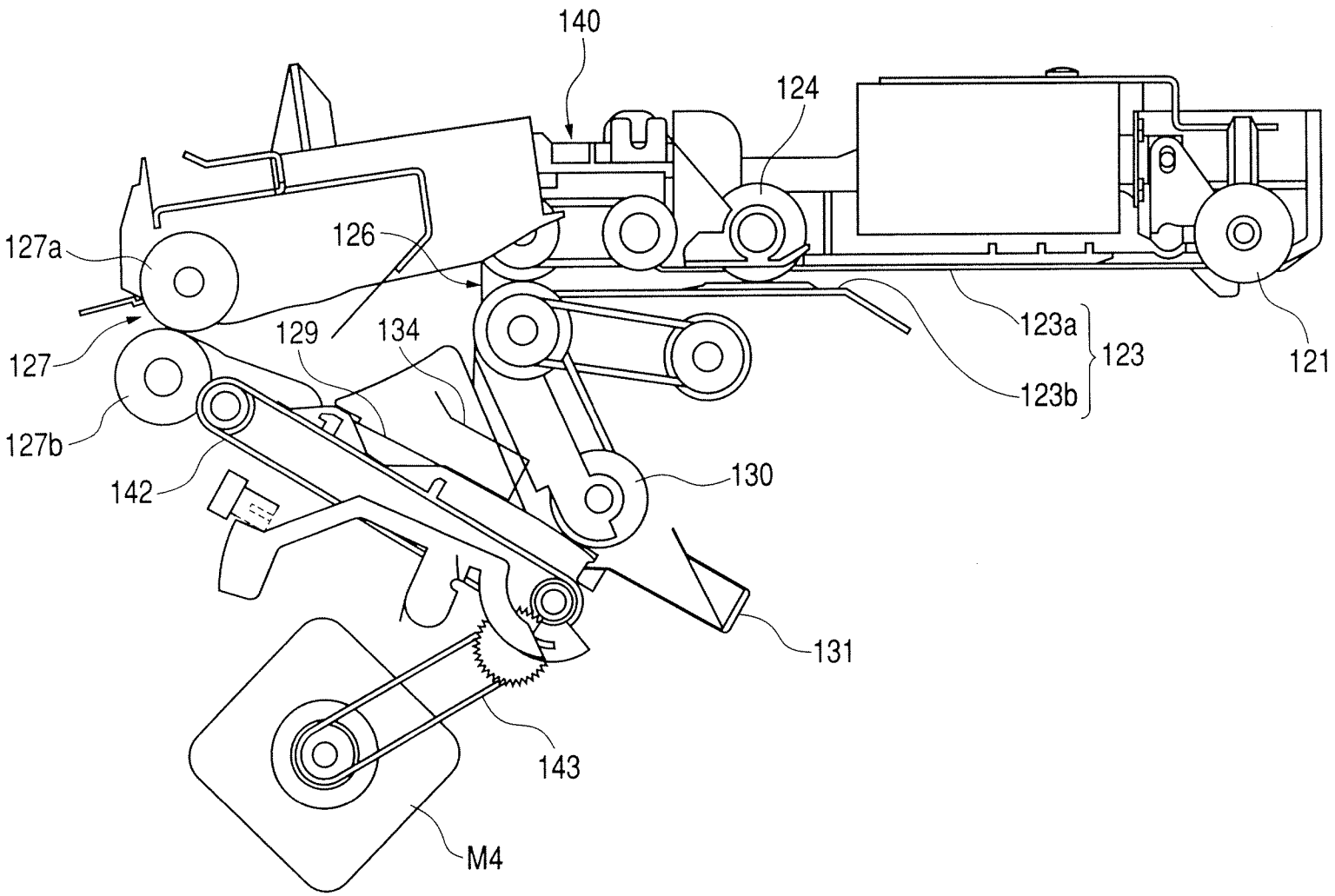
FIG. 6 is a view showing a state in which a trailing edge assist of FIG. 5 has moved.
Figure 7:
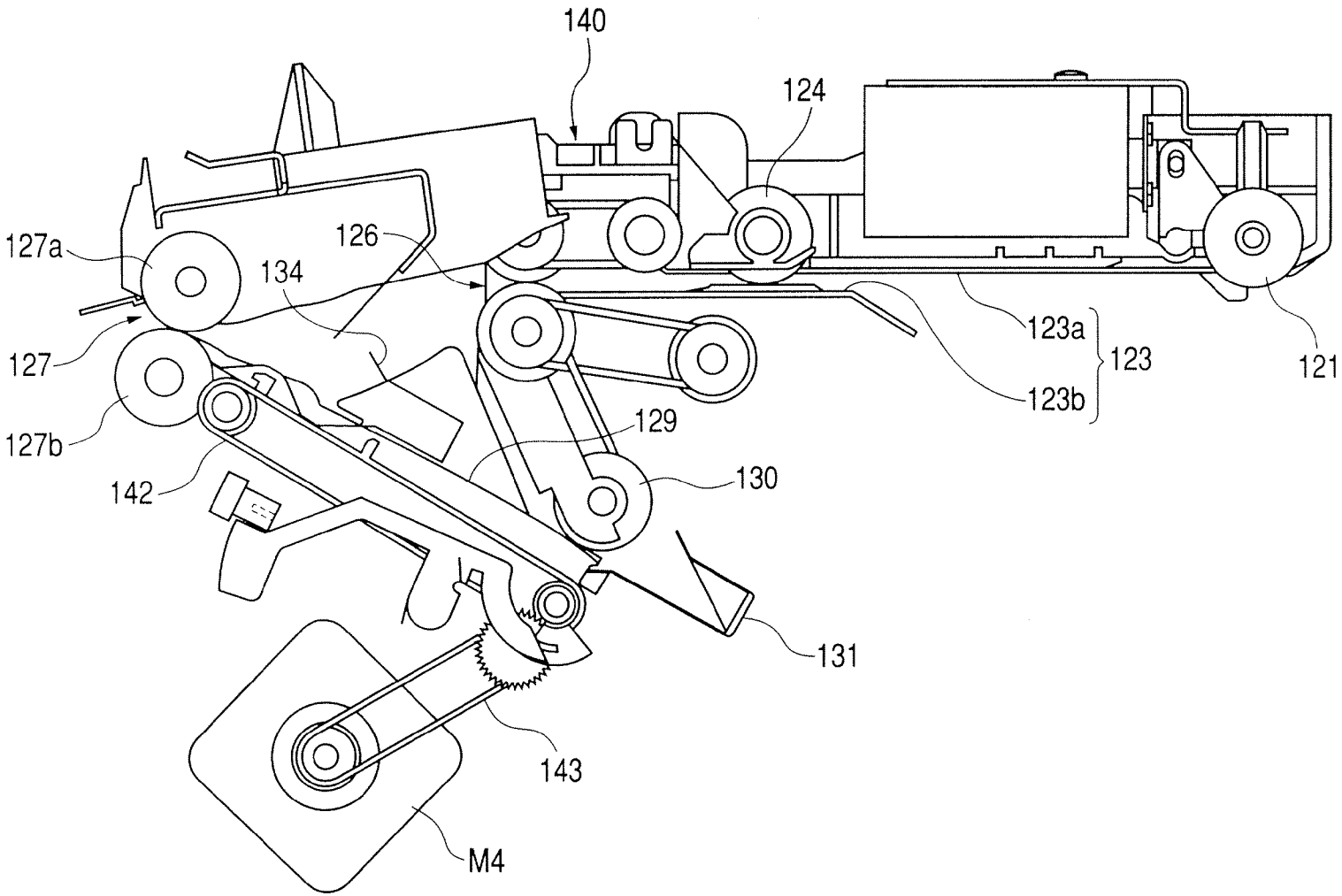
FIG. 7 is a view showing a state in which the trailing edge assist has moved further from the state shown in FIG. 6.

The sheet processing apparatus 119 is adapted to be controlled by a finisher control portion 211 shown in FIGS. 6 and 7. A ROM 222, which has stored therein a control procedure (sequence) of the sheet processing apparatus 119 operating on the basis of an instruction from the CPU circuit portion 200 of the apparatus main body of the copying machine, a RAM 203, which temporarily stores information required for controlling the sheet processing apparatus 119 each time it is controlled, and the like are provided in a CPU 221 of the finisher control portion 211. In addition, a sheet surface detection sensor 224, which operates on the basis of an action of a sheet surface detection lever 133 to be described later, is connected to the finisher control portion 211. The CPU 221 is adapted to control ascent and decent of a stack tray 128 on the basis of a sheet detection signal of the sheet surface detection sensor 224. The finisher control portion 211 is adapted to control to operate an inlet conveyance motor M2 which rotates an inlet roller pair 121, a buffer roller 124, and a first discharge roller pair, a stack delivery motor M3 which rotates an oscillation roller pair 127 and a return roller 130, an under-stack clutch CL which transmits the rotation of the stack delivery motor M3 to a lower roller 127*b* or disconnects the rotation, and the like on the basis of the above-mentioned sequence.

Note that the CPU circuit portion 200 and the finisher control portion 211 may be integrally formed.

The under-stack clutch CL shown in FIG. 4 is provided in order to absorb a speed difference. This is because, since the lower roller 127*b* and the return roller 130 to be described later are rotated by the common stack delivery motor M3, if slip occurs or a sheet conveyance speed difference is generated in both the rollers when a sheet or a sheet stack is conveyed by the lower roller 127*b* and the return roller 130, it is likely that wrinkles are formed on the sheet or the sheet stack or that the sheet or the sheet stack is scratched.

Explanation of an Action for Stitching and Discharging a Sheet Stack

When sheet stitch processing display of the operation portion 210 (see FIG. 2) of the copying machine 100 is selected by a user, the CPU circuit portion 200 controls the respective portions of the apparatus main body to shift the copying machine to a copying action and, at the same time, sends a sheet stitch processing signal to the finisher control portion 211.

Note that the explanation of actions on the basis of FIGS. 13A and 13B to 19 is an explanation of a case in which the CPU circuit portion 200 judges that a sheet is long on the basis of sheet size information inputted by the user in the operation portion 210 (e.g., the case of an A3 size sheet), or a case in which a sheet is a special sheet, which is provided with attributes different from an ordinary sheet, such as a thick sheet, a thin sheet, a tab sheet, or a sheet for color image formation, depending upon sheet type information. In other words, the explanation of actions on the basis of FIGS. 13A and 13B to 19 is an explanation of a case in which an action for stacking a buffer sheet to be described later on a processing tray 129 serving as sheet stacking means is started after a sheet stack is discharged to the stack tray 128, that is, a case in which sheets do not have to be stored during sheet processing. Note that it is needless to mention that actions to be described below may be performed regardless of a length of a sheet and whether or not a sheet is a special sheet.

The finisher control portion 211 activates the inlet conveyance motor M2 and the stack delivery motor M3 on the basis of a sheet stitch processing signal. In addition, the finisher control portion 211 operates a buffer roller estrangement plunger SL1 (see FIG. 4) to estrange the buffer roller 124 from the lower conveyance guide plate 123*b*, and further operates a not-shown plunger to estrange an upper roller 127*a* of the oscillation roller pair 127 from the lower roller 127*b*. Note that the activation and stop of the inlet conveyance motor M2 and the stack delivery motor M3 may be controlled in accordance with movement of a sheet one by one.

A first sheet, which has been sent from the discharge roller pair 120 of the apparatus main body 101 of the copying machine 100 (see FIG. 1), is conveyed to the inlet roller pair 121 according to conveyance of a receiving roller pair 137 and guidance of a flapper 122 shown in FIGS. 3 and 4. The receiving roller pair 137 is adapted to be rotated by the common conveyance motor M1 which rotates the discharge roller pair 120.

Figure 13A:
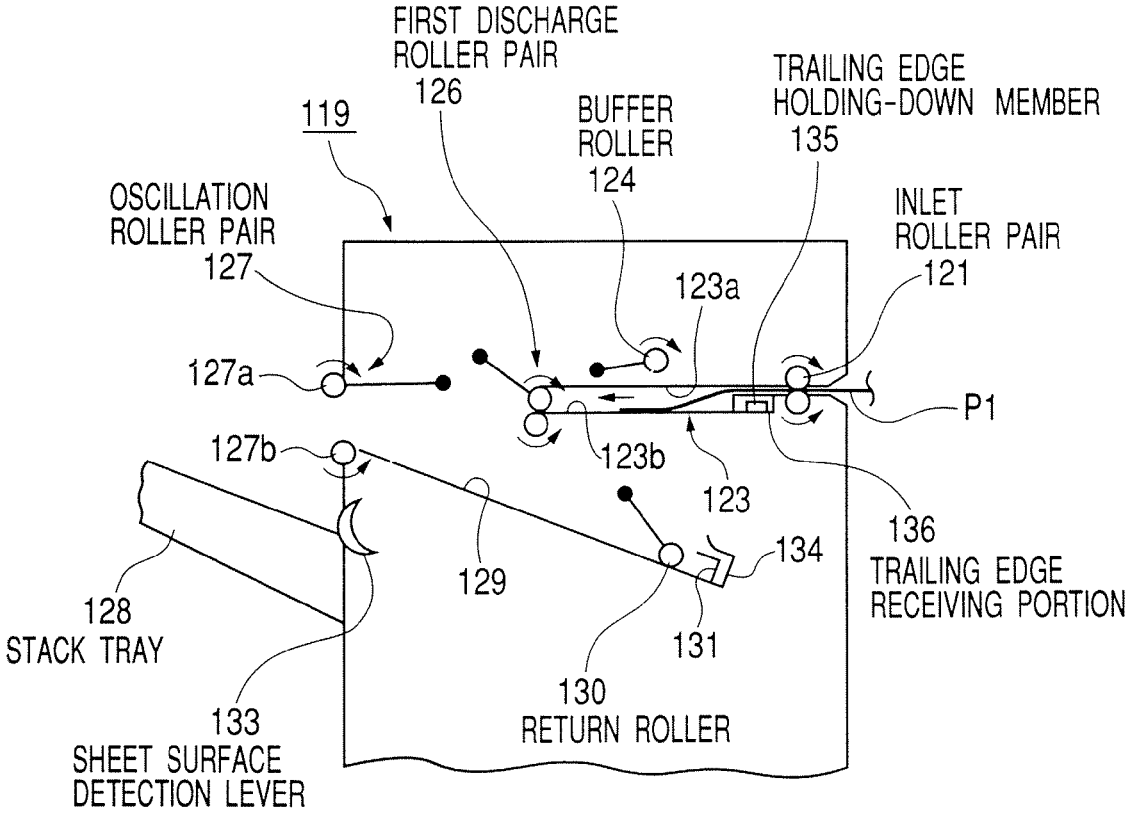
FIG. 13A is a diagram for explaining actions of the sheet processing apparatus in the case in which sheets do not have to be stored during sheet processing and shows a state in which a first sheet has been fed into the sheet processing apparatus.

As shown in FIG. 13A, the inlet roller pair 121 is rotated by the inlet conveyance motor M2 (see FIG. 4) to convey a first sheet P1. The sheet P1 is conveyed to a first discharge roller pair 126 according to guidance of the linearly constituted guide 123 which is composed of an upper conveyance guide plate 123*a* and a lower conveyance guide plate 123*b*.

Figure 13B:
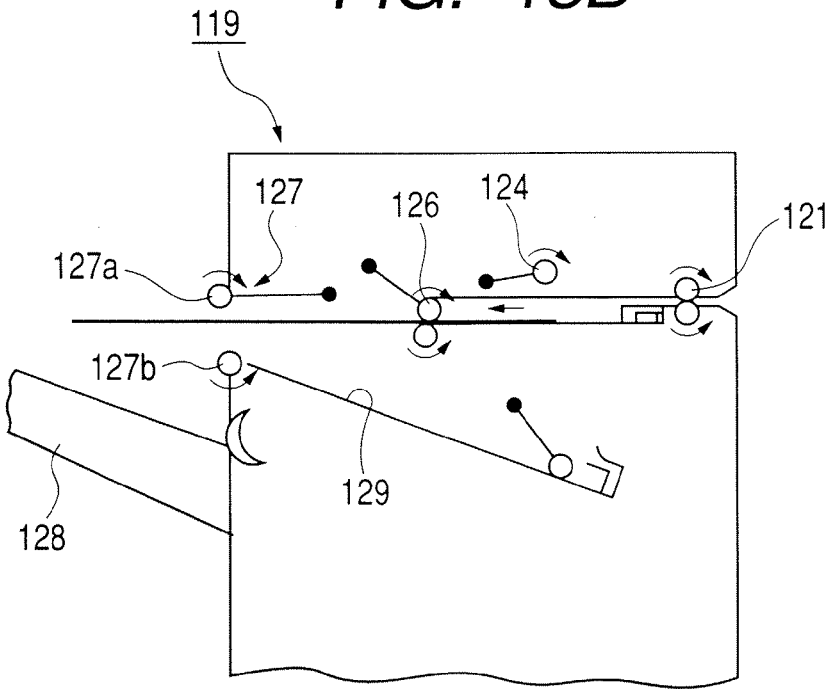
FIG. 13B is a diagram for explaining actions of the sheet processing apparatus in the case in which sheets do not have to be stored during sheet processing and shows a state in which the first sheet has been received.
Figure 14A:
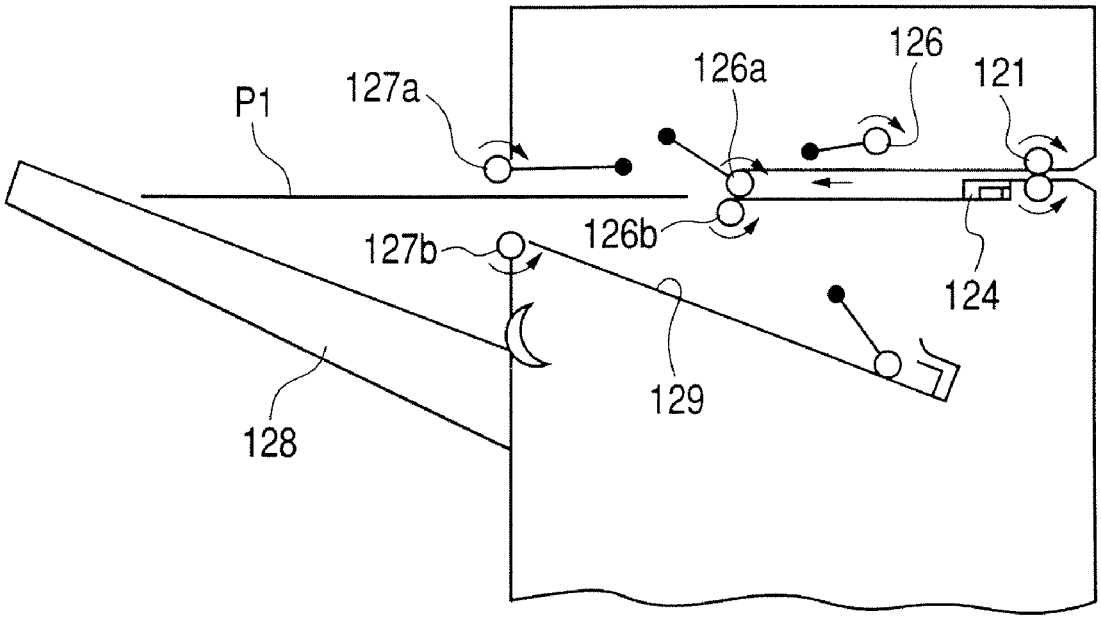
FIG. 14A is a diagram for explaining actions of the sheet processing apparatus following the actions of FIGS. 13A and 13B in the case in which sheets do not have to be stored during sheet processing and shows a state in which the first sheet has passed through a first discharge roller.
Figure 14B:
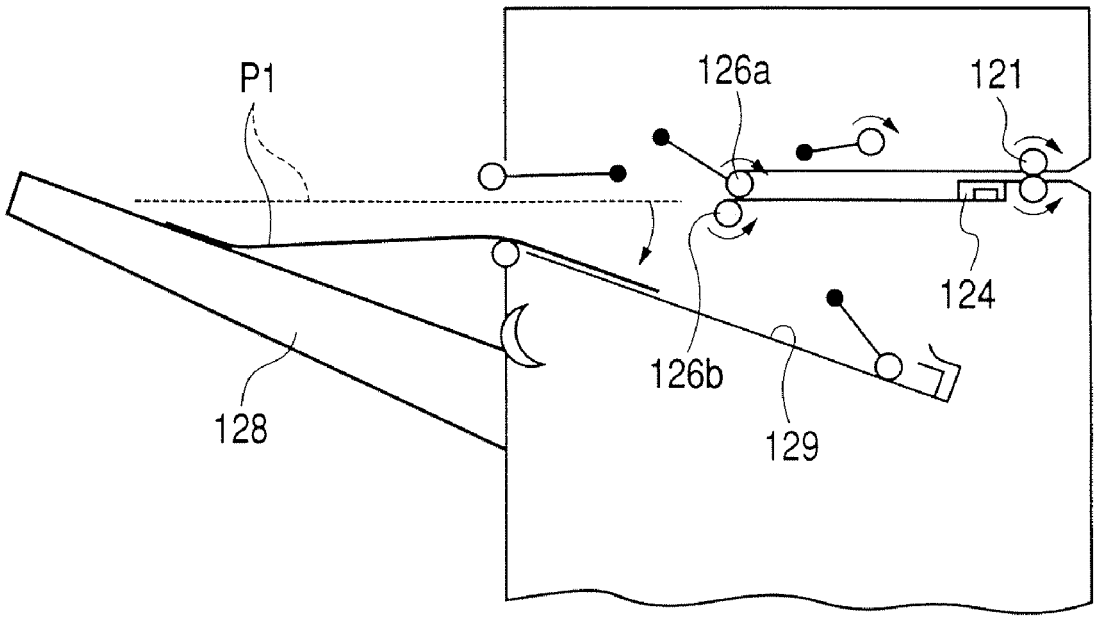
FIG. 14B is a diagram for explaining actions of the sheet processing apparatus following the actions of FIGS. 13A and 13B in the case in which sheets do not have to be stored during sheet processing and shows a state in which the first sheet has fallen over a stack tray and a processing tray.
Figure 15A:
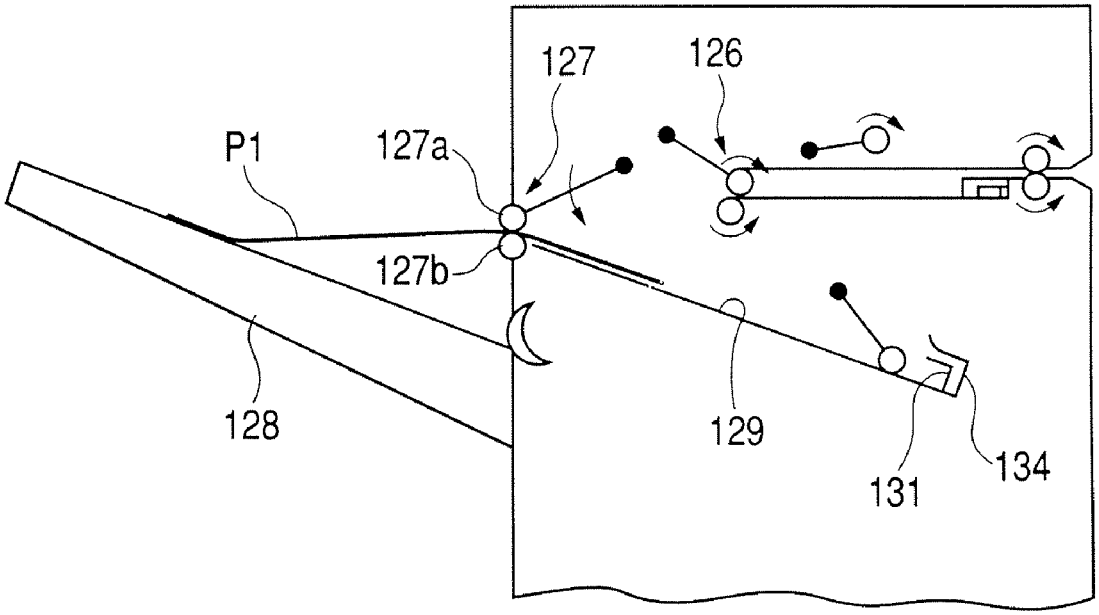
FIG. 15A is a diagram for explaining actions of the sheet processing apparatus following the actions of FIGS. 14A and 14B in the case in which sheets do not have to be stored during sheet processing and shows a state in which the first sheet is fed into the processing tray.
Figure 15B:
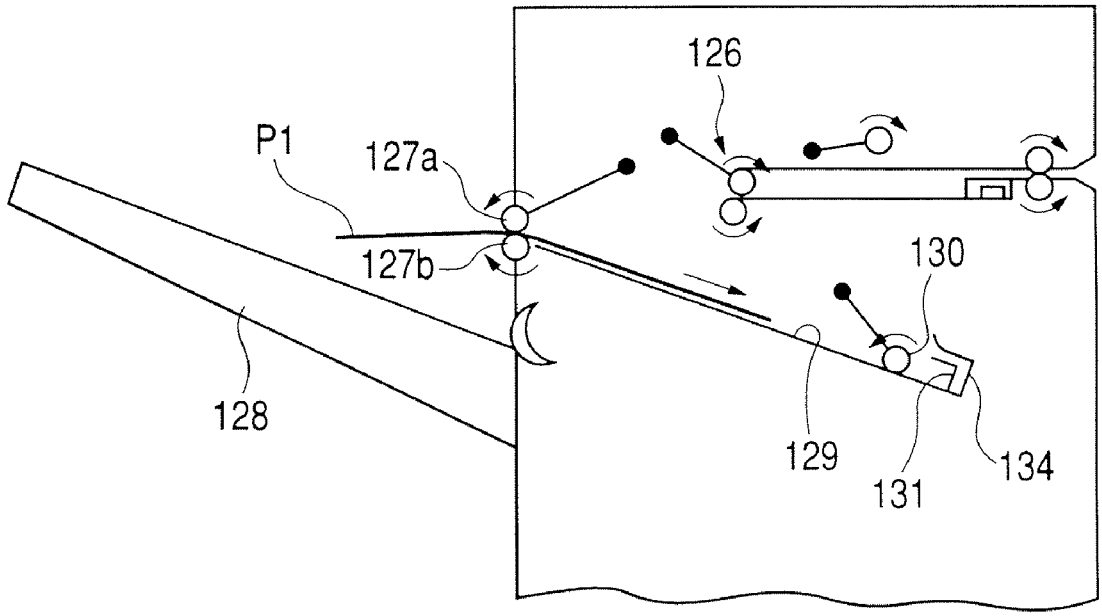
FIG. 15B is a diagram for explaining actions of the sheet processing apparatus following the actions of FIGS. 14A and 14B in the case in which sheets do not have to be stored during sheet processing and shows a state in which the first sheet is further fed into the processing tray.

As shown in FIG. 13B, the sheet P1 is further conveyed by the rotation of the first discharge roller pair 126 to be discharged to the stack tray 128 as shown in FIG. 14A. As shown in FIG. 14B, the sheet P1 falls over the stack tray 128 and the processing tray 129. Thereafter, as shown in FIGS. 15A and 15B, the upper roller 127*a* is lowered by the not-shown plunger to nip the sheet with the lower roller 127*b*.

At this point, the lower roller 127*b* has already been rotated in a direction of arrow by the upper roller 127*a* and the stack delivery motor M3 (see FIG. 4). Moreover, The return roller 130, which comes into contact with and moves away from the processing tray 129 freely, is also rotated in a direction of arrow by the stack delivery motor M3 (see FIG. 4). However, the lower roller 127*b* is adapted to be coupled with a driving force by an operation of the understack clutch CL (see FIG. 4) when a first sheet is conveyed, but is turned off and rotates idly when second and subsequent sheets are conveyed. This is because, when the second and subsequent sheets are stacked after the first sheet is stacked on the processing tray 129, if the lower roller 127*b* rotates, it is likely that the lower roller 127*b* pushes the first sheet into a side of a stopper 131 as a receiving stopper to cause wrinkles on the first sheet.

Figure 16A:
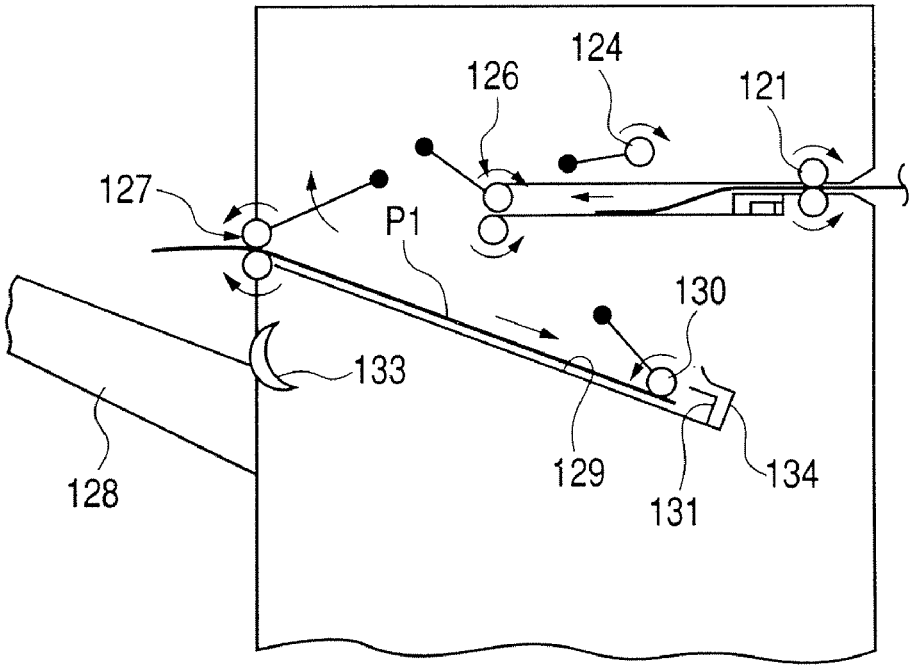
FIG. 16A is a diagram for explaining actions of the sheet processing apparatus following the actions of FIGS. 15A and 15B in the case in which sheets do not have to be stored during sheet processing and shows a state in which a second sheet has been fed into the sheet processing apparatus.
Figure 16B:
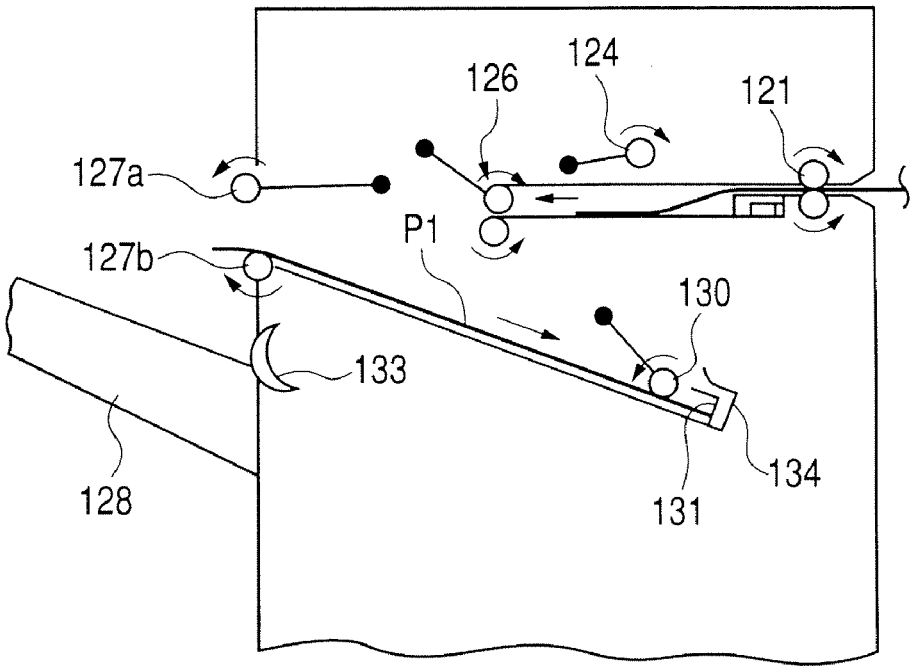
FIG. 16B is a diagram for explaining actions of the sheet processing apparatus following the actions of FIGS. 15A and 15B in the case in which sheets do not have to be stored during sheet processing and shows a state in which the first sheet has come into abutment against a stopper.

As shown in FIG. 16A, the sheet P1 slides down in a direction of arrow on the processing tray 129 slanting to the lower right according to the rotation of the oscillation roller pair 127 and the return roller 130. At this point, the trailing edge assist 134 stands by in a standby position. Then, before the sheet P1 comes into abutment against the stopper 131, the upper roller 127*a* moves away from the sheet P1. The sheet P1 is brought into abutment against the stopper 131 by the return roller 130. Thereafter, width alignment of the sheet P1 is performed by a pair of alignment plates 144*a* and 114*b* (see FIG. 5).

Figure 17:
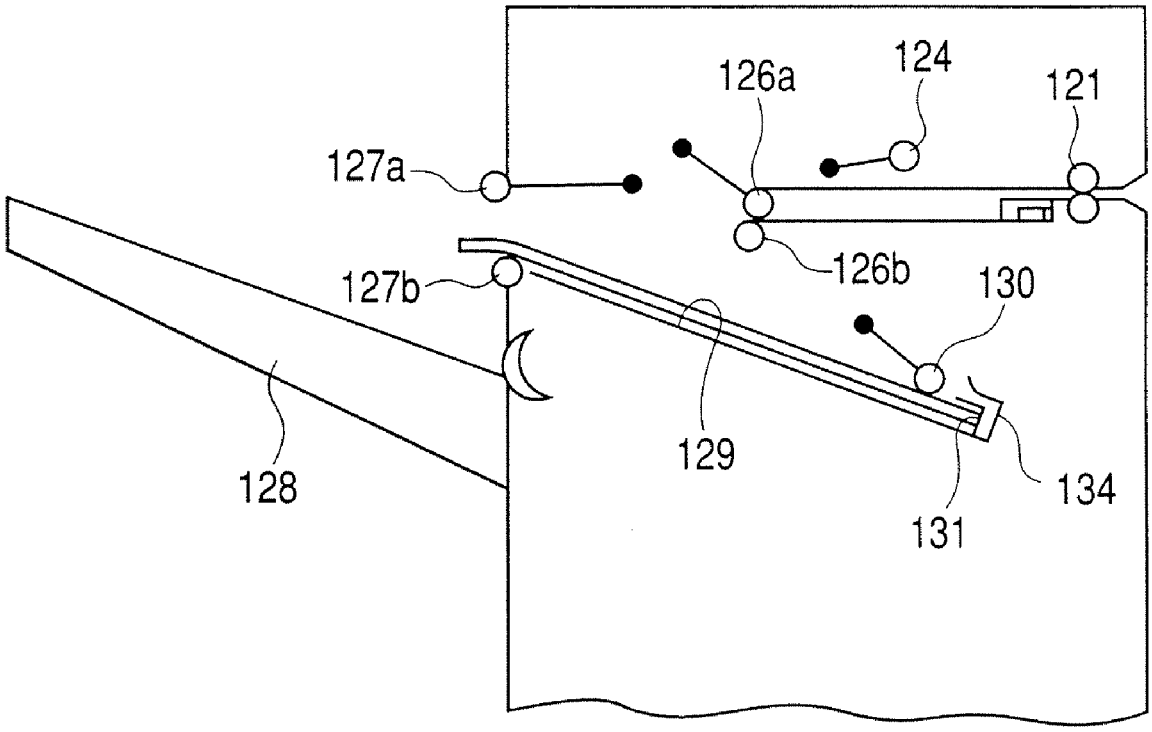
FIG. 17 is a diagram for explaining actions of the sheet processing apparatus in the case in which sheets do not have to be stored during sheet processing and shows a state in which a third sheet has been stacked on the processing tray.

Thereafter, the subsequent sheets are stacked on the processing tray 129 in the same manner. As shown in FIG. 17, when a predetermined number of sheets are stacked on the processing tray 129, the sheets in bundles are stitched by the stapler unit 132 shown in FIGS. 3 and 4. Note that, instead of applying the stitch processing to the sheet stack with the stapler unit 132, punch processing may be applied with a not-shown punch unit.

Figure 18A:
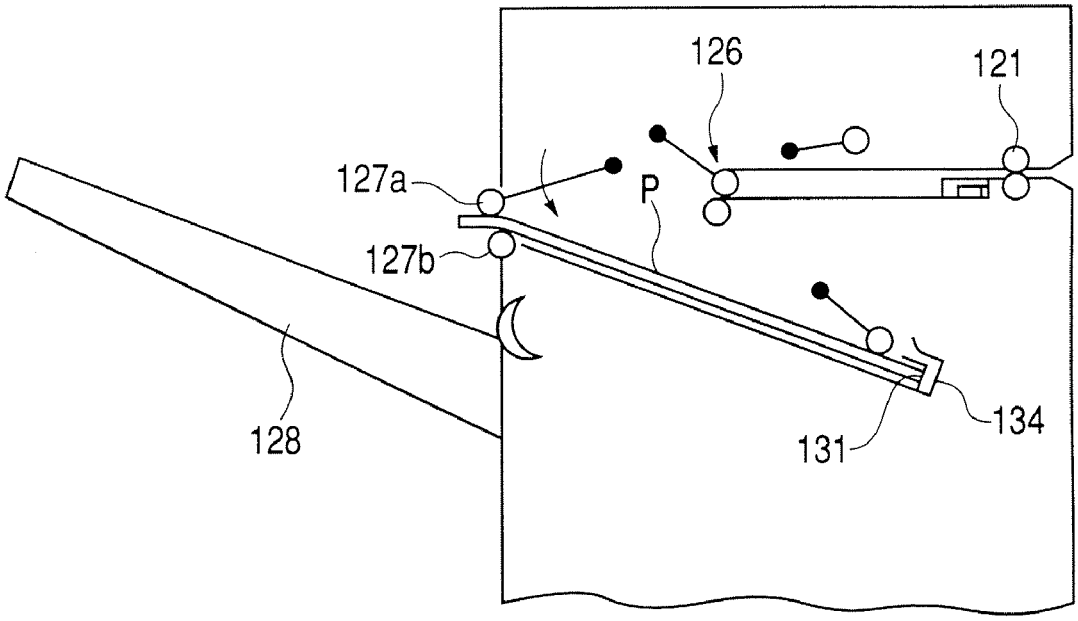
FIG. 18A is a diagram for explaining actions of the sheet processing apparatus following the actions of FIG. 17 in the case in which sheets do not have to be stored during sheet processing and shows a state in which a sheet stack is started to be discharged to a stack tray from the processing tray.

Actions of the sheet processing apparatus will be hereinafter described in accordance with a flowchart of FIG. 9. As shown in FIG. 18A, the upper roller 127*a* is lifted by the not-shown plunger and nips a sheet with the lower roller 127*b* (S101). After about 150 msec has elapsed (S103), the alignment plates 144 retract from a sheet stack (S104), and the stack tray 128 moves to a position where detection by the sheet surface detection lever 13 is effected, moves to a position to which the sheet stack is discharged, and stands by in a position where the stack tray 128 can easily receive the sheet stack to be discharged (S105).

Figure 5:
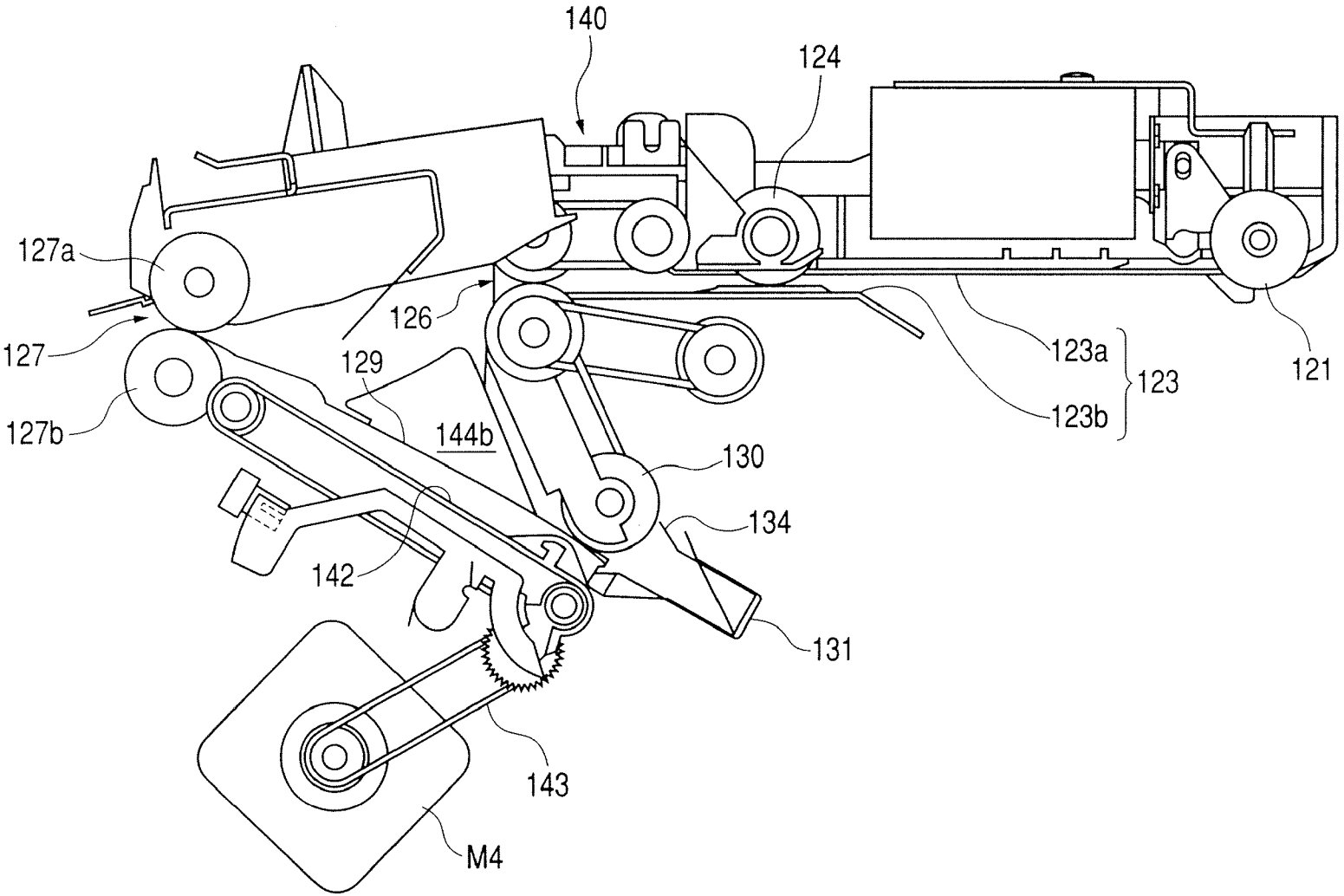
FIG. 5 is an enlarged view of a main part of the sheet processing apparatus according to the embodiment of the present invention.
Figure 18B:
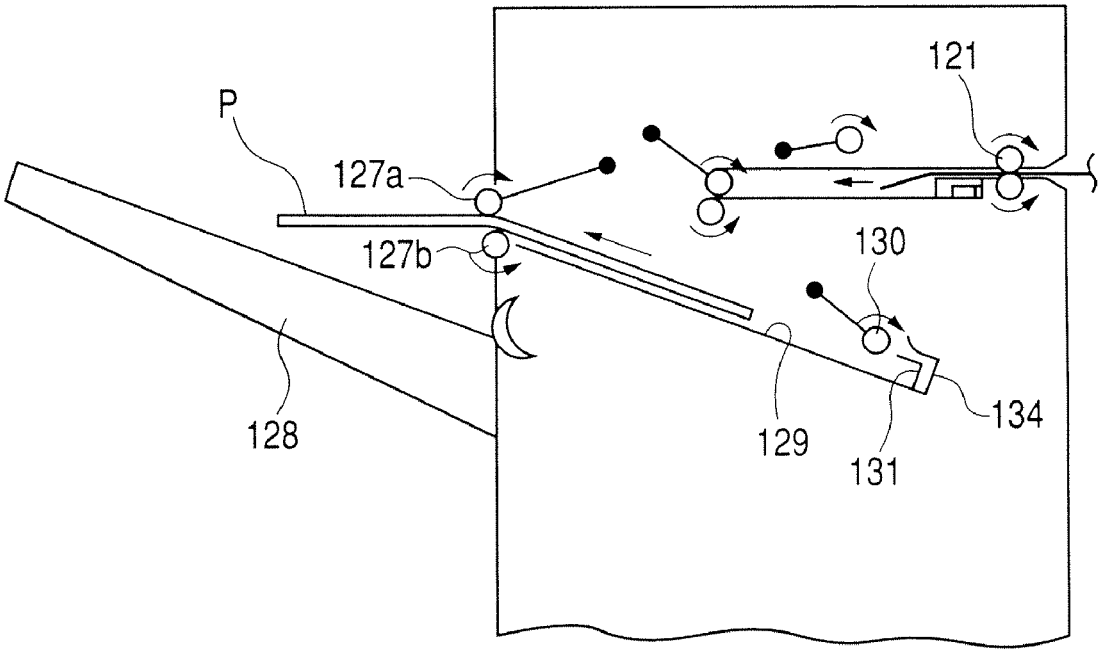
FIG. 18B is a diagram for explaining actions of the sheet processing apparatus following the actions of FIG. 17 in the case in which sheets do not have to be stored during sheet processing and shows a state in which a sheet stack is being discharged to a stack tray from the processing tray.

As shown in FIG. 18B, the upper roller 127*a* nips the sheet stack P with the lower roller 127*b* and rotates in a direction of arrow, and the trailing edge assist 134 pushes the trailing edge of the sheet stack P to discharge the sheet stack to the stack tray 128. As shown in FIGS. 5 to 7, the trailing edge assist 134 is provided in a belt 142 which is rotated regularly and reversely by a trailing edge assist motor M4.

At this point, as shown in FIGS. 10 and 11, if the oscillation roller pair 127 and the trailing edge assist 134 have the same start time (T1) and the same start speed (132 mm/sec) and reach the same acceleration end speed (500 mm/sec) at the same time (T2), the oscillation roller pair 127 and the trailing edge assist 134 can discharge the sheet stack without applying a tensile force or a compression force to the sheet stack (S106).

However, as shown in FIG. 11, the start speed of the trailing edge assist 134 may be lower than the start speed of the oscillation roller pair 127 due to belts 143, 142, and the like which transmit a rotation force of the trailing edge assist motor M4 to the trailing edge assist 134 (the start speed of the trailing edge assist 134 is assumed to be 300 mm/sec). In such a case, the trailing edge assist 134 is at rest without starting movement until a time T3 when the sheet conveyance speed of the oscillation roller pair 127 reaches 300 mm/sec, and starts movement when the sheet conveyance speed of the oscillation roller pair 127 has reached 300 mm/sec. In other words, the trailing edge assist 134 starts when time (T3−T1)=ΔT has elapsed after the oscillation roller pair 127 starts (S107). Note that, in the case in which the start speed of the oscillation roller pair 127 is higher than the start speed of the trailing edge assist 134, conversely, the start time of the oscillation roller pair 127 is delayed by ΔT. If the start speed of the trailing edge assist 134 and the start speed of the oscillation roller pair 127 are the same, ΔT is zero.

In this way, if the time difference of ΔT is provided for the start time, even if there is a difference in the start speeds of the oscillation roller pair 127 and the trailing edge assist 134, the oscillation roller pair 127 and the trailing edge assist 134 can discharge the sheet stack without applying a tensile force and a compression force to the sheet stack. In addition, there is no fear that scratch streak of a roller due to the oscillation roller pair 127 is left on the sheet to deteriorate quality of the sheet stack or quality of an image on the sheet stack.

Figure 19:
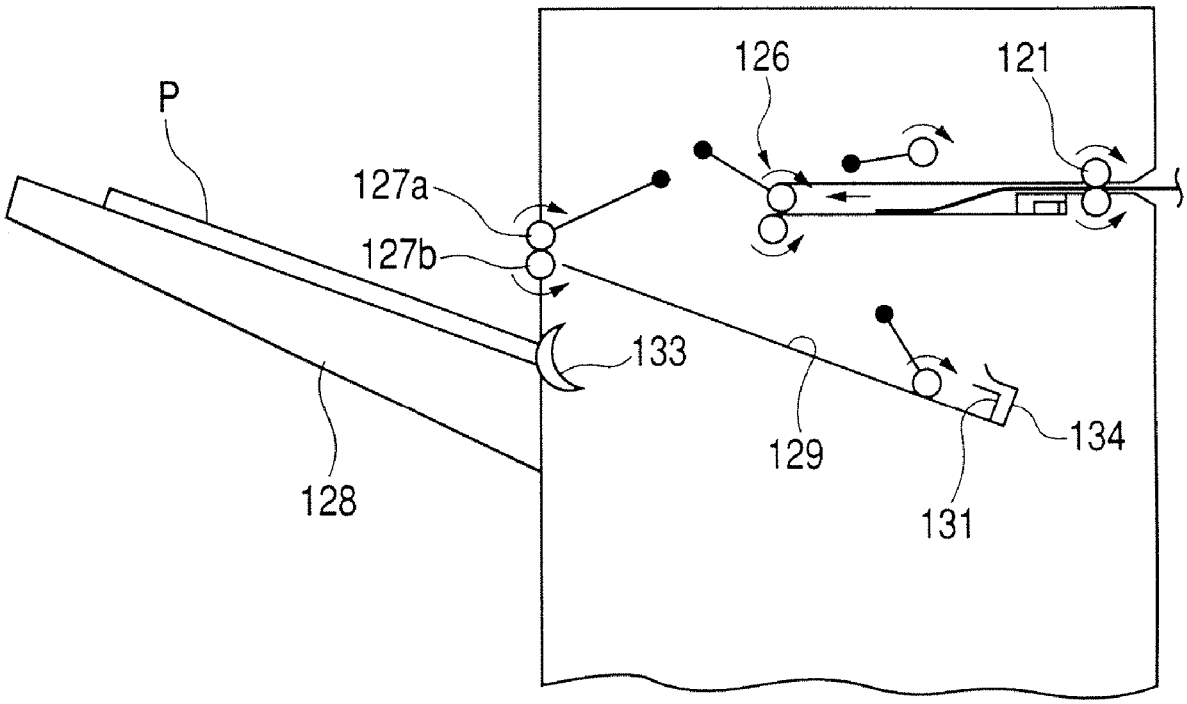
FIG. 19 is a diagram for explaining actions of the sheet processing apparatus in the case in which sheets do not have to be stored during sheet processing and shows a state in which the sheet stack has been discharged to the stack tray from the processing tray.

The sheet stack is started to be fed to the stack tray 128 by the oscillation roller pair 127, the trailing edge assist 134, and the return roller 130 (S108). The trailing edge assist 134 returns to an original position (home position) (S110, an action equivalent to "HP delivery control" in FIG. 12) at the point when the trailing edge assist 134 has moved about 15 mm (S109). As shown in FIG. 19, the sheet stack is discharged onto the stack tray 128 by the oscillation roller pair 127. Thereafter, at the point when the upper roller 127*a* of the oscillation roller pair 127 has estranged from the lower roller 127*b*, a series of sheet stack delivery actions end (S111, S112).

In FIG. 18B, when the sheet stack is started to be discharged, a first sheet of the next sheet stack has been fed into the inlet roller pair 121.

In the sheet processing apparatus 119 of this embodiment, since the trailing edge assist 134 pushes the trailing edge of the sheet stack to convey the sheet stack, unlike a case in which a roller is brought into pressed contact with the surface of the sheet stack and rotated to discharge the sheet stack, it is possible to convey the sheet stack surely without scratching the surface of the sheet stack.

Explanation of a Buffer Action

The above explanation of actions is an explanation of actions in the case in which a large interval is provided between sheets to be conveyed and stitch processing can be applied to a sheet stack while the next sheet is being fed into the sheet processing apparatus. The following explanation of actions is an explanation about a buffer action for, in the case in which an interval of conveyance of sheets is short and subsequent sheets are fed into the sheet processing apparatus while processing is being applied to a sheet stack, storing (buffering) the subsequent sheets only during stitch processing.

The sheet processing apparatus 119 performs a buffer action on the basis of a buffer action command of the finisher control portion 211 at the point when the CPU circuit portion 200 judges that an interval of sheets to be sent from the apparatus main body 101 of the copying machine 100 is shorter than a sheet stitch processing time. In this case, the buffer roller 124 is lowered by the plunger SL1 (see FIG. 4) and is in contact with the lower conveyance guide plate 123*b*.

Figure 20A:
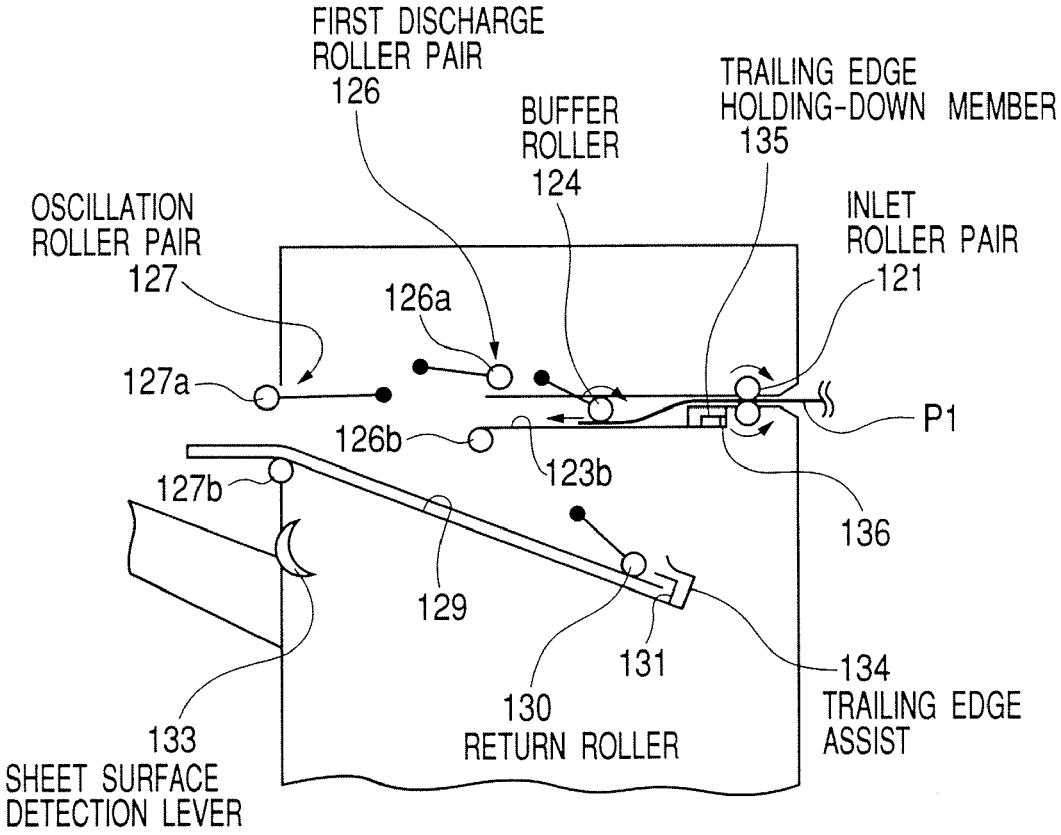
FIG. 20A is a diagram for explaining actions of the sheet processing apparatus in the case in which sheets are stored during sheet processing and shows a state in which a first sheet has been fed into the sheet processing apparatus.
Figure 20B:
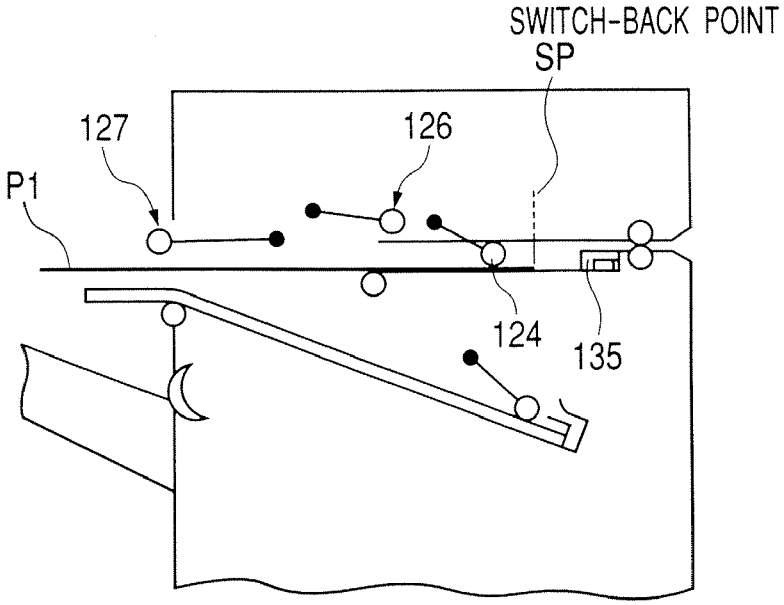
FIG. 20B is a diagram for explaining actions of the sheet processing apparatus in the case in which sheets are stored during sheet processing and shows a state in which the first sheet has been received up to a switch-back point.

In FIGS. 20A and 20B, it is assumed that a sheet stack is stacked on the processing tray 129 on the basis of the above-mentioned action. It is also assumed that the stitch processing is applied to the sheet stack by the stapler unit 132 (see FIGS. 3 and 4).

As shown in FIG. 20A, when a first sheet P1 of the next sheet stack is fed into the sheet processing apparatus 119 while staple processing is being applied to a sheet stack P stacked on the processing tray 129, the sheet P1 is fed into the buffer roller 124 by the inlet roller pair 121. The buffer roller 124 is rotated by the inlet conveyance motor M2 (see FIG. 4) to convey the sheet P1 downstream. At this point, an upper first discharge roller pair 126*a* of the first discharge roller pair 126 is estranged from a lower first discharge roller pair 126*b* by a first discharge roller estrangement plunger SL2 (see FIG. 4). Note that, the first discharge roller estrangement plunger SL2 is not shown in FIG. 4 because it overlaps the buffer roller estrangement plunger SL1. In addition, the upper roller 127*a* of the oscillation roller pair 127 is also estranged from the lower roller 127*b* by the not-shown plunger.

Figure 21A:
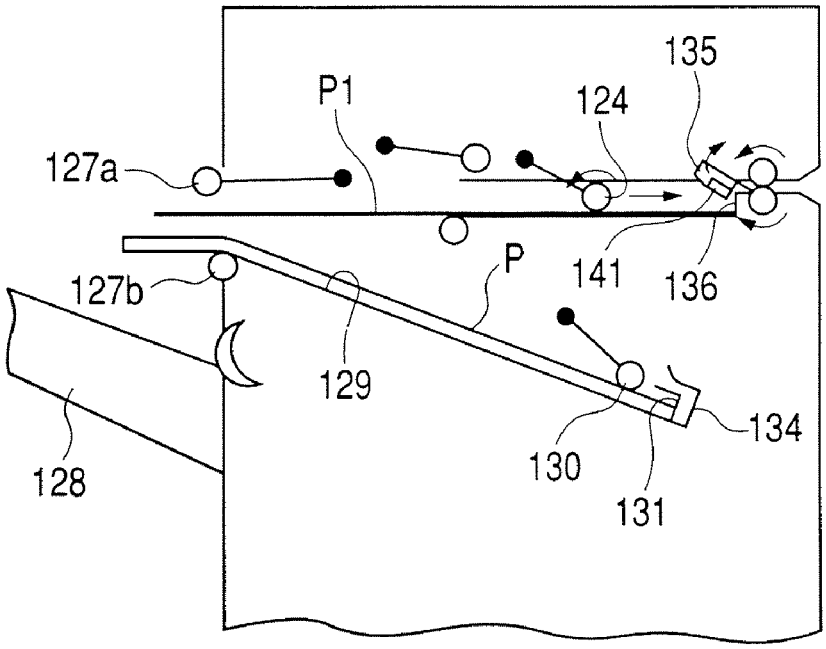
FIG. 21A is a diagram for explaining actions of the sheet processing apparatus following the actions of FIGS. 20A and 20B in the case in which sheets are stored during sheet processing and shows a state in which the first sheet has been received by a trailing edge receiving portion.

As shown in FIG. 20B, when the trailing edge of the sheet P1 has reached the switch-back point SP, the sheet P1 is returned to the upstream side by reverse rotation of the buffer roller 124 as shown in FIG. 21A. Substantially simultaneously with this, a trailing edge holding-down member 135 is estranged from the lower conveyance guide plate 123*b*, and a trailing edge receiving portion 136 is opened. It can be detected that the trailing edge of the sheet P1 has reached the switch-back point SP when a predetermined time has elapsed after an inlet path sensor S1, which is disposed in the vicinity of the downstream side of the inlet roller pair 121 shown in FIG. 4, is operated by the leading edge (downstream side edge) of the sheet or according to the rpm of rotations or the like of the buffer roller 124.

Figure 21B:
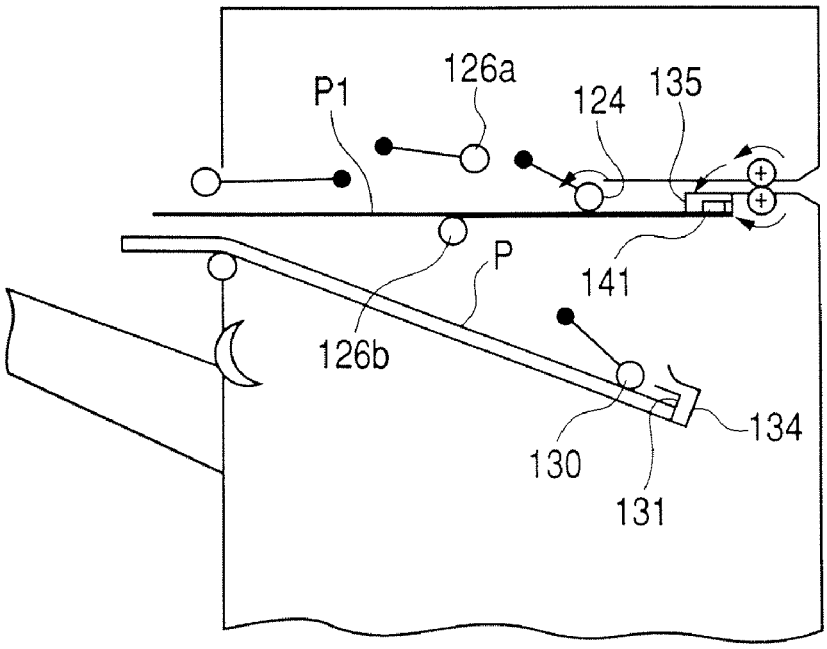
FIG. 21B is a diagram for explaining actions of the sheet processing apparatus following the actions of FIGS. 20A and 20B in the case in which sheets are stored during sheet processing and shows a state in which the first sheet has been held down to a lower conveyance guide plate by a trailing edge holding-down member.

The upstream edge side of the sheet P1 after the downstream edge of the sheet is detected is received by the trailing edge receiving portion 136 as shown in FIG. 21A. Thereafter, as shown in FIG. 21B, the trailing edge holding-down member 135 returns to the original position and presses the sheet P1 against the lower conveyance guide plate 123*b* with a friction member 141 provided in the trailing edge holding-down member 135.

Figure 22A:
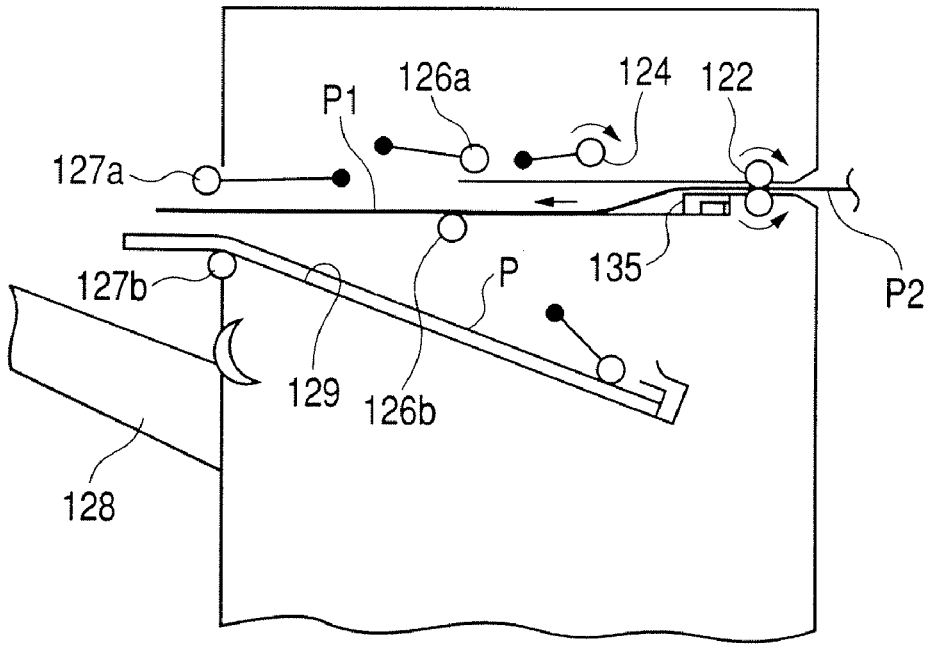
FIG. 22A is a diagram for explaining actions of the sheet processing apparatus following the actions of FIGS. 21A and 21B in the case in which sheets are stored during sheet processing and shows a state in which a second sheet has been fed into the sheet processing apparatus.
Figure 22B:
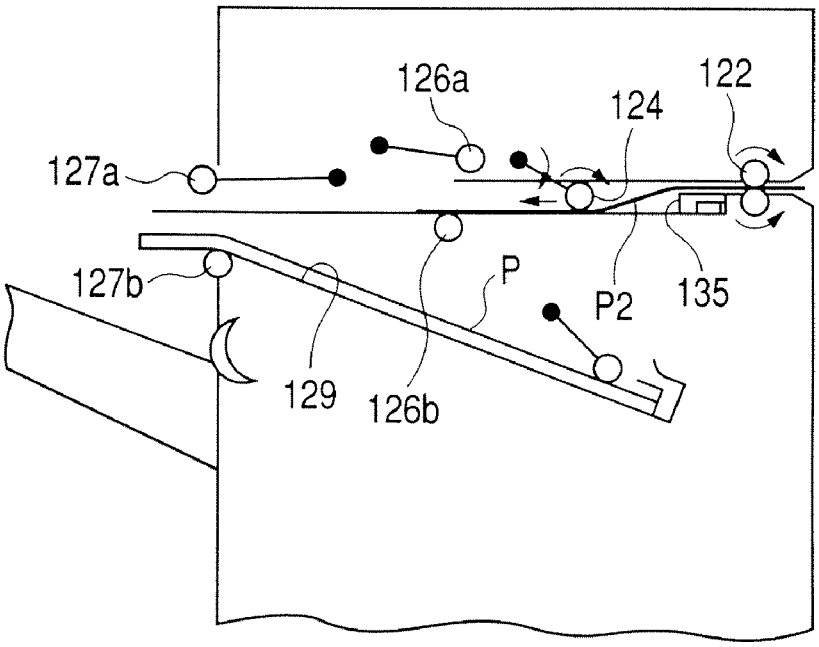
FIG. 22B is a diagram for explaining actions of the sheet processing apparatus following the actions of FIGS. 21A and 21B in the case in which sheets are stored during sheet processing and shows a state in which the second sheet has been further fed into the sheet processing apparatus.

Thereafter, as shown in FIG. 22A, a second sheet P2 is fed into the sheet processing apparatus 119. The second sheet P2 is conveyed by the inlet roller pair 121. At this point, the sheet P2 passes on the trailing edge holding-down member 135. Thereafter, as shown in FIG. 22B, the sheet P2 is also conveyed by the buffer roller 124.

At this point, the first sheet P1 is pressed against the lower conveyance guide plate 123*b* together with the second sheet P2 by the buffer roller 124 and is about to move to the downstream side following the second sheet P2 being conveyed. However, since the first sheet P1 is pressed against the lower conveyance guide plate 123*b* by the friction member 141 provided in the trailing edge holding-down member 135, the first sheet P1 never moves.

Figure 23A:
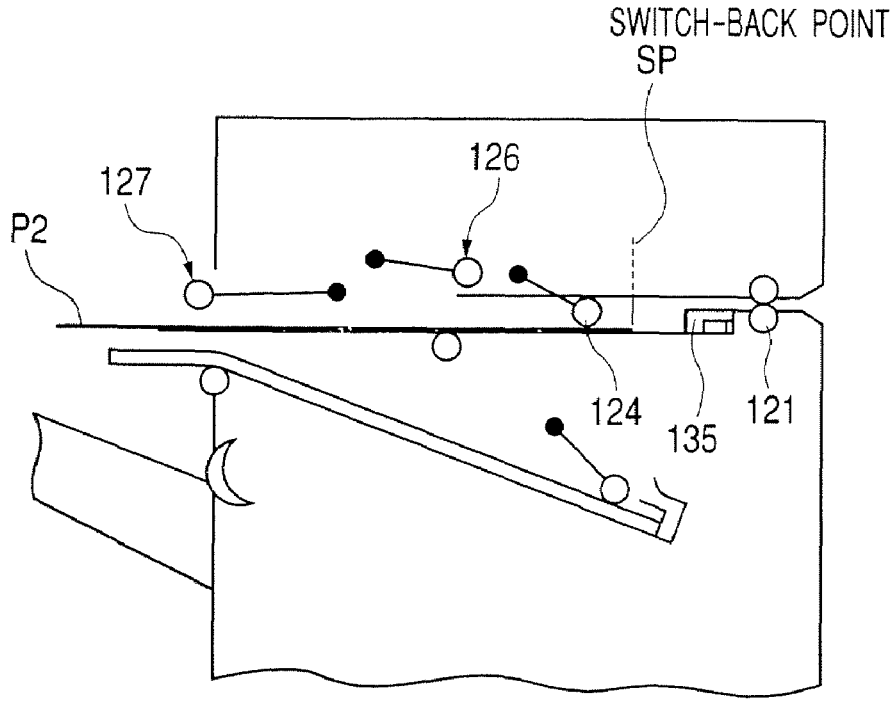
FIG. 23A is a diagram for explaining actions of the sheet processing apparatus following the actions of FIGS. 22A and 22B in the case in which sheets are stored during sheet processing and shows a state in which the second sheet has been received up to the switch-back point.
Figure 23B:
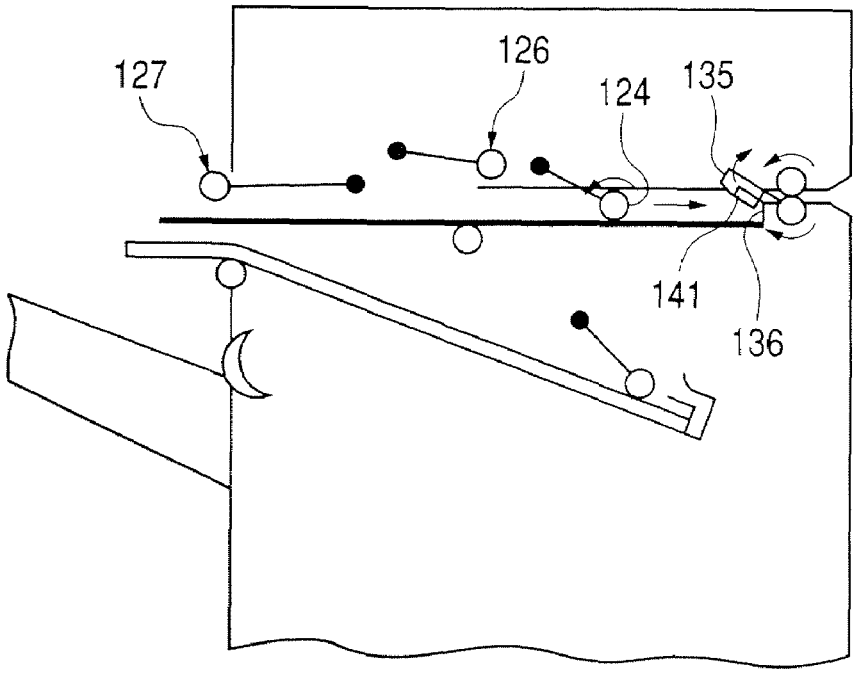
FIG. 23B is a diagram for explaining actions of the sheet processing apparatus following the actions of FIGS. 22A and 22B in the case in which sheets are stored during sheet processing and shows a state in which the second sheet has been received by a trailing edge receiving portion.
Figure 24:
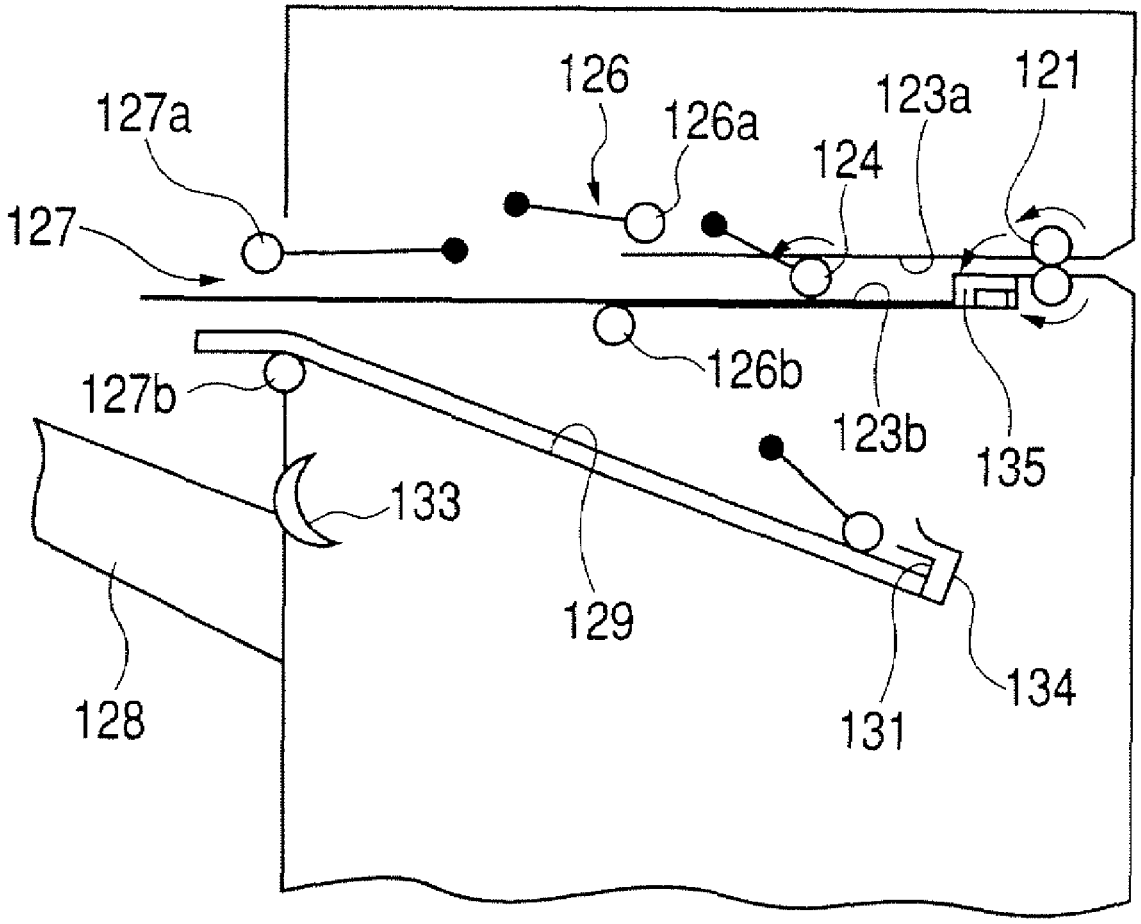
FIG. 24 is a diagram for explaining actions of the sheet processing apparatus in the case in which sheets are stored during sheet processing and shows a state in which the first and the second sheets are laid one on top of another and held down to the lower conveyance guide plate by the trailing edge holding-down member.

The second sheet P2 is also returned to the upstream side as shown in FIGS. 23A, 23B, and 24 when the trailing edge thereof has reached the switch-back point SP in the same manner as the first sheet P1. Then, the second sheet P2 is laid on the first sheet P1 and pressed against the lower conveyance guide plate 123*b* by the friction member 141 of the trailing edge holding-down member 135.

Figure 25A:
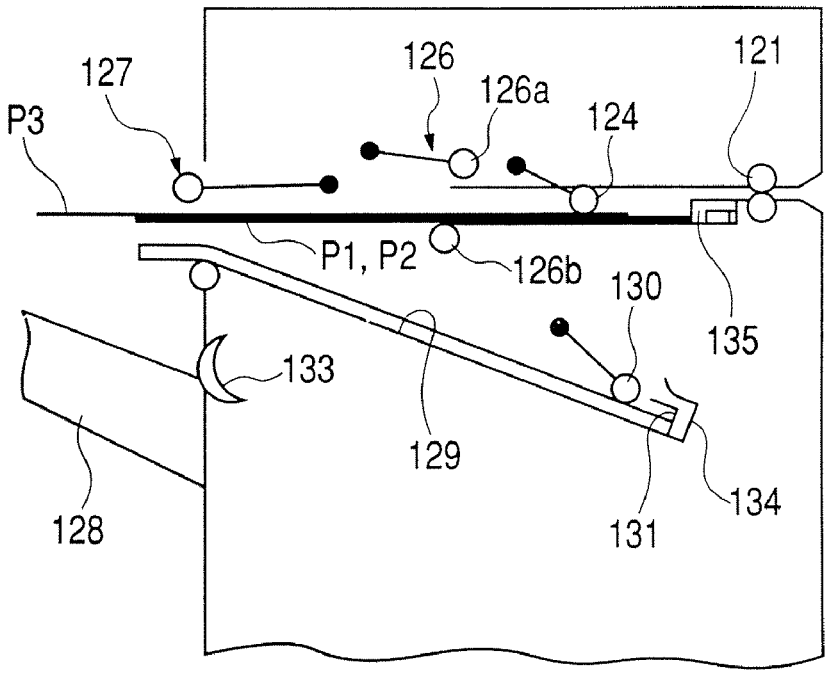
FIG. 25A is a diagram for explaining actions of the sheet processing apparatus following the actions of FIG. 24 in the case in which sheets are stored during sheet processing and shows a state in which a third sheet has been fed into the sheet processing apparatus.
Figure 25B:
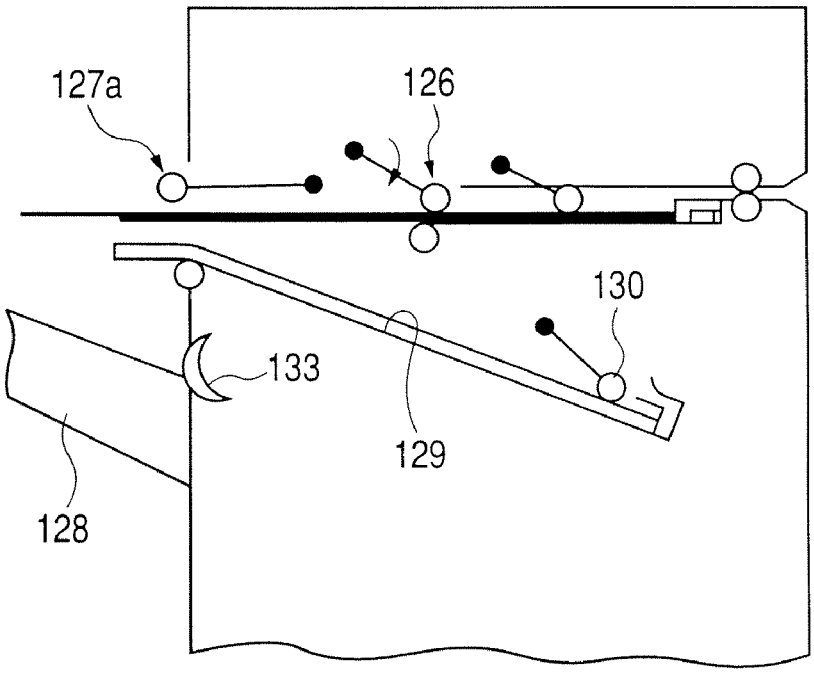
FIG. 25B is a diagram for explaining actions of the sheet processing apparatus following the actions of FIG. 24 in the case in which sheets are stored during sheet processing and shows a state in which the third sheet has been fed into the sheet processing apparatus.
Figure 26A:
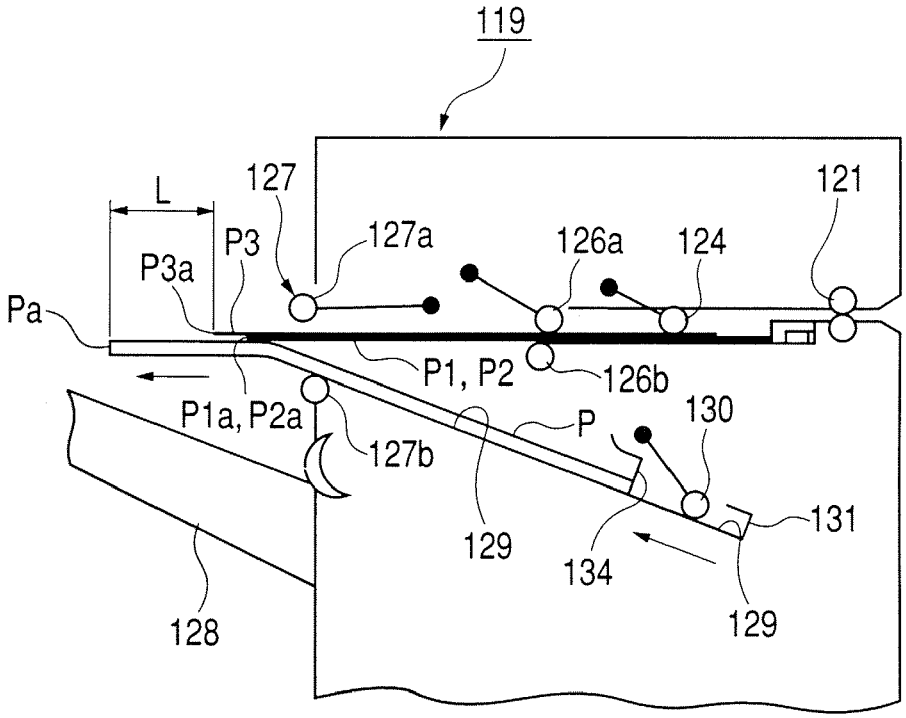
FIG. 26A is a diagram for explaining actions of the sheet processing apparatus following the actions of FIGS. 25A and 25B in the case in which sheets are stored during sheet processing and shows a state in which a sheet stack is started to be discharged to the stack tray from the processing tray.

Thereafter, when a third sheet P3 is fed into the sheet processing apparatus 119 and the trailing edge thereof passes through the inlet roller pair 121 as shown in FIG. 25A, the upper first discharge roller pair 126*a* nips the first to the third sheets with the lower first discharge roller pair 126*c* as shown in FIG. 25B. At this point, the third sheet P3 slightly projects further to the downstream side than the first and the second sheets P1 and P2. In addition, around this point, since the stitch processing with respect to the sheet stack on the processing tray 129 has ended, as shown in FIG. 26A, the trailing edge assist 134 moves along the processing tray 129 to lift the trailing edge of the sheet stack. As a result, a downstream edge Pa of the sheet stack P projects further to the downstream side by a length L than a downstream edge P3*a* of the third sheet P3.

Figure 26B:
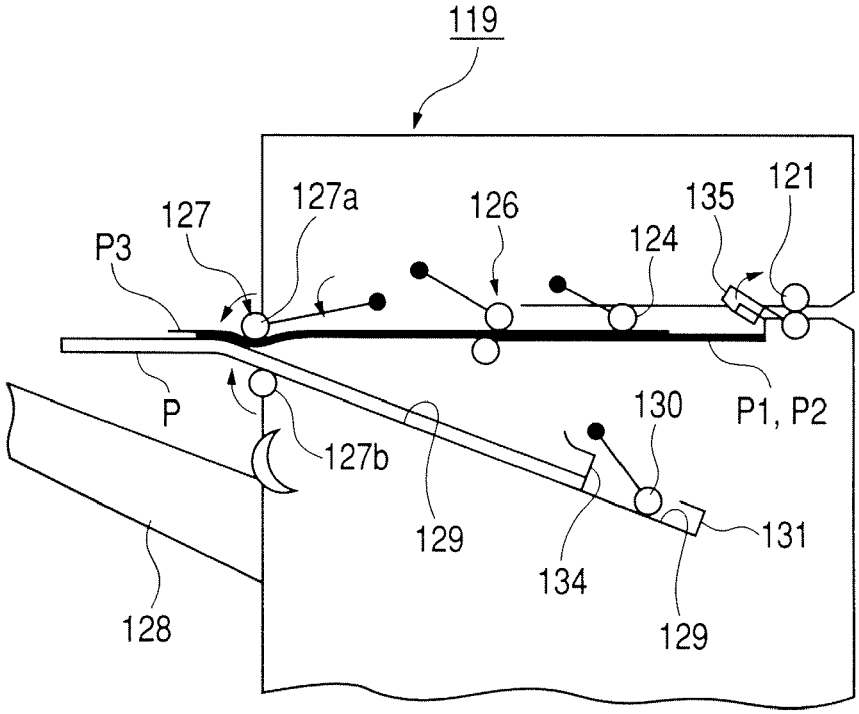
FIG. 26B is a diagram for explaining actions of the sheet processing apparatus following the actions of FIGS. 25A and 25B in the case in which sheets are stored during sheet processing and shows a state in which the sheet stack and a buffer sheet are being conveyed in a discharge direction.

Then, as shown in FIG. 26B, the upper roller 127*a* also moves down and nips the three sheets P1, P2 and P3, and the sheet stack P with the lower roller 127*b*. Following this, the trailing edge holding-down member 135 is estranged from the second sheet P2 to release the first sheet P1 and the second sheet P2.

Figure 27A:
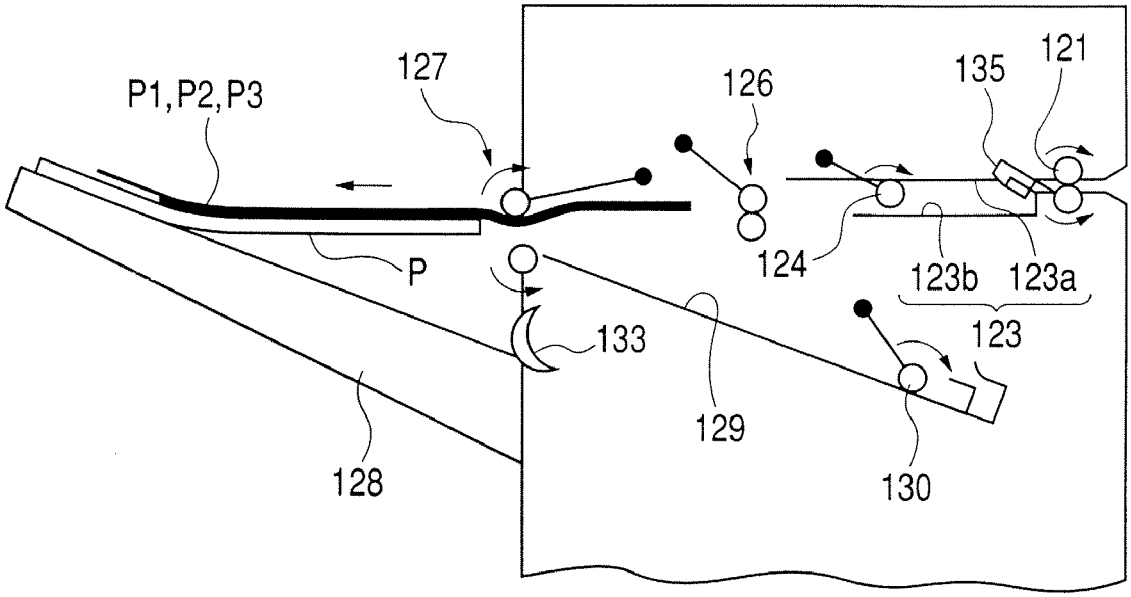
FIG. 27A is a diagram for explaining actions of the sheet processing apparatus following the actions of FIGS. 26A and 26B in the case in which sheets are stored during sheet processing and shows a state in which the sheet stack has been discharged to the stack tray from the processing tray.

Thereafter, the three sheets P1, P2 and P3, and the sheet stack P are nipped and conveyed by the oscillation roller pair 127. Then, as shown in FIGS. 27A and 27B, when the sheet stack P is discharged to the stack tray 128, the trailing edges of the first sheet P1 and the second sheet P2 slip out of the first discharge roller pair 126, and the upstream side portions of the three sheets are received by the processing tray 129.

Figure 27B:
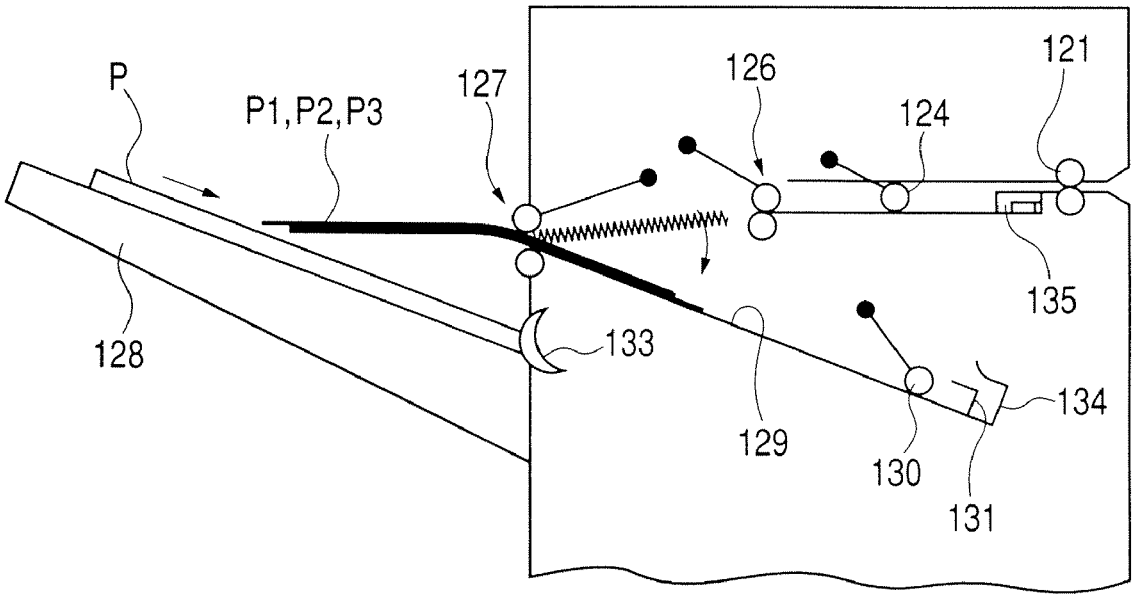
FIG. 27B is a diagram for explaining actions of the sheet processing apparatus following the actions of FIGS. 26A and 26B in the case in which sheets are stored during sheet processing and shows a state in which the buffer sheet is being fed into the processing tray.

In FIG. 27B, as shown in FIGS. 11 and 12, if the first discharge roller pair 126, the oscillation roller pair 127, and the trailing edge assist 134 have the same start time (T1) and the same start speed (132 mm/sec) and reach the same acceleration end speed (500 mm/sec) at the same time (T2), the first discharge roller pair 126, the oscillation roller pair 127, and the trailing edge assist 134 can discharge the sheet stack without applying a tensile force or a compression force to the sheet stack and the three sheets. However, in the case in which there is a difference in start speeds, as in S107 in FIG. 9, the first discharge roller pair 126, the oscillation roller pair 127, and the trailing edge assist 134 can discharge the sheet stack without applying a tensile force or a compression force to the sheet stack and the three sheets if a time difference of ΔT is provided to start them. In addition, there is no fear that scratch streak of a roller due to the first discharge roller pair 126 and the oscillation roller pair 127 is left on the sheet to deteriorate quality of the sheet stack or quality of an image on the sheet stack.

Figure 28A:
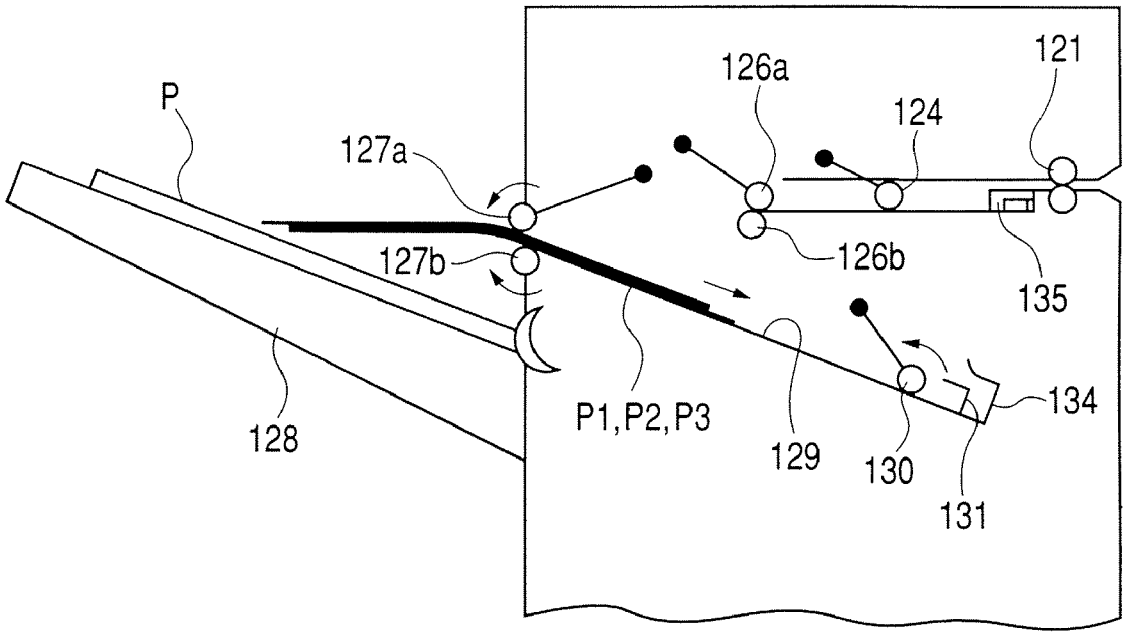
FIG. 28A is a diagram for explaining actions of the sheet processing apparatus following the actions of FIGS. 27A and 27B in the case in which sheets are stored during sheet processing and shows a state in which the buffer sheet is being fed into the processing tray.
Figure 28B:
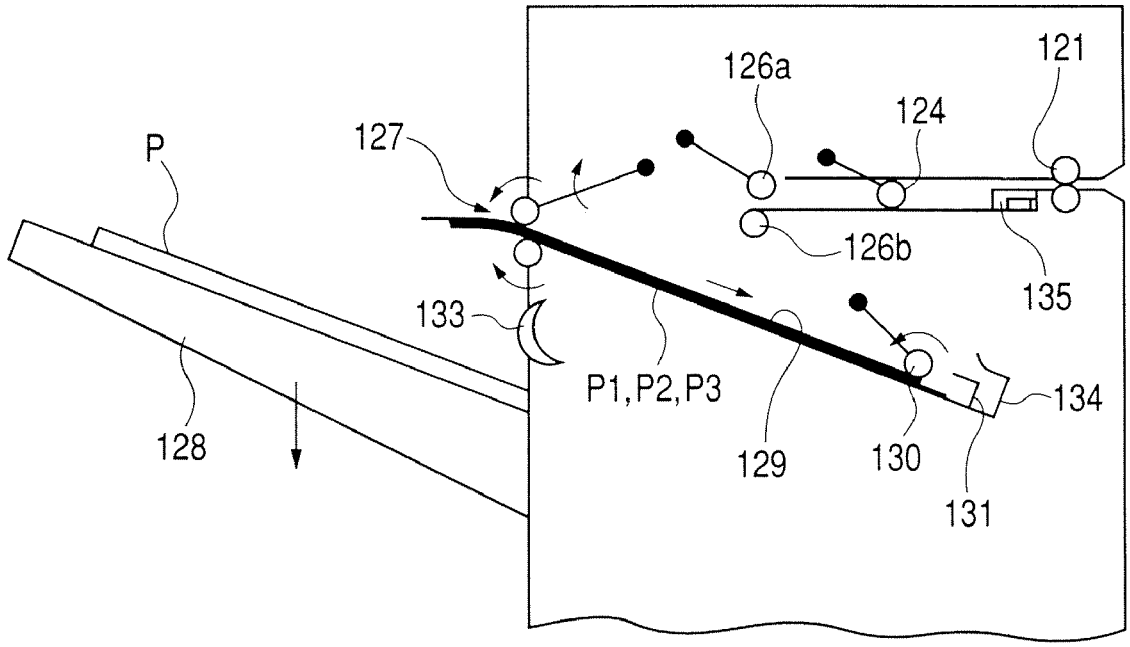
FIG. 28B is a diagram for explaining actions of the sheet processing apparatus following the actions of FIGS. 27A and 27B in the case in which sheets are stored during sheet processing and shows a state in which the buffer sheet is being further fed into the processing tray.

As shown in FIGS. 28A and 28B, the three sheets are slid down and conveyed on the processing tray 129 by the oscillation roller pair 127 and the return roller 130 and received by the stopper 131. During this action, the stack tray 128 moves down once and moves up again after lowering the upper surface of the sheet stack to a position lower than the sheet surface detection lever 133. At the point when the sheet surface detection lever 133 is operated by the upper surface of the sheet stack, the stack tray 128 stops moving up. As a result, the upper surface of the sheet stack on the stack tray 128 can be held at a predetermined height. Thereafter, the sheets are sequentially stacked on the processing tray 129 without being stored on the lower conveyance guide plate 123*b*. When the number of the sheets has reached a predetermined number, the sheets are stitched. During this stitch action, first three sheets of the next sheet stack are stored on the lower conveyance guide plate 123*b*.

Note that, although three sheets are stored on the lower conveyance guide plate 123*b* in the above description, the number of sheets (buffer sheets) to be stored is not limited to three because the number of sheets that can be stored varies according to a length of sheets, a stitching time, a conveyance speed of sheets, and the like.

As described above, in the sheet processing apparatus 119 of this embodiment, the downstream edge Pa of the sheet stack P is projected to the downstream side P3*a* of the third sheet P3 by a length L. The reason for this is as described below. Note that the downstream edges P1*a* and P2*a* of the first and the second sheets P1 and P2 are located further on the upstream side than the downstream edge P3*a* of the third sheet P3.

Figure 29:
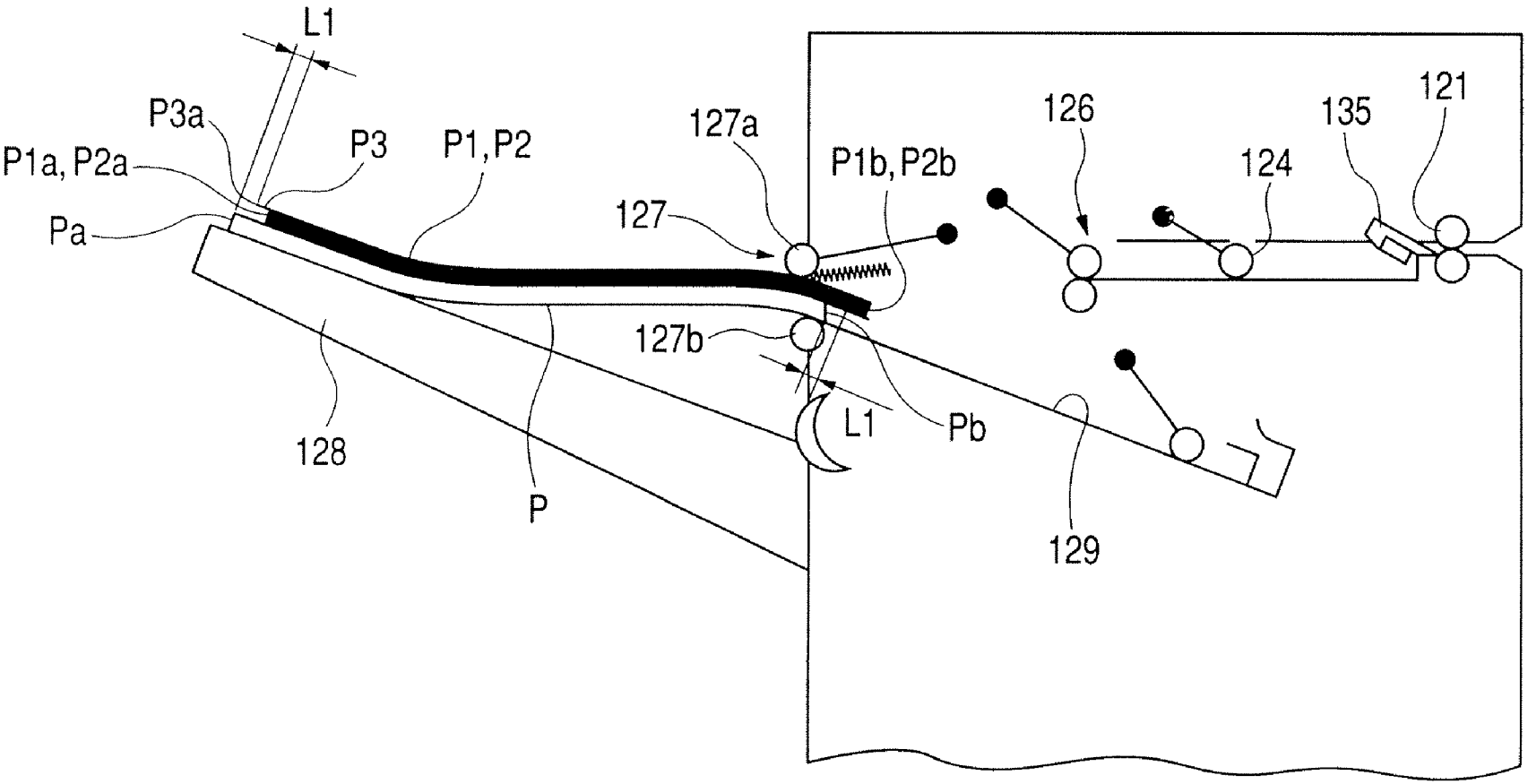
FIG. 29 is a diagram for explaining actions of the sheet processing apparatus in the case in which a projection length of a downstream edge of a sheet stack from a downstream edge of a buffer sheet is short.

As shown in FIG. 29, if a projecting length of the downstream edge of the sheet stack P is L1 which is shorter than the length L, a projecting length of the upstream edge of the sheet P3 is also L1. Consequently, after the oscillation roller pair 127 has discharged the sheet stack P to the stack tray 128, it is possible that a length for gripping three buffer sheets is reduced, and the oscillation roller pair 127 fails to grip the three buffer sheets and cannot feed them to the processing tray 129 surely. Therefore, the sheet stack is projected by the length L with respect to the downstream edge P3*a* of the sheet P3 such that the oscillation roller pair 127 can grip buffer sheets surely and feed them into the processing tray 129.

In addition, if the projecting length is short, a contact area of a buffer sheet and a sheet stack is increased, and the sheet stack tends to adhere to the buffer sheet and fall on the stack tray 128 slowly. In such a case, when the oscillation roller pair 127 rotates reversely to feed the buffer sheet into the processing tray 129, it is likely that the sheet stack enters the oscillation roller pair 127 while keeping on sticking to the buffer sheet to scratch the sheet stack or cause sheet jam. Therefore, in order to improve a separation property of the sheet stack and the buffer sheet, the sheet stack is projected by the length L with respect to the downstream edge P3*a* of the sheet P3.

In addition to the above, the sheet processing apparatus 119 of this embodiment is adapted such that the trailing edge assist 134 pushes the trailing edge of a sheet stack. If the trailing edge of the sheet stack is pushed by the trailing edge assist 134 to convey the sheet stack in this way, unlike a case in which a roller is brought into pressed contact with the surface of the sheet stack and rotated to discharge the sheet stack, it is possible to convey the sheet stack surely without scratching the surface of the sheet stack.

Figure 30:
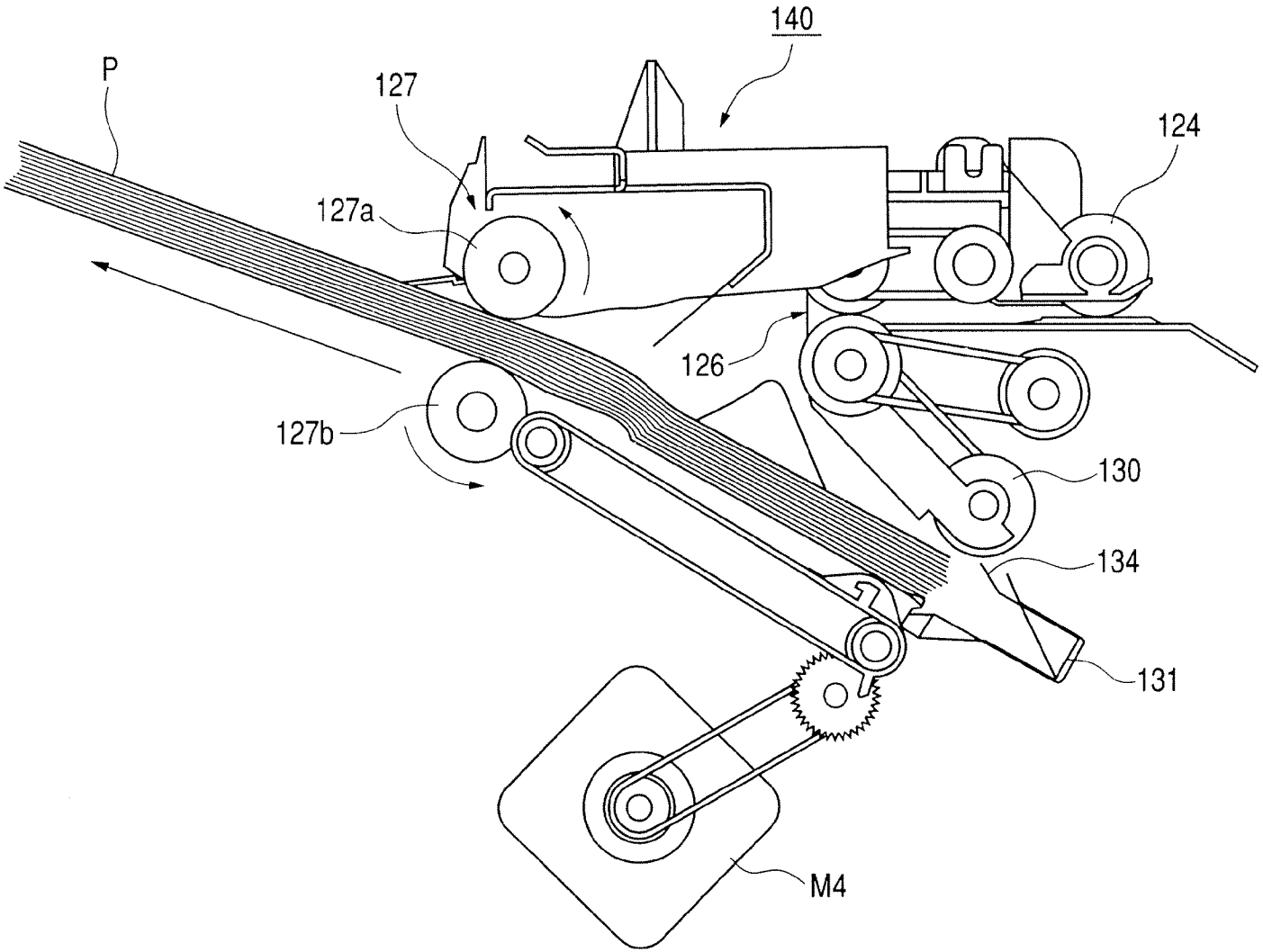
FIG. 30 is a diagram for explaining problems in the case in which a sheet stack is discharged only by an oscillation roller.

In other words, as shown in FIG. 30, if a sheet stack is discharged only by the oscillation roller pair 127, it is possible that deviation occurs between an upper sheet and a lower sheet because an amount of conveyance of sheets is different due to the difference in friction between the upper roller 127*a* and the lower roller 127*b* against a sheet, the difference in rotation speed, or the like. In such a case, the oscillation roller pair 127 may slide and rotate with respect to the sheet causing scratches on the sheet. In addition, the oscillation roller pair 127 may discharge the sheet stack while twisting the entire sheet stack. As a result, the sheet stack cannot be discharged smoothly, and processing requires long time. Moreover, in the case in which the entire sheet stack is twisted, it is likely that the sheet is torn in stitched parts, and the sheet stack cannot be used.

In addition, such a phenomenon tends to occur if a nipping pressure of the oscillation roller pair 127 with respect to the sheet stack is increased in an attempt to discharge the sheet stack surely. If the nipping pressure is decreased to the contrary, the sheet stack cannot be conveyed surely. Therefore, it is difficult to set the nipping pressure of the oscillation roller pair 127.

Thus, the sheet processing apparatus of this embodiment is adapted to discharge the sheet stack not only by the oscillation roller pair 127 but also by the trailing edge assist 134. Therefore, the oscillation roller pair 127 never slides and rotates with respect to the sheet or twists the sheet stack as described above, and the oscillation roller pair 127 can discharge the sheet stack smoothly and promptly without scratching the sheet and the sheet stack. In addition, the sheet stack can be discharged even if the nipping pressure of the oscillation roller pair 127 is not controlled strictly.

Figure 31:
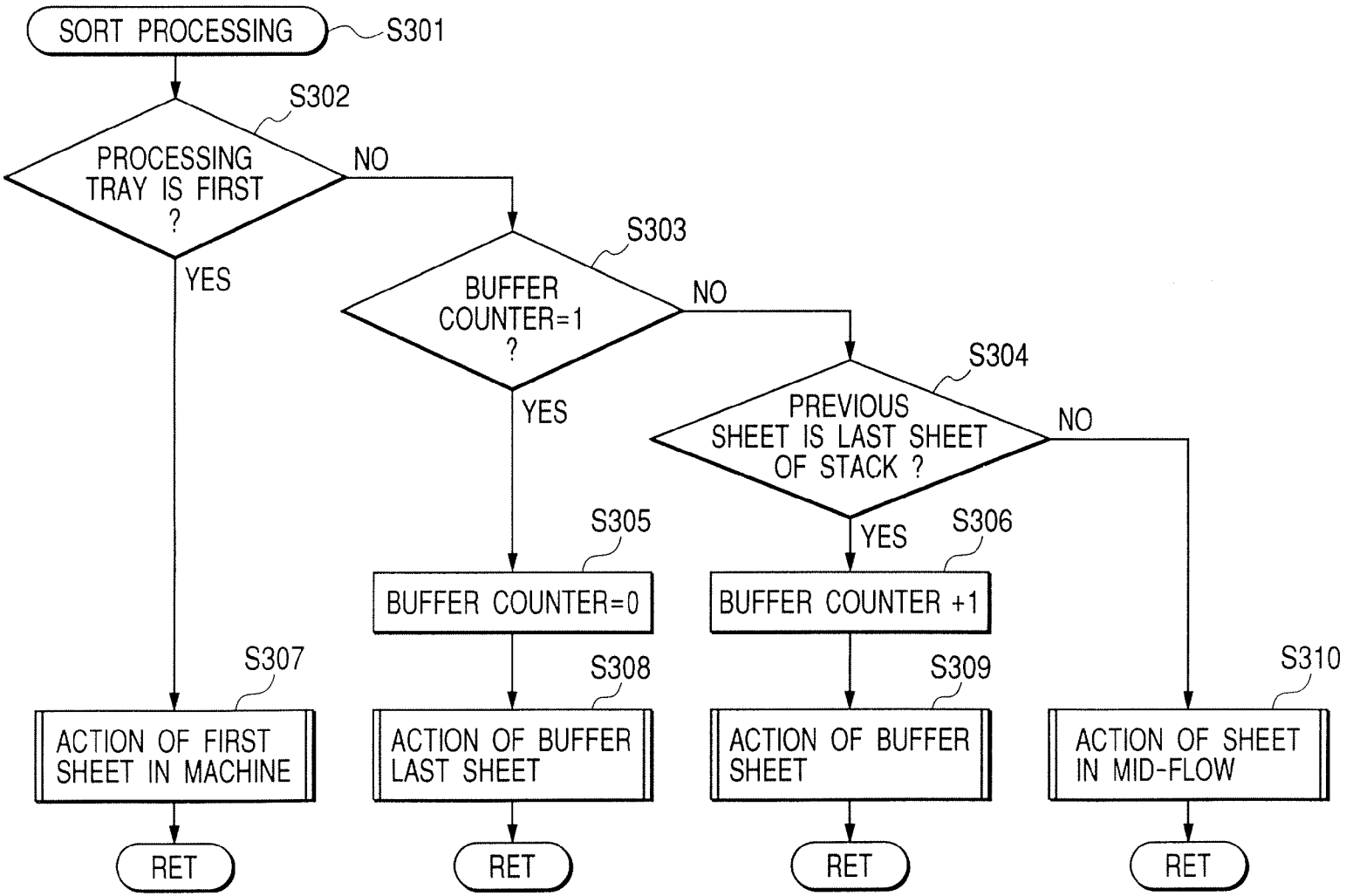
FIG. 31 is a flowchart of sort processing.

FIG. 31 is a flowchart for explaining schematic operations of the entire sheet processing apparatus 119 and is also a flowchart of sort processing. Note that the flowchart explains sort processing for performing two-sheet buffer. Operations of respective portions shown in the flowchart are performed by the control of the finisher control portion 211 shown in FIG. 8.

In sort processing (S301), upon judgment on whether or not a sheet to be stacked on the processing tray 129 is a first sheet (S302), whether or not a buffer counter is 1 (S303), and whether or not a previous sheet is the last sheet of a sheet stack (S304), the sheet processing apparatus 119 performs any one of an action for first sheet in machine (S307), an action for buffer last sheet (S308), an action for buffer sheet (S309), and an action for sheet in mid-flow (S310).

Figure 32A:
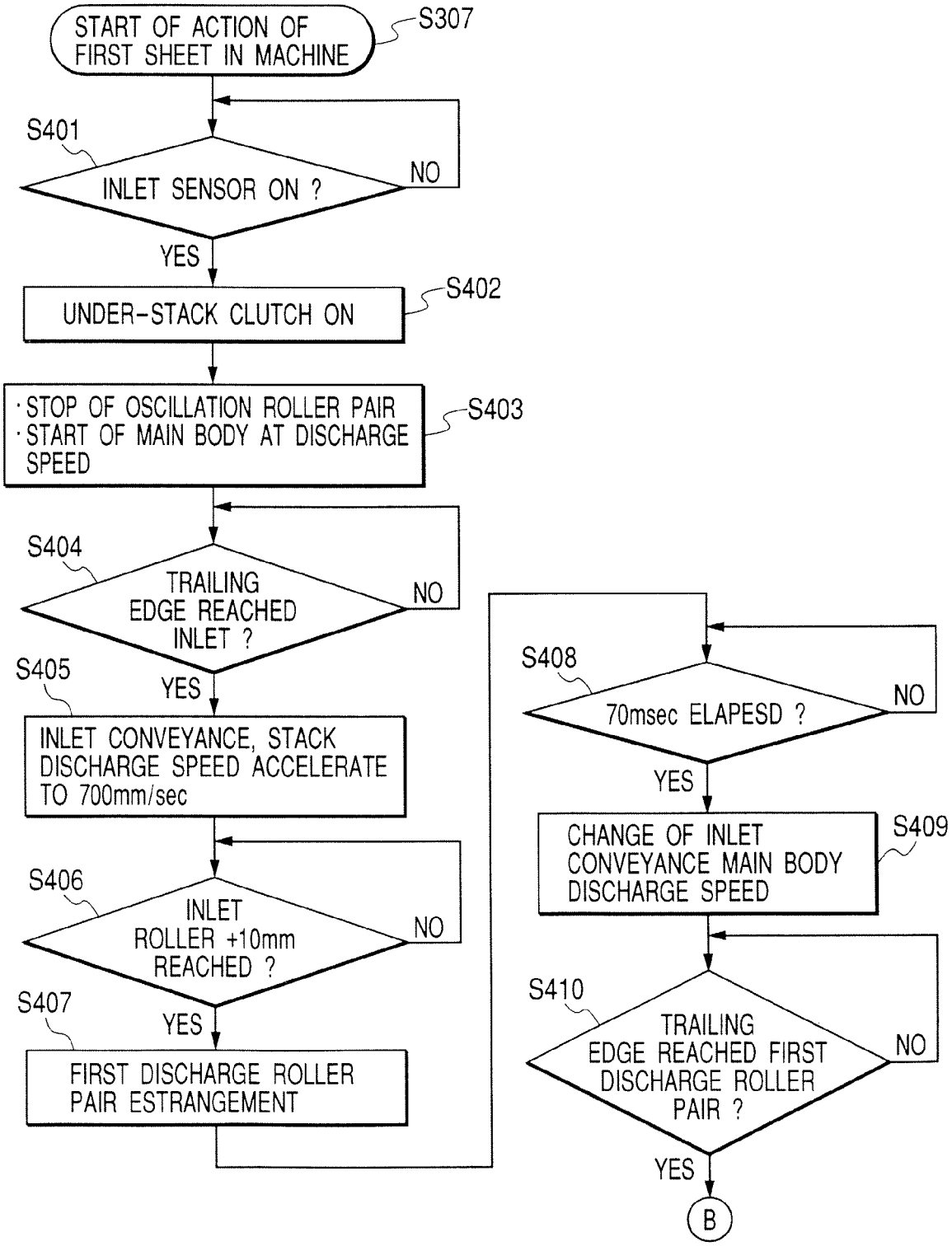
FIGS. 32A and 32B are flowcharts for explaining an action of a first sheet in machine.
Figure 32B:
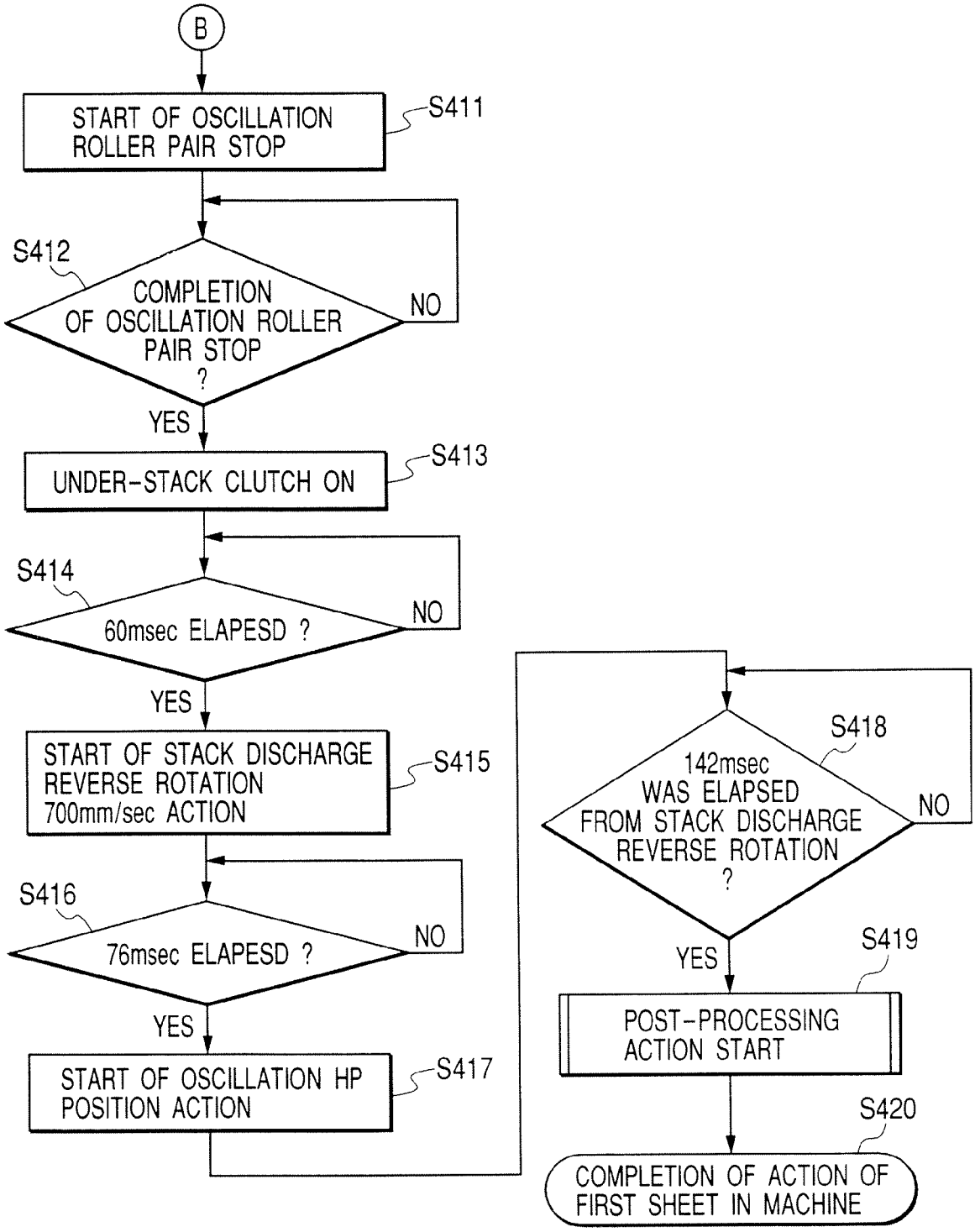
Figure 33A:
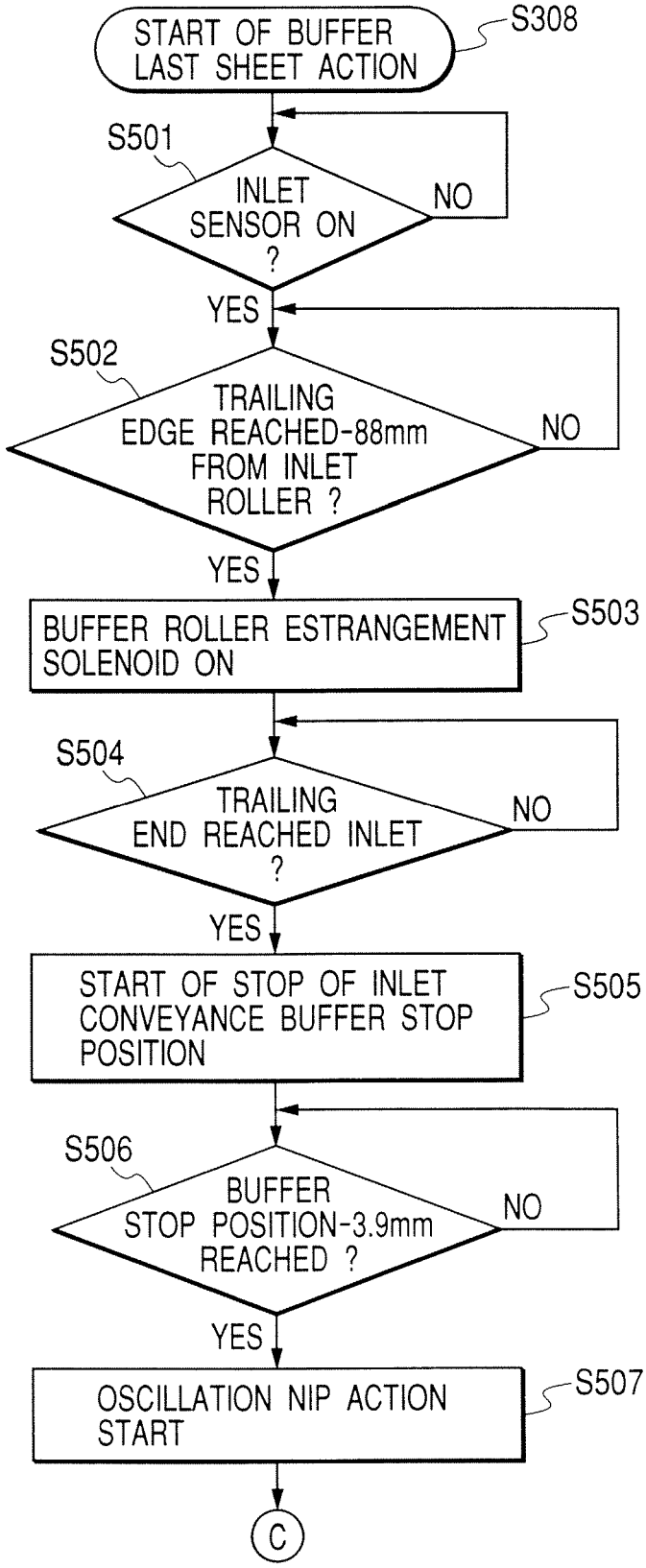
FIGS. 33A and 33B are flowcharts for explaining an action of a buffer last sheet.
Figure 33B:
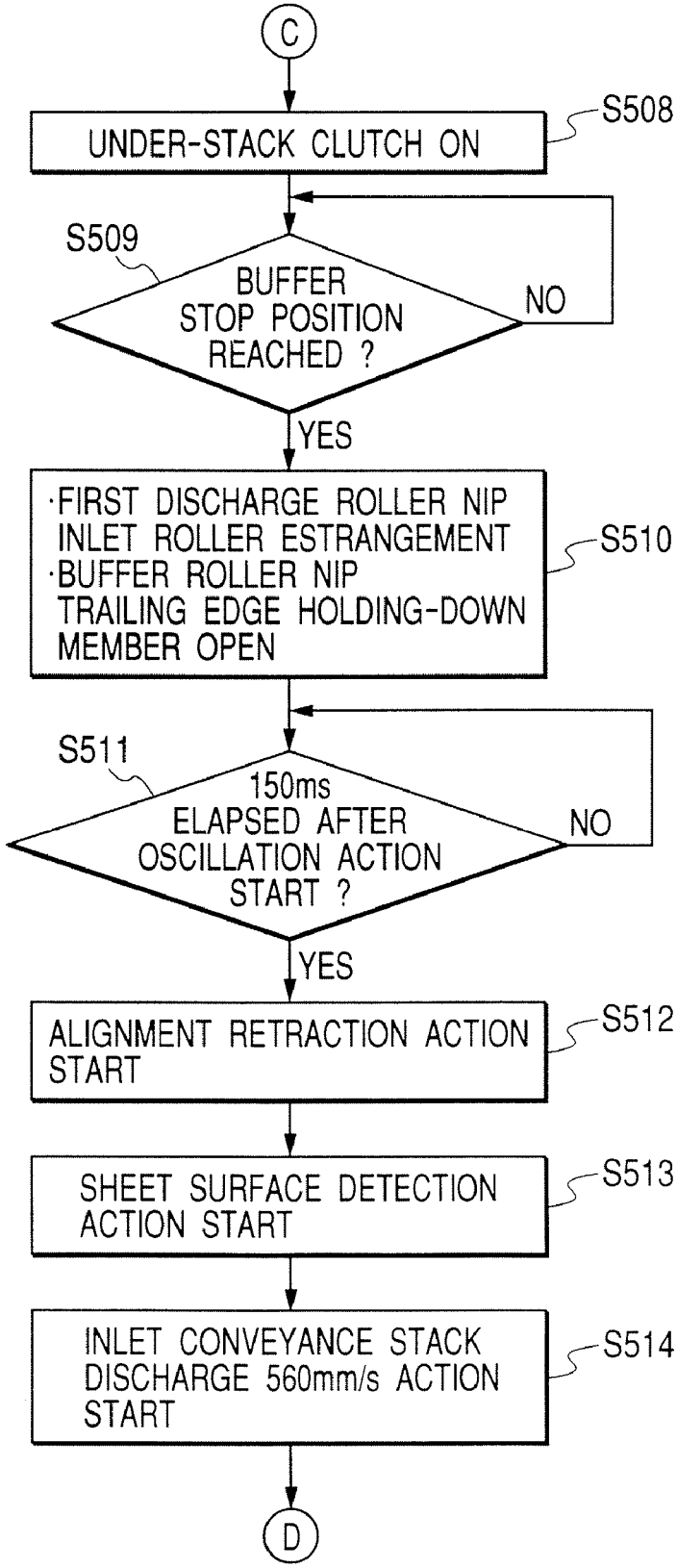

The action for first sheet in machine (S307) in FIG. 31 is an action from stacking of a first sheet on the processing tray 129 until start of sheet processing as indicated by reference signs S401 to S420 in FIGS. 32A and 32B.

The action for buffer last sheet (S308) in FIG. 31 is an action from stacking of a buffer sheet on the processing tray 129 until start of a post-processing operation as indicated by reference signs S501 to S535 in FIGS. 33A, 33B, 34A, 34B and 34C.

Figure 35A:
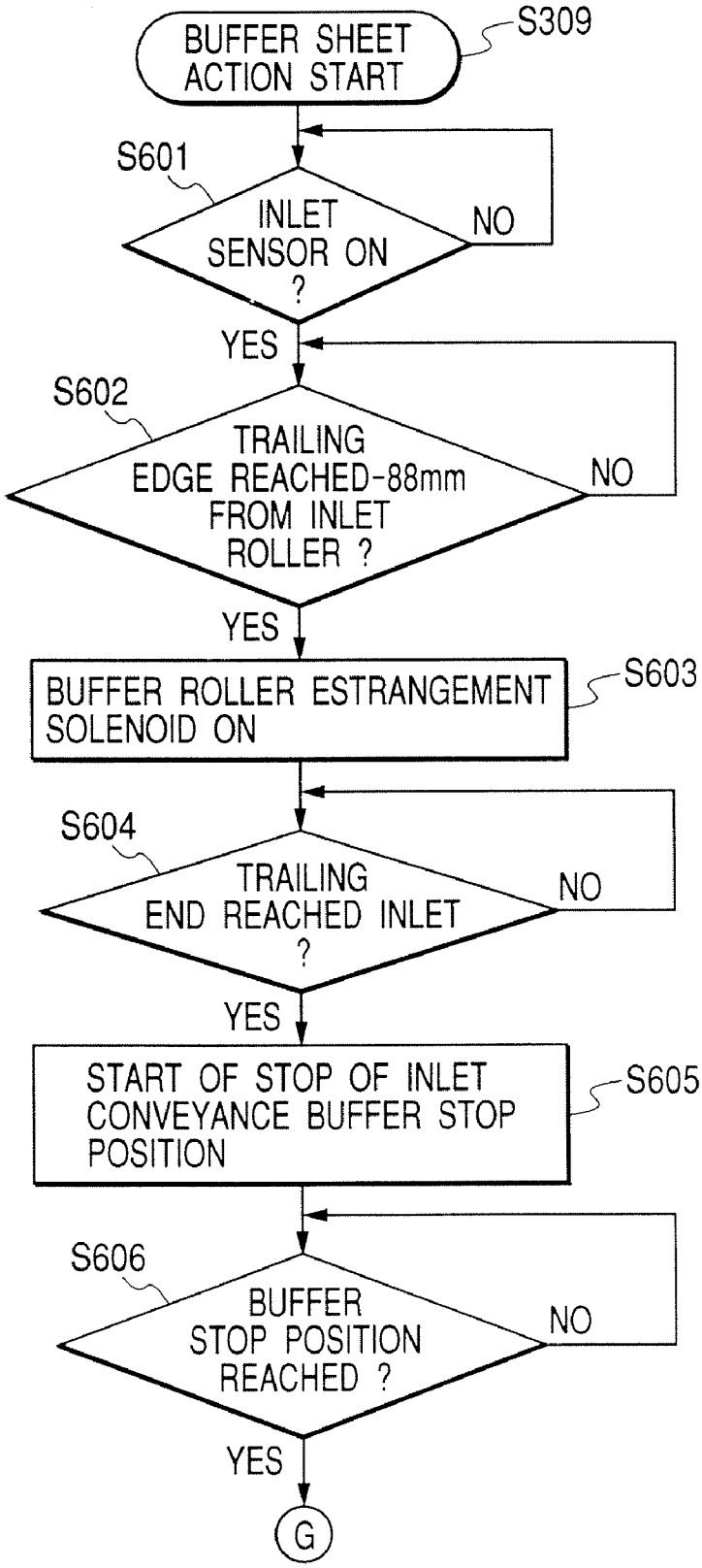
FIGS. 35A and 35B are flowcharts for explaining a buffer action.
Figure 35B:
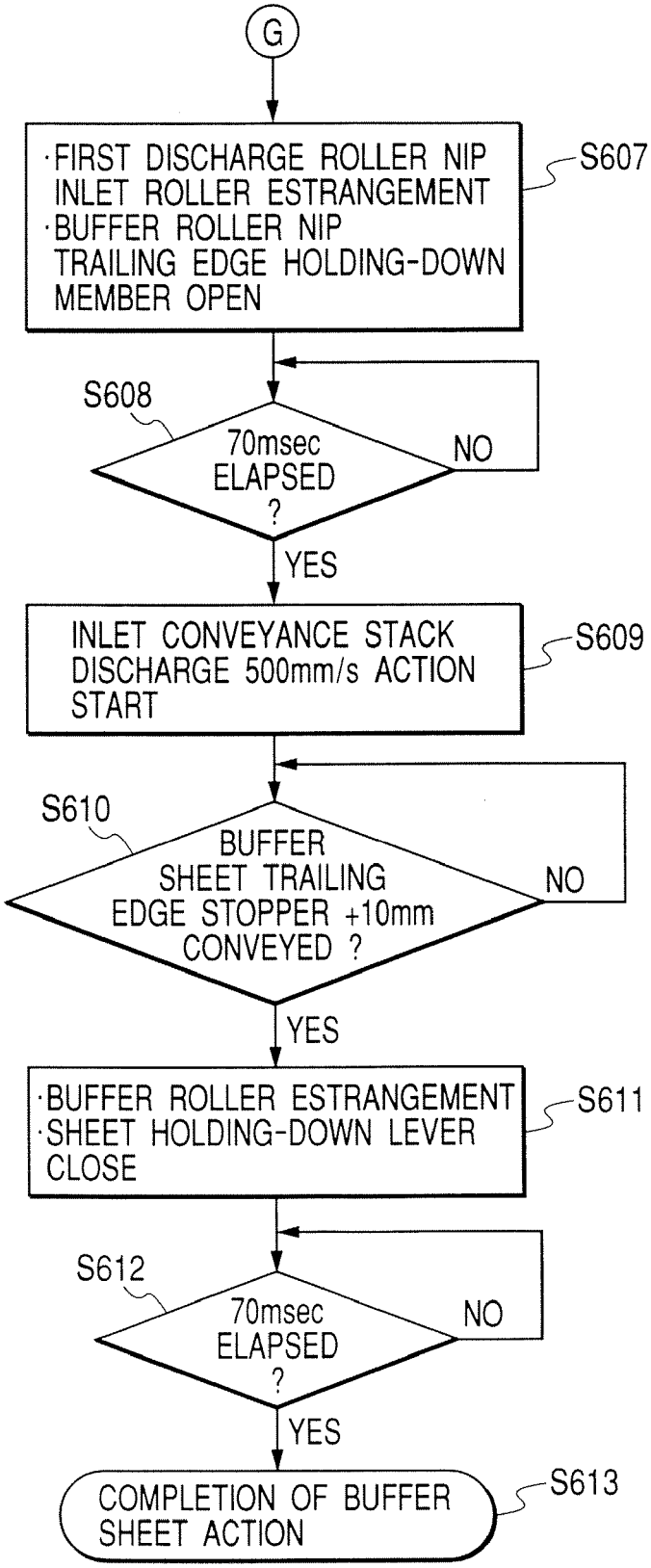

The action for buffer sheet (S309) in FIG. 31 is an action for storing (buffering) a buffer sheet in the guide 123 as indicated by reference signs S601 to S613 in FIGS. 35A and 35B (see FIGS. 20A and 20B to 25A and 25B).

Figure 34A:
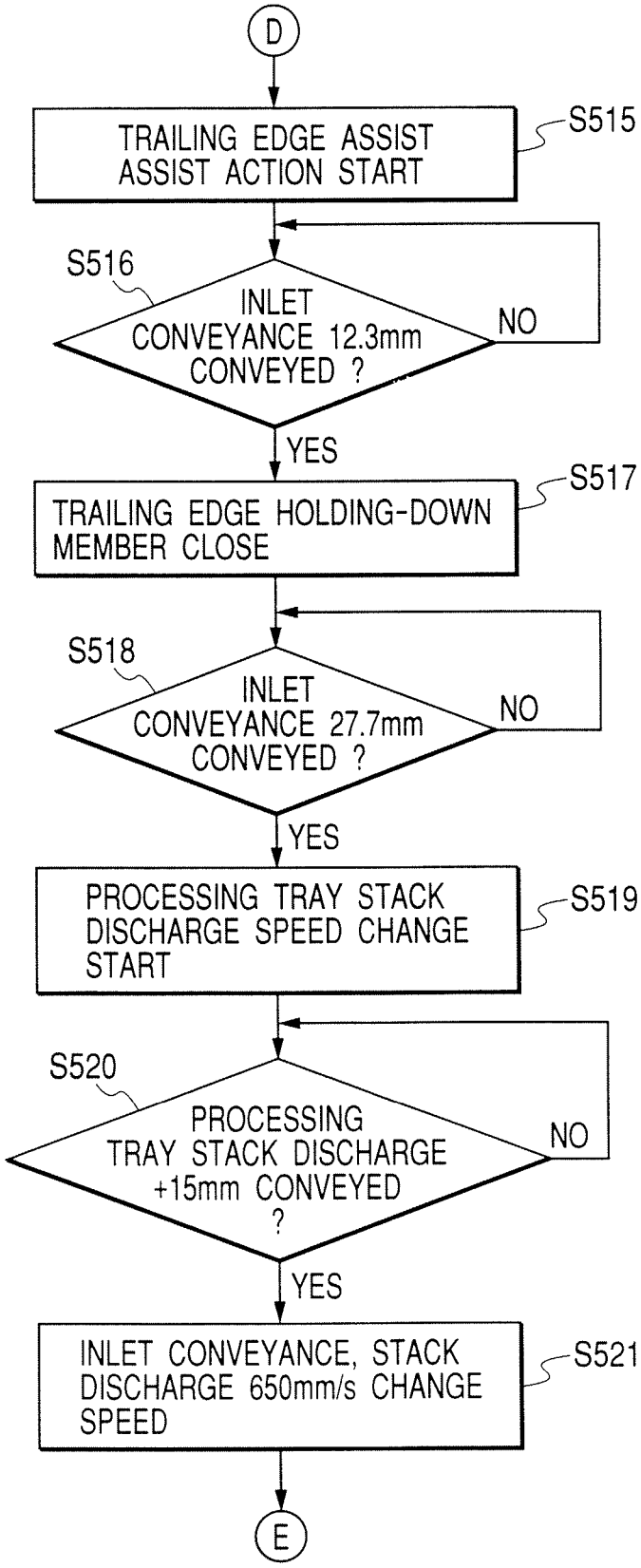
FIGS. 34A, 34B and 34C are flowcharts following that of FIGS. 33A and 33B.
Figure 34B:
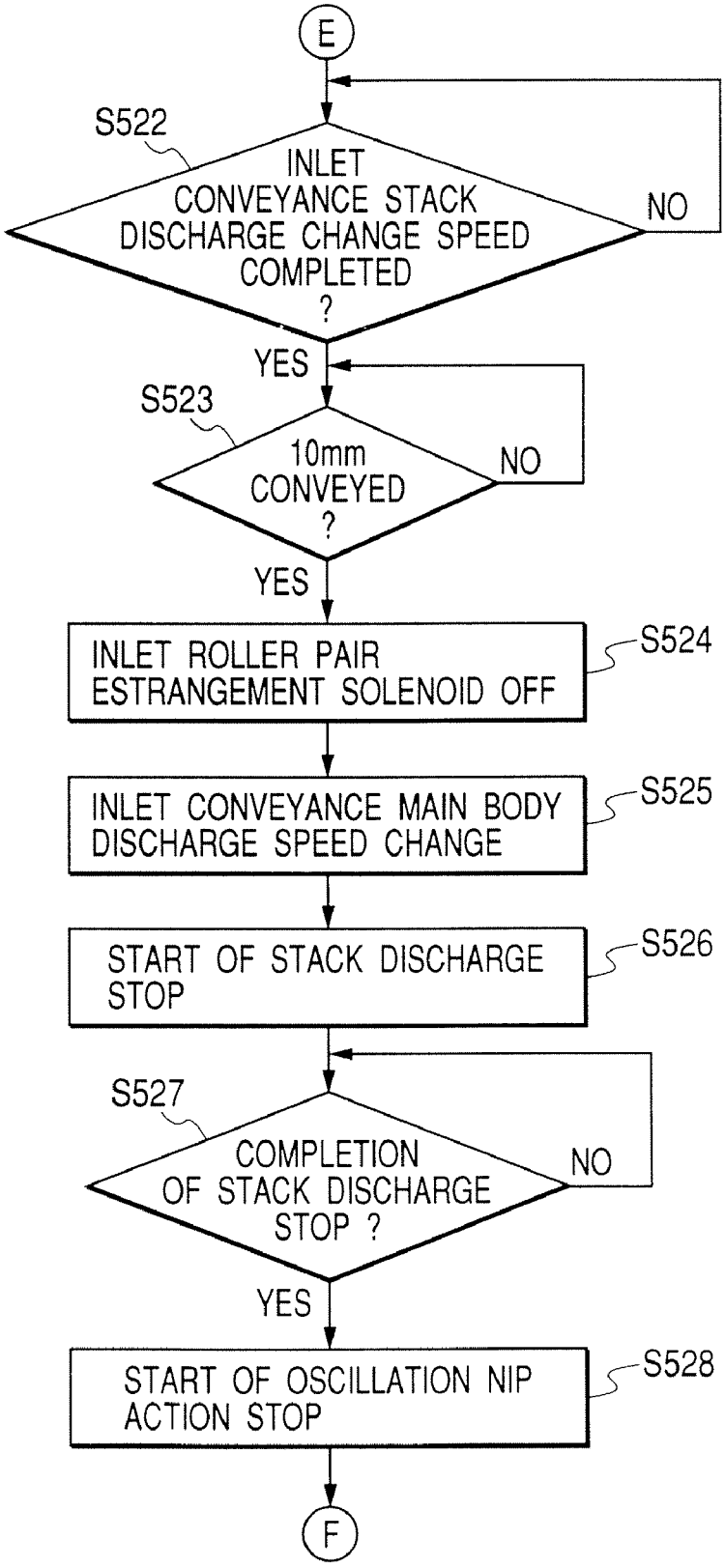
Figure 34C:
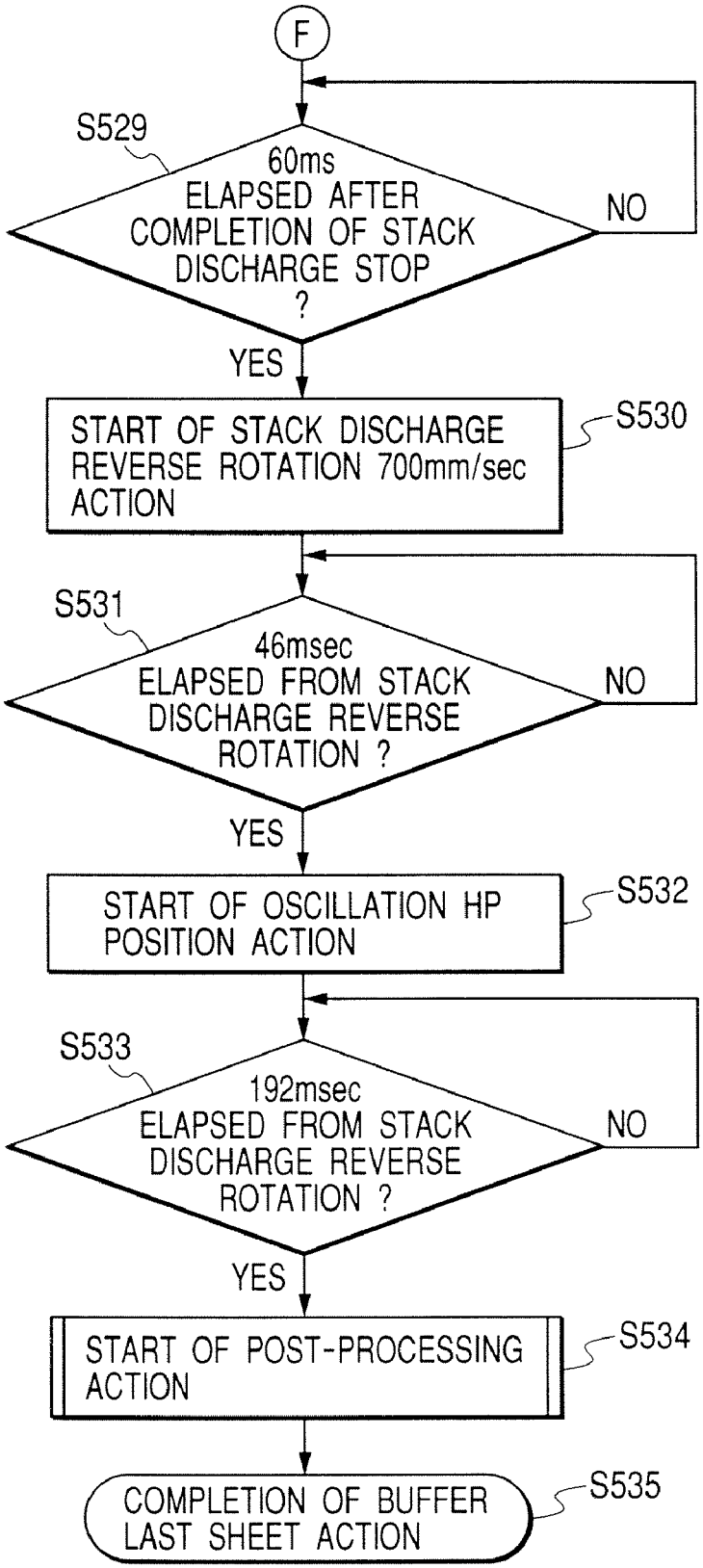
Figure 36A:
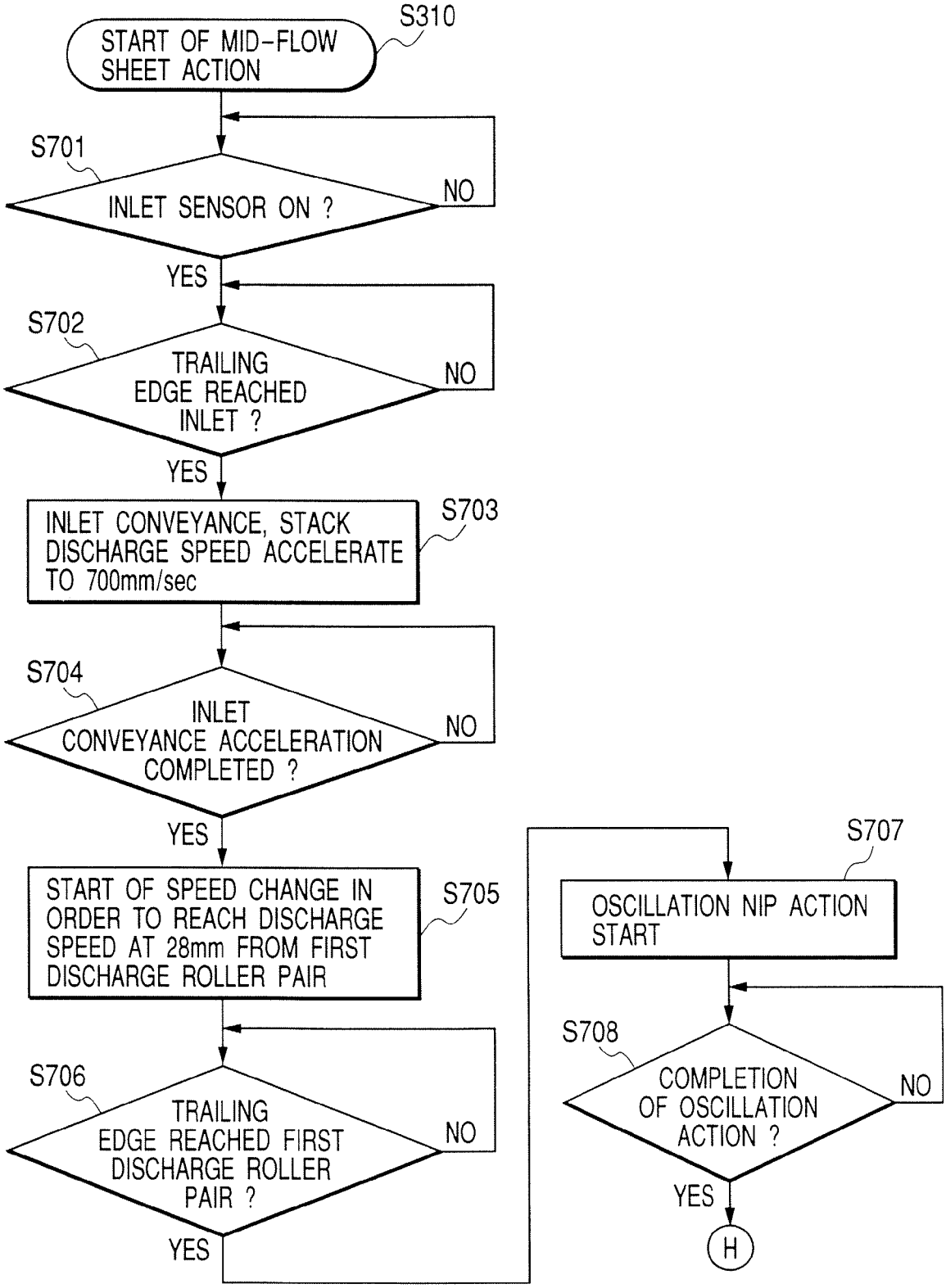
FIGS. 36A and 36B are flowcharts for explaining a mid-flow action.

The action for sheet in mid-flow (S310) in FIG. 31 is an action from stacking of second and subsequent sheets on the processing tray 129 until start of the sheet processing as indicated by reference signs S701 to S716 in FIGS. 36A and 34B.

Figure 36B:
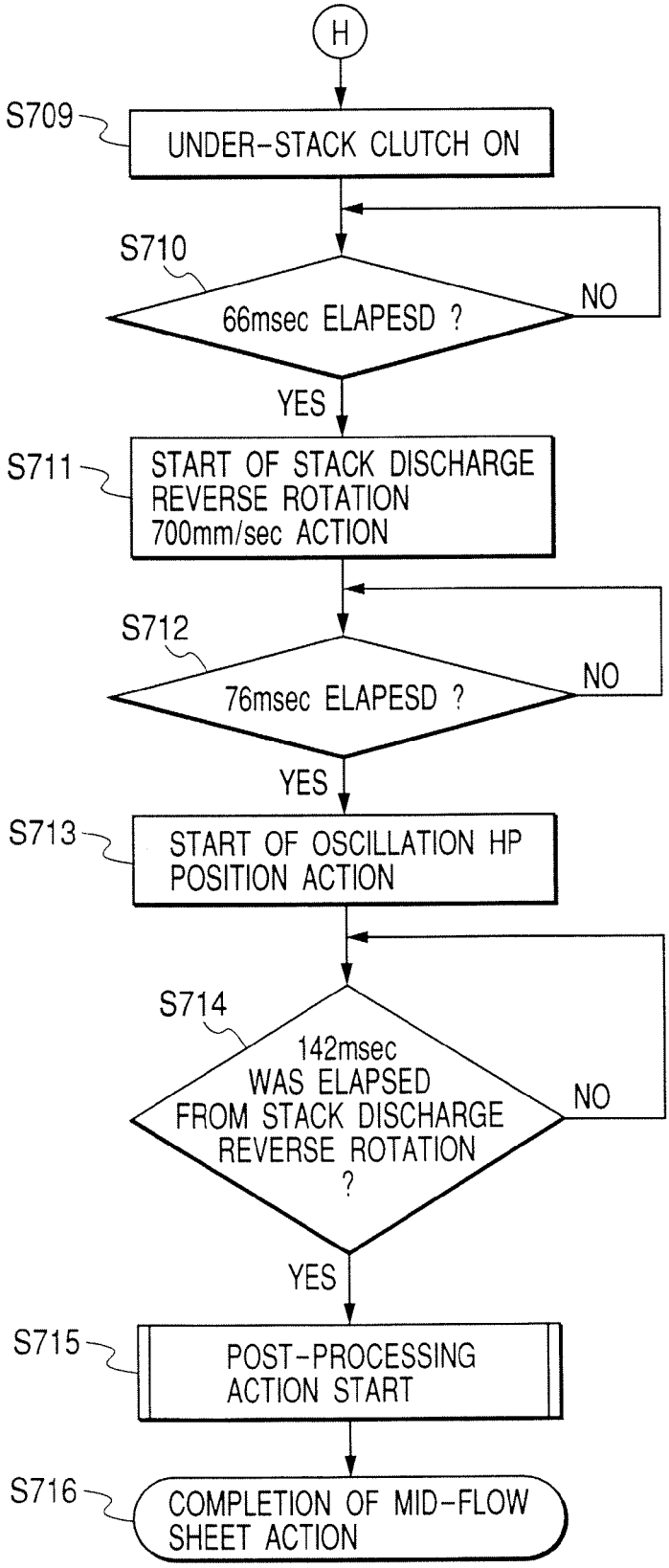
Figure 37:
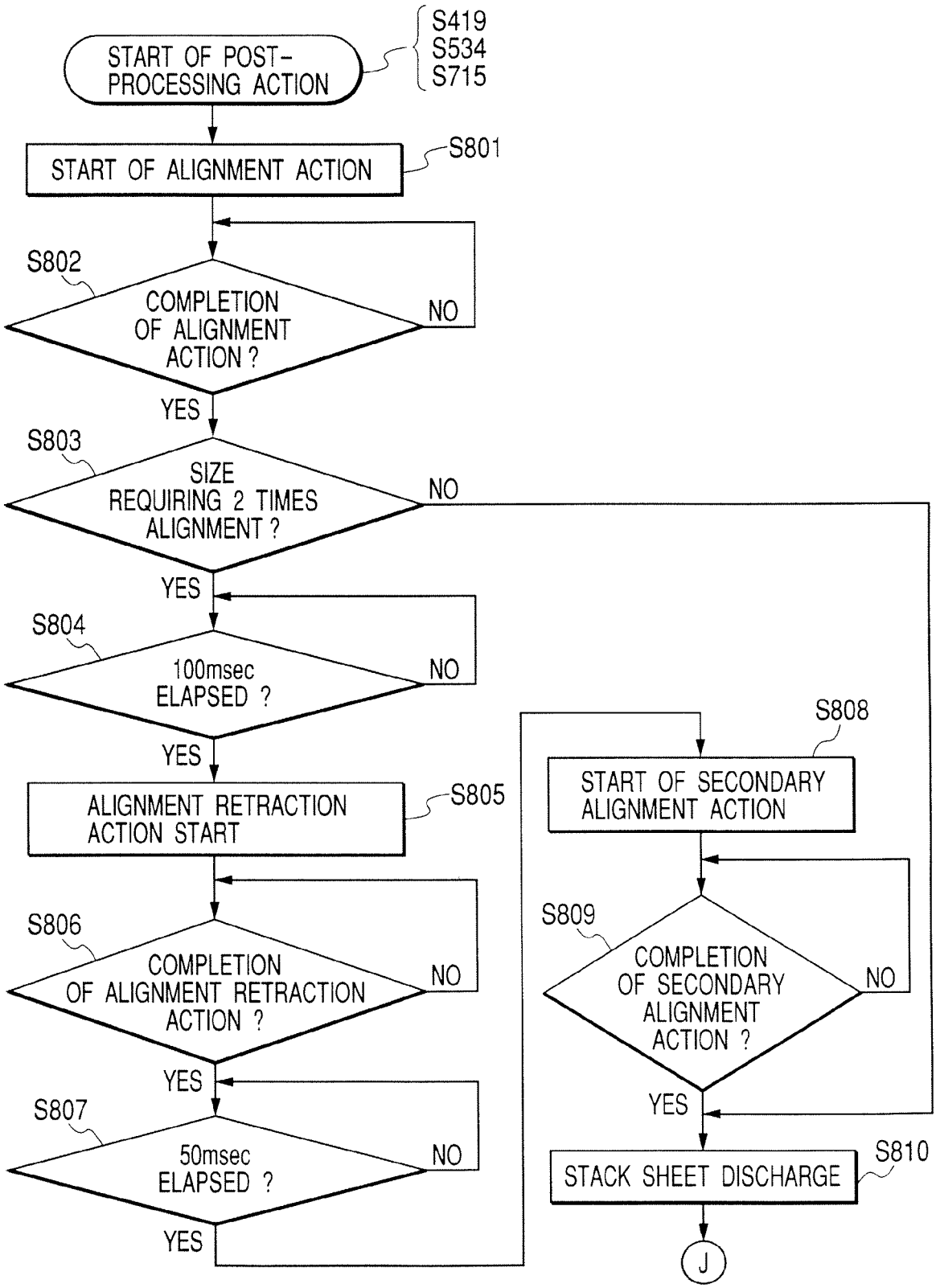
FIG. 37 is a flowchart for explaining a post-processing action.
Figure 38:
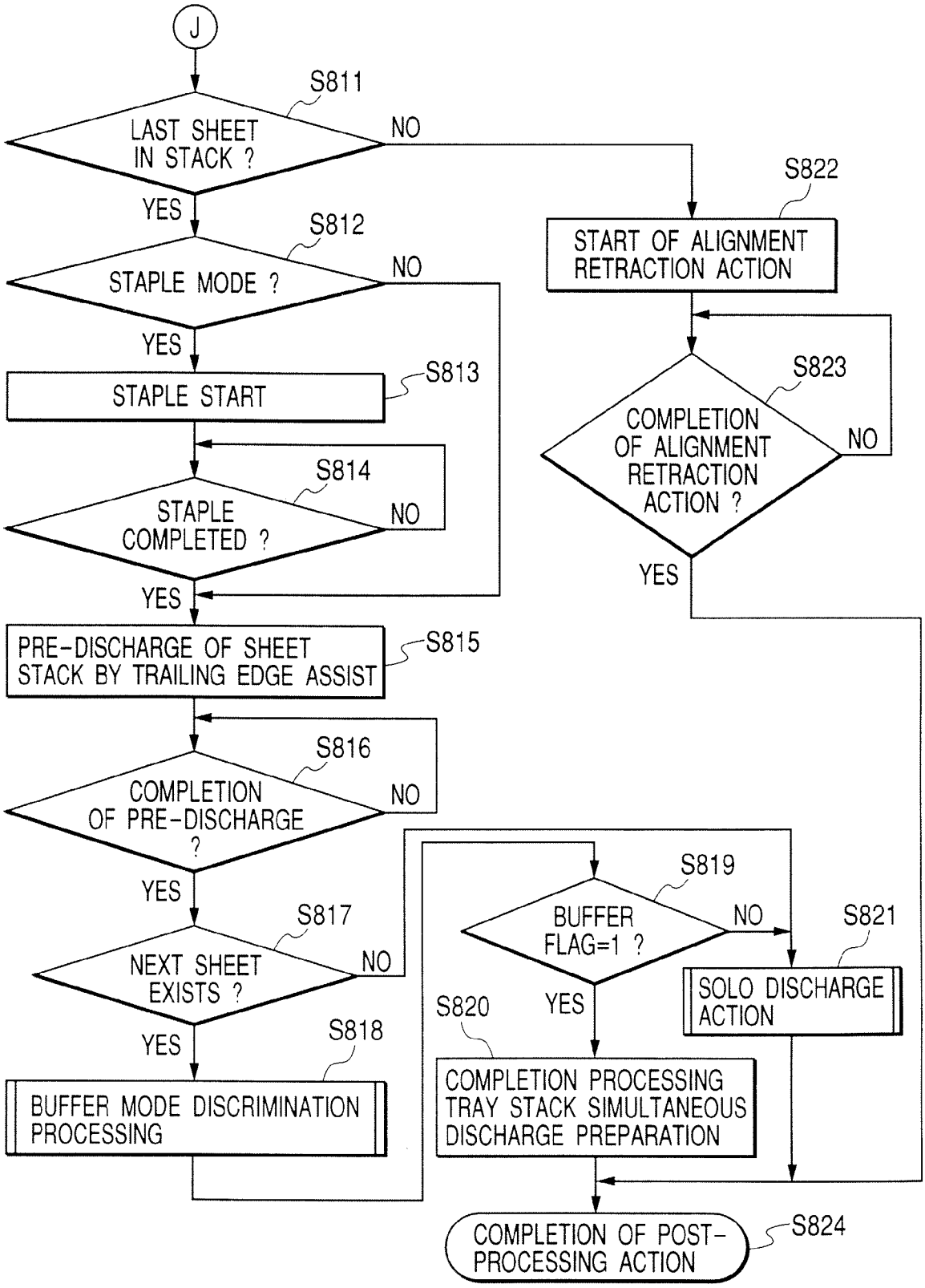
FIG. 38 is a flowchart following that of FIG. 37.

Symbol S419 in FIGS. 32A and 32B, symbol S534 in FIGS. 34A and 34B, and symbol S715 in FIGS. 36A and 36B defined as start of post-processing action is an action for performing post-processing after stacking a sheet, which is discharged from the apparatus main body 101 of the copying machine 100, on the processing tray 129 as indicated by reference signs S801 to S824 in FIGS. 37 and 38.

First, the CPU 221 (see FIG. 8) controls a front alignment motor M5 and an inside alignment motor M6 to bring a front alignment plate 144*a* and an inside alignment plate 144*b* (see FIG. 5), which are disposed along both sides in a sheet conveying direction and approach and separate from a direction crossing the sheet conveying direction, close to a sheet and align both sides of the sheet (S801, S802). In the case of a large sheet such as an B4 sheet requiring two times alignment (S803), after 100 msec has elapsed (S804), the front alignment plate 144*a* and the inside alignment plate 144*b* are estranged from the sheet once and retracted (S805, S806). Then, after 50 msec (S807), the front alignment plate 144*a* and the inside alignment plate 144*b* (see FIG. 5) are brought close to the sheet again to perform a secondary alignment action (S808). After a series of alignment actions are completed (S809), the CPU 221 controls the stack delivery motor M3 to stop a reverse rotation action of the oscillation roller pair 127 (S810).

Thereafter, the CPU 221 judges whether or not the sheet is the last sheet in the stack according to last sheet information of the sheet stack from the CPU circuit portion 200 of the apparatus main body 101 or on the basis of the number of sheets from a counter which counts the number of sheets (FIG. 38, S811). If the sheet is not the last sheet in the stack, the CPU 221 controls the front alignment motor M5 and the inside alignment motor M6 (see FIG. 8) to return the front alignment plate 144*a* and the inside alignment plate 144*b* (see FIG. 5) to the retracted position (S822, S823).

In S811, if the sheet is the last sheet in the stack and the sheet stack is stitched by a stapler unit 132 (S812), the CPU 221 moves a stapler shift motor M8 to move a stapler 166 to a stitching position and controls a stapler motor M9 to stitch the sheet stack with the stapler 166 (S813, S814). Thereafter, the CPU 221 controls the trailing edge assist motor M4 (see FIGS. 5 to 8) to project only the sheet stack by the length L from the sheet stored in advance with the trailing edge assist 134 as shown in FIGS. 26A and 26B (pre-discharge) (S815, S816).

Then, if there is no subsequent sheet (S817), the CPU 221 controls the stack delivery motor M3 to discharge only the stitched sheets to the stack tray 128 from the processing tray 129 and completes the post-processing operation (S821, S824).

In S817, if there is the next sheet (S817), the CPU 221 performs buffer mode discrimination processing (S818) to judge whether or not a buffer flag is 1.

Figure 39:
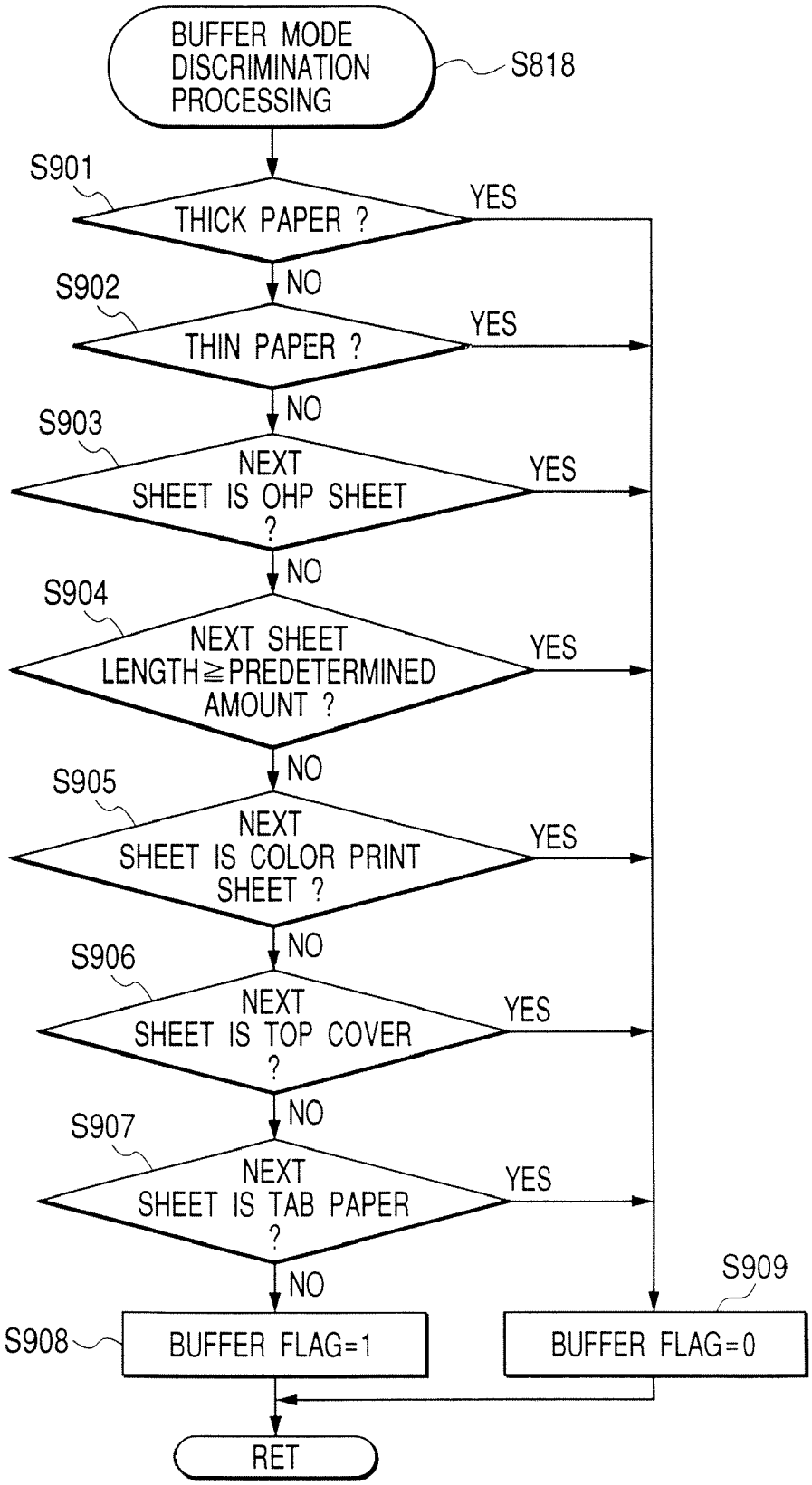
FIG. 39 shows a subroutine of buffer mode discrimination processing in the flowchart of FIG. 38.

The buffer mode discrimination processing in S818 of FIG. 38 is processing for changing the buffer flag from 1 to 0 such that a buffer mode can be discriminated. As shown in FIG. 39, in the case in which the next sheet is a specific sheet such as a thick sheet, a thin sheet, a sheet for an overhead projector (OHP), a sheet with a length equal to or larger than a predetermined length, a color print sheet, a top cover, or tab paper, the buffer flag is 0. In the case in which the next sheet is an ordinary sheet other than the above specific sheet, the buffer flag is 1.

Therefore, if the buffer flag is not 1, the CPU 221 judges that attribute information of a sheet such as a thick sheet, a thin sheet, a sheet for an overhead projector (OHP), a sheet with a length equal to or larger than a predetermined length, a color print sheet, a sheet for a top cover, or a tab sheet, which is inputted in the operation portion 210 (see FIG. 2) by a user, belongs to a specific sheet and cannot allow the stitched sheet stack and the stored sheet (buffer sheet) to be discharged simultaneously (S819). Then, the CPU 221 controls the stack delivery motor M3 to discharge only the stitched sheet stack to the stack tray 128 from the processing tray 129 (second action) and completes the post-processing action (S821, S824).

In addition, when the buffer flag is 1 in S819, the CPU 221 controls the inlet conveyance motor M2, the stack delivery motor M3, and the under-stack clutch CL to discharge the sheet stack on the processing tray 129 to the stack tray 128 and, at the same time, discharges the stored sheets to the processing tray 129 from the guide 123. In other words, a simultaneous discharge action is performed (first action) (S820, S824).

Therefore, since the sheet processing apparatus 119 of this embodiment is adapted, when a sheet is a specific sheet, perform solo discharge action (second action) for discharging the sheet individually, a thick sheet never stuffs the buffer unit 140 or thin sheets, sheets for color image formation, or sheets for an overhead projector never stick with each other to cause sheet jam. Thus, sheet processing efficiency can be improved. In addition, since a preceding sheet stacked on the sheet stacking means and a subsequent sheet held in the sheet holding portion are not discharged simultaneously, an alignment property at the time when a sheet is moved from the sheet holding portion to the sheet stacking means can be improved. Further, occurrence of sheet jam during conveyance of a sheet can be prevented.

Figure 40:
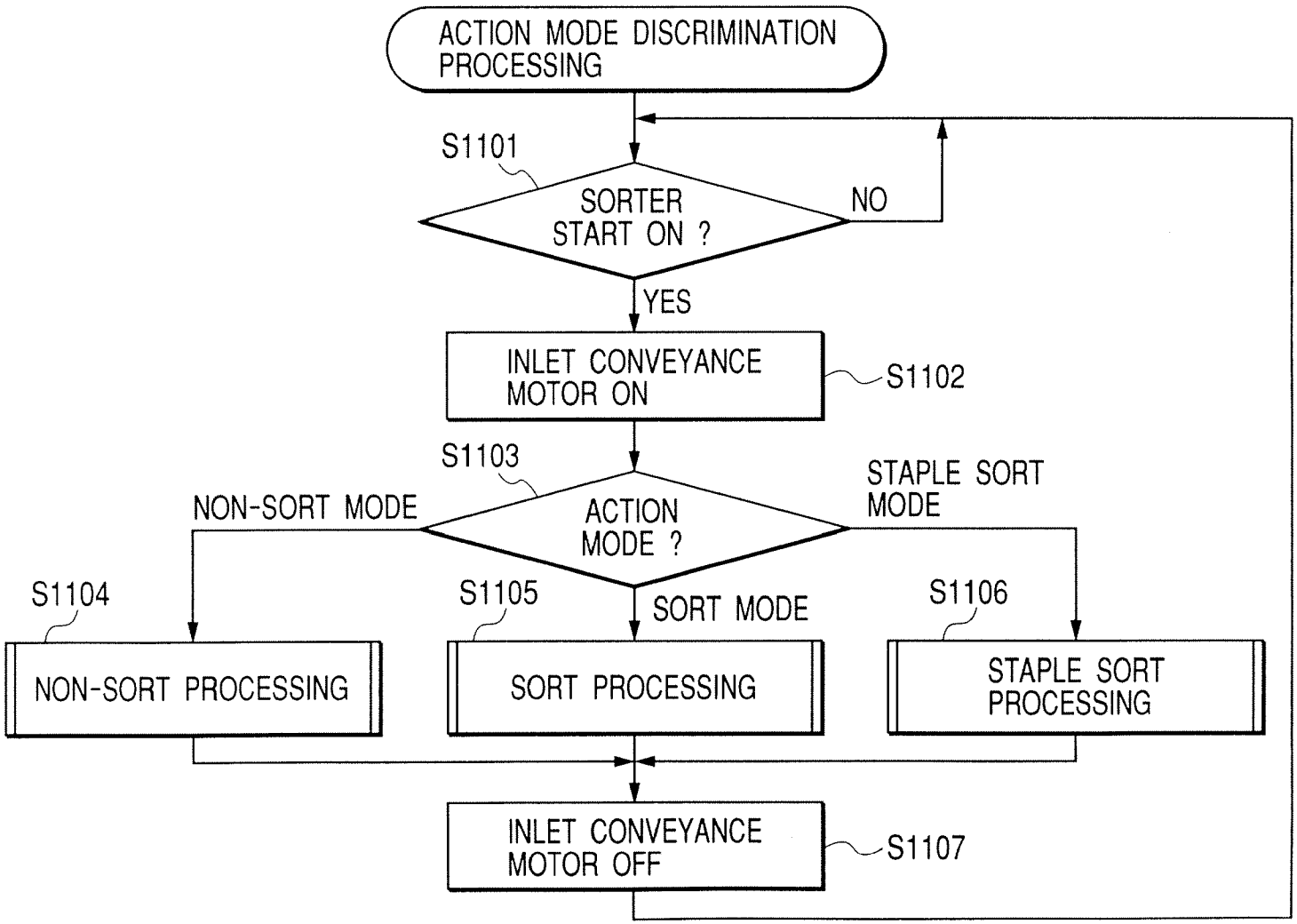
FIG. 40 is a flowchart of action mode discrimination processing.

The sheet processing apparatus 119 of this embodiment is adapted to be able to perform non-sort processing and sort processing other than the staple sort processing. FIG. 40 is a flowchart showing a motion mode discrimination processing procedure. An action discrimination processing program for this procedure is stored in the ROM 222 in the finisher control portion 221 (see FIG. 8) and is adapted to be executed by the CPU 221.

First, the CPU 221 waits for finisher (sorter) start to be turned ON (S1101). When a start key for copy start provided in the operation portion 210 (see FIG. 2) of the apparatus main body 101 of the copying machine 100 is pressed, and a signal for starting an action of the finisher is inputted to the CPU 221 in the finisher control portion 211 (see FIG. 8)

from the apparatus main body 101 of the copying machine 100 via a communication IC (IPC), the finisher start comes into an ON state (S1101).

Then, the CPU 221 starts driving of the inlet conveyance motor M2 (see FIG. 4) (S1102). Here (S1101), if the signal for starting the finisher is not inputted to the CPU 221, the finisher is in a standby state.

Subsequently, the CPU 221 discriminates an action mode (S1103) and, if the action mode is a non-sort mode, executes the non-sort processing (S1104). In addition, if the action mode is a sort mode, the CPU 221 executes the sort processing (S1105).

Moreover, if the action mode is a staple sort mode, the CPU 221 executes the staple sort processing (S1106). When any one of the processing of S1104 to the processing of S1106 ends, the CPU 221 stops the driving of the inlet conveyance motor M2 (S1107) and returns to the processing of step S1101, and the finisher returns to the standby state.

Figure 41:
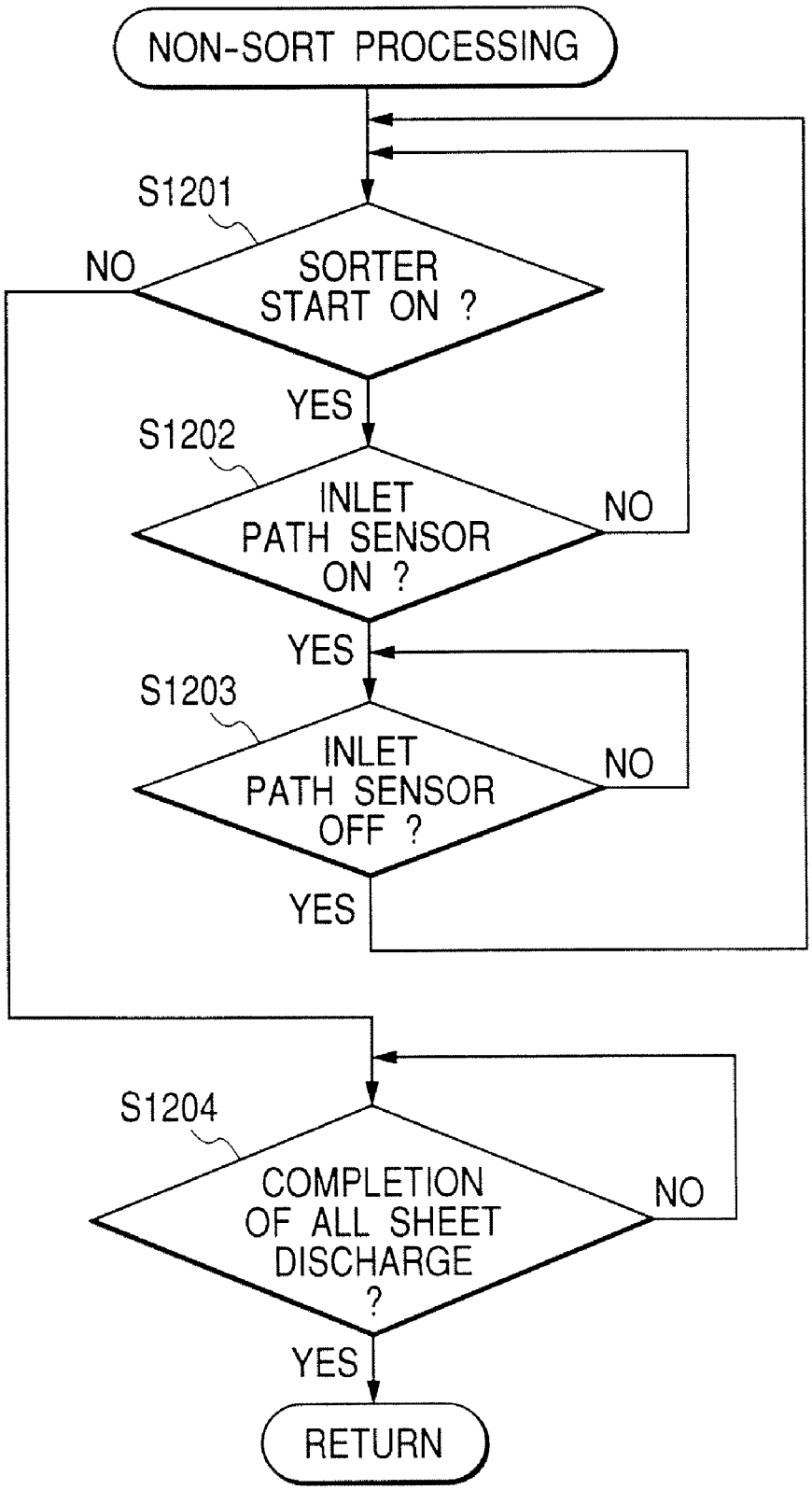
FIG. 41 is a flowchart of non-sort processing.

FIG. 41 is a flowchart showing a procedure of the non-sort processing (S1104) in FIG. 40. In the non-sort processing, the CPU 221 discriminates whether or not the finisher start (sorter start) is in the ON state (S1201). If the finisher start is in the ON state, the sheet discharged from the apparatus main body 101 of the copying machine is delivered to the guide 123 (see FIG. 4) in the finisher. The CPU 221 waits for the delivered sheet to be conveyed by the inlet conveyance motor M2 and the leading edge thereof to be detected by the inlet path sensor S1 disposed in the guide 123 to turn ON the inlet path sensor S1 (S1202). When the inlet path sensor S1 is turned ON, the CPU 221 waits for the trailing edge of the conveyed sheet to pass through the inlet path sensor S1 and to be turned OFF (S1203).

When the inlet path sensor S1 is turned OFF, the CPU 221 returns to the processing of S1201, and in the case in which the finisher start comes into the OFF state again, continues the processing in the same manner. On the other hand, in the case in which the finisher start comes into the OFF state, the CPU 221 waits for all the sheets to be discharged to the stack tray 128 (S1204), and if all the sheets are discharged to the stack tray 128, the CPU 221 ends the non-sort processing.

Figure 42:
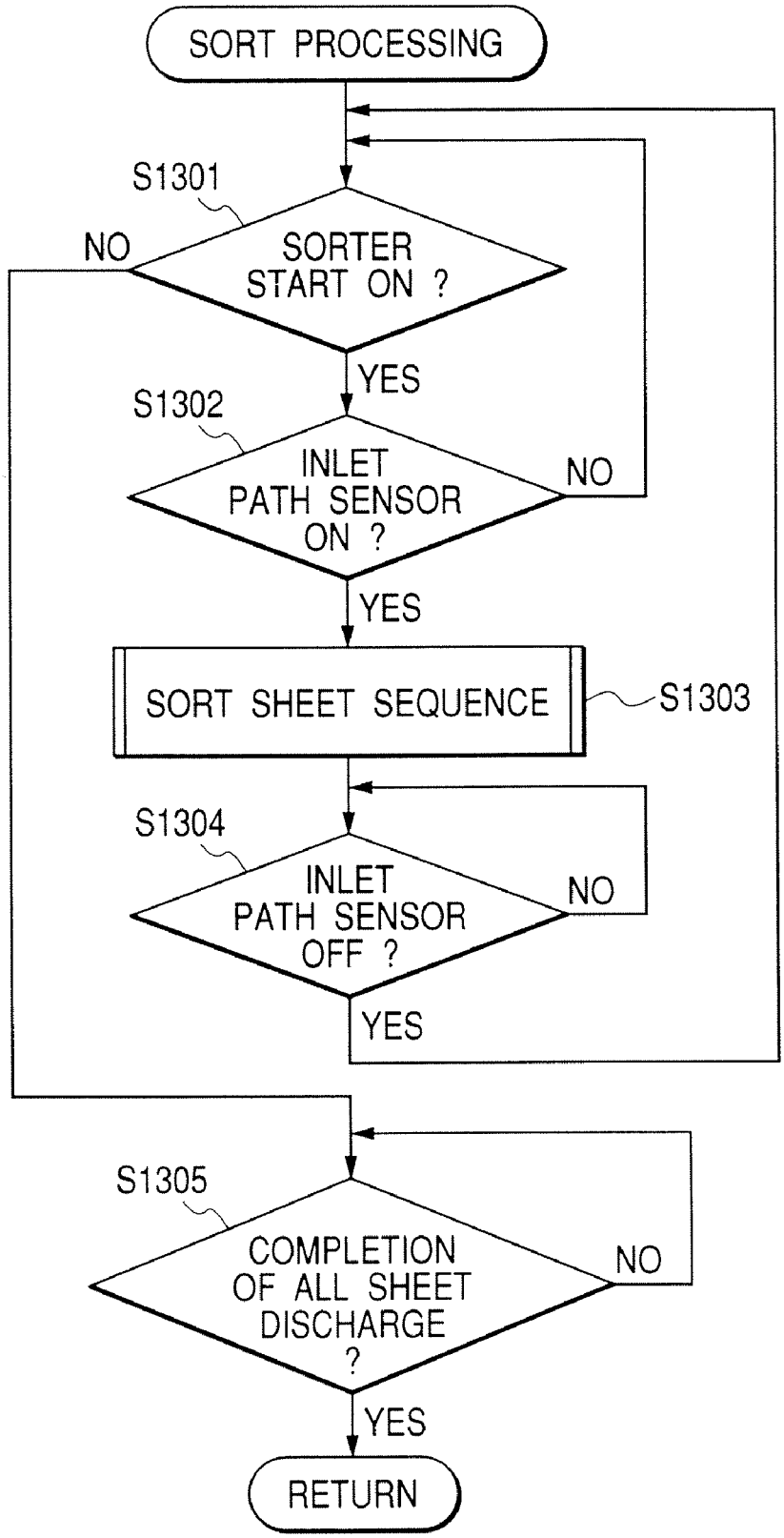
FIG. 42 is a flowchart of sort processing.

FIG. 42 is a flowchart showing a procedure of the sort processing (S1105). In the sort processing, the CPU 221 discriminates whether or not the finisher start is in the ON state (S1301). If the finisher start is in the ON state, the sheet discharged from the apparatus main body 101 of the copying machine is delivered to the guide 123 (see FIG. 4) in the finisher. The delivered sheet is conveyed by the inlet conveyance motor M2, and the CPU 221 waits for the leading edge thereof to be detected by the inlet path sensor S1 arranged in the guide 123 (S1302). When the inlet path sensor S1 is turned ON, the CPU 221 starts a sort sheet sequence (S1303). Then, the CPU 221 waits for the trailing edge of the conveyed sheet to pass through the inlet path sensor S1 and the inlet path sensor S1 to be turned OFF (S1304).

When the inlet path sensor S1 is turned OFF, the CPU 221 returns to the processing of S1301, and if the finisher start comes into the OFF state again, the CPU 221 repeats the same processing. On the other hand, when the finisher start comes into the OFF state, the CPU 221 waits for all the sheets to be discharged to the stack tray 128 (S1305), and if all the sheets have been discharged, the CPU 221 ends the sort processing.

Figure 43:
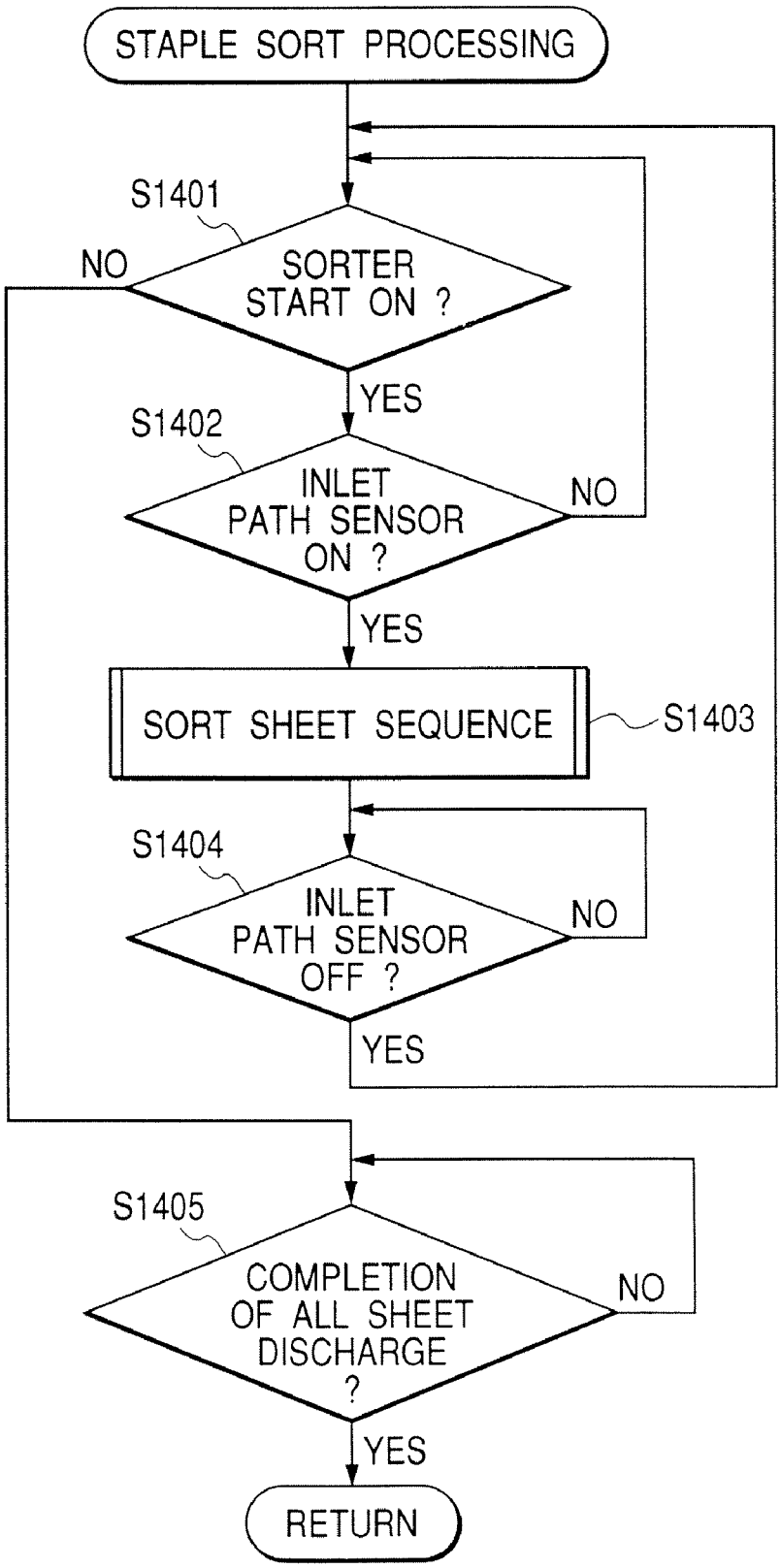
FIG. 43 is a flowchart of staple sort processing.

FIG. 43 is a flowchart showing a procedure of the staple sort processing (S1106) in FIG. 40. In the staple sort processing, the CPU 221 discriminates whether or not the finisher start is in the ON state (S1401). If the finisher start is in the ON state, the sheet discharged from the apparatus main body 101 of the copying machine is delivered to the guide 123 (see FIG. 4) in the finisher. The delivered sheet is conveyed by the inlet conveyance motor M2, and the CPU 221 waits for the leading edge thereof to be detected by the inlet path sensor S1 disposed in the guide 123 (S1402). When the inlet path sensor S1 is turned ON, the CPU 221 starts the sort sheet sequence (S1403) Then, the CPU 221 waits for the trailing edge of the conveyed sheet to pass through the inlet path sensor S1 to be turned OFF (S1404).

When the inlet path sensor S1 is turned off, the CPU 221 returns to the processing of S1401 and, when the finisher start comes into the OFF state again, repeats the same processing. On the other hand, when the finisher start comes into the OFF state, the CPU 221 waits for all the sheet to be discharged to the stack tray 128 (S1405), and if all the sheets have been discharged, the CPU 221 ends the non-sort processing.

Figure 44:
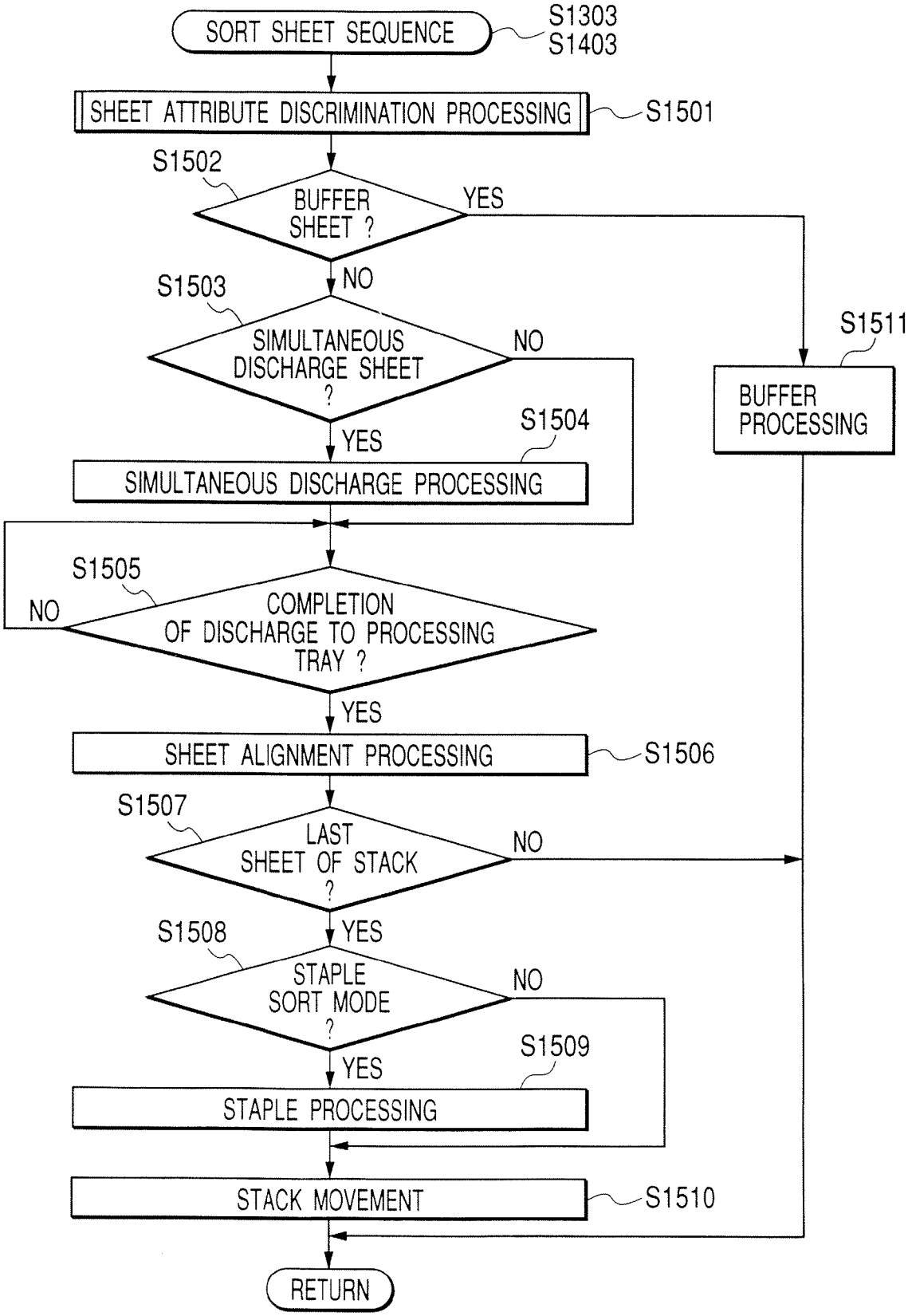
FIG. 44 is a flowchart of a sort sheet sequence.

FIG. 44 is a flowchart showing a procedure of the sort sheet sequence (S1303, S1403) in FIGS. 42 and 43. Processing of this sort sheet sequence is applied to each sheet to be conveyed. In addition, a program for this processing is carried out by the CPU 221 (see FIG. 8) in multitask.

In the sort sheet sequence processing, first, the CPU 221 performs sheet attribute discrimination processing (S1501). A detailed description of this sheet attribute discrimination processing will be made later on the basis of FIG. 45. Briefly, the sheet attribute discrimination processing is processing for discriminating whether an attribute of a sheet to be conveyed is "a sheet to be subjected to buffering", "a sheet to be discharged simultaneously with a stack already subjected to the post-processing on the processing tray", or "a sheet to be subjected to the post-processing after a stack is stacked on the processing tray".

As a result of the sheet attribute discrimination processing, the CPU 221 discriminates whether or not the sheet is a buffer sheet (S1502). If the sheet is designated as the buffer sheet, the CPU 221 buffers the sheet on the guide 123 (see FIG. 4) (S1511) and ends the processing.

The buffering is a series of actions for once stopping the sheet to be conveyed with the guide 123, lifting the trailing edge holding-down member 135, moving back the sheet upstream in the conveying direction by the buffer roller 124 to abut the trailing edge of the sheet against the trailing edge receiving portion 136, and lowering the trailing edge holding-down member 135 to hold down the buffer sheet (see FIGS. 20 to 25).

On the other hand, if it is judged in S1502 that the sheet is not a buffer sheet, the CPU 221 judges whether or not the sheet is a simultaneous discharge sheet (S1503). If it is judged in S1503 that the sheet is a simultaneous discharge sheet, the CPU 221 executes simultaneous discharge processing (S1504) and waits for discharge of the simultaneous discharge sheet to the processing tray 129 (for the buffer sheet) to be completed (S1505).

On the other hand, if it is judged in S1503 that the sheet is not a simultaneous discharge sheet, the CPU 221 waits for discharge of the sheet to the processing tray 129 to be completed (S1505).

Next, the CPU 221 aligns the sheet discharged to the processing tray 129 (S1506) and judges whether or not the sheet is the last sheet of the stack (S1507). If it is judged in S1507 that the sheet is the last sheet in the stack, the CPU 221 judges whether or not the action mode is the staple sort mode (S1508). If it is judged in S1508 that the action mode is the staple sort mode, the CPU 221 executes staple processing (S1509). Next, the CPU 221 moves the sheet stack to a position for simultaneous discharge (S1510) and ends the processing.

On the other hand, if it is judged in S1508 that the action mode is not the stable sort mode, the CPU 221 moves the sheet stack to the position for simultaneous discharge (S1510) and ends the processing. On the other hand, if it is judged in S1507 that the sheet is not the last sheet of the sheet stack, the CPU 221 ends the processing.

Figure 45:
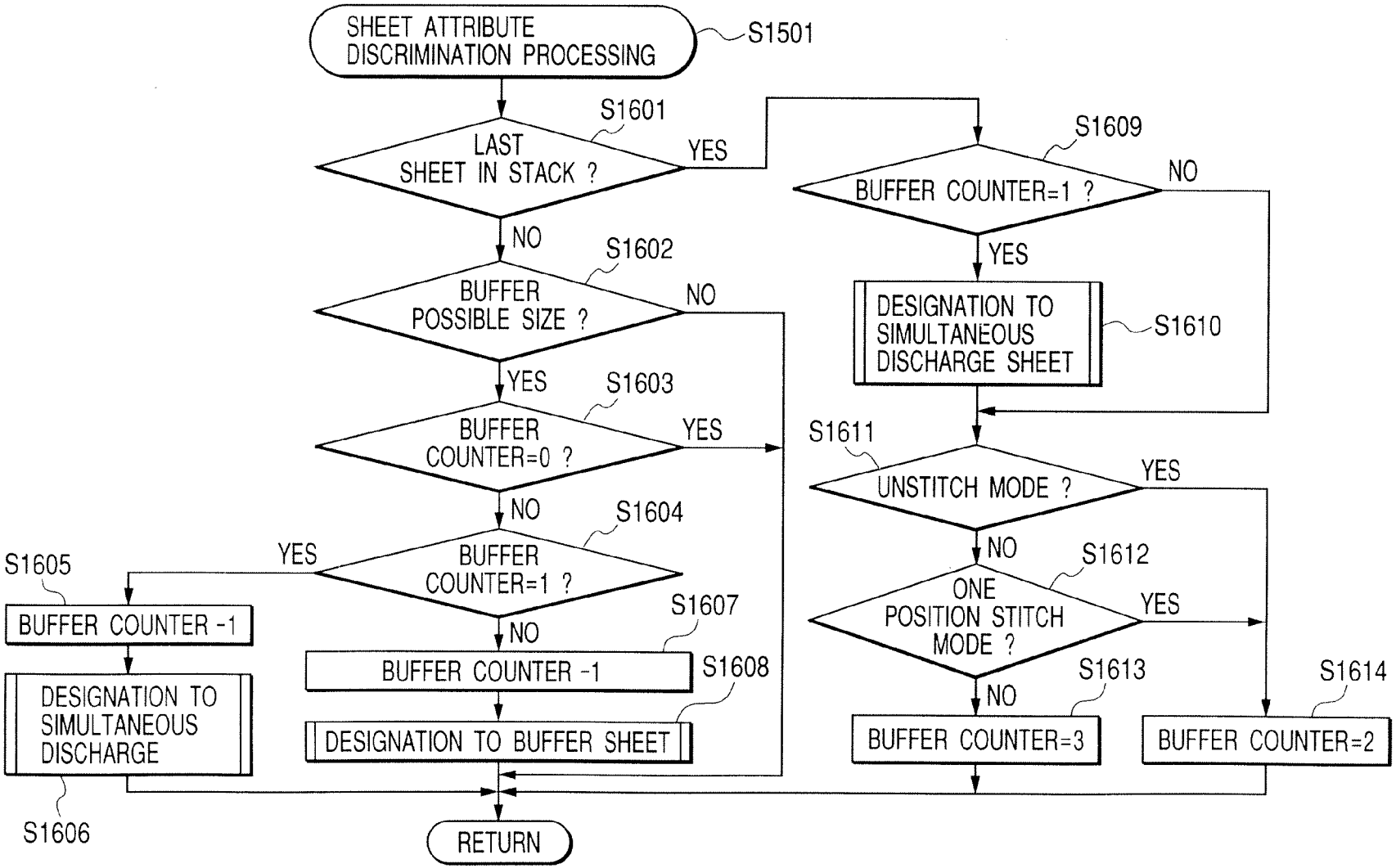
FIG. 45 is a flowchart of sheet attribute discrimination processing.

FIG. 45 is a flowchart showing a procedure of the sheet attribute discrimination processing (S1501) in FIG. 44.

First, the CPU 221 discriminates whether or not the sheet is the last sheet in one stack (S1601). Here, one stack means a unit for sorting in the case in which the action mode is the sort mode. In addition, in the case in which the action mode is the staple sort mode, one stack is a unit for performing stapling. Moreover, in the case in which the action mode is the non-sort mode, one stack is a unit of one job.

If it is judged that the sheet is the last sheet of the stack, the CPU 221 judges whether or not the buffer counter is 1 (S1609). If it is judged in S1609 that the buffer counter is 1, the CPU 221 designates the sheet as a simultaneous discharge sheet (S1610) and judges whether or not the post-processing mode is an unstitch mode (S1611). The sheet designated as a simultaneous discharge sheet is once stopped in the buffer position and laid on the sheet which has already been subjected to buffering. Thereafter, the sheet stack on the processing tray 129 which has been subjected to the post-processing and the buffer sheet are simultaneously conveyed. The buffer sheet is discharged to the processing tray 129, and the sheet stack that has been subjected to the post-processing is discharged to the stack tray. In addition, the buffer counter is a counter to be used for limiting the number of sheets to be subjected to buffering and is counted down every time a sheet is subjected to buffering.

On the other hand, if it is judged in S1609 that the buffer counter is not 1, the CPU 221 judges whether or not the post-processing mode is the unstitch mode (S1611).

If it is judged in S1611 that the post-processing mode is the unstitch mode, the CPU 221 sets the buffer counter to 2 (S1614). Consequently, the number of sheets to be subjected to buffering (the number of sheets to be laid one on top of another), which is usually three, is reduced to two. As a result, an alignment property of the buffer sheets after the simultaneous discharge on the processing tray 129 can be improved.

On the other hand, if it is judged in S1611 that the post-processing mode is not the unstitch mode, the CPU 221 judges whether or not the post-processing mode is a one position stitch mode (S1612).

If it is judged in S1612 that the post-processing mode is the one position stitch mode, the CPU 221 sets the buffer counter to 2 (S1614). Consequently, the number of sheets to be subjected to buffering (the number of sheets to be laid one on top of another), which is usually three, is reduced to two. As a result, an alignment property of the buffer sheets after the simultaneous discharge on the processing tray 129 can be improved.

On the other hand, if it is judged in S1612 that the post-processing mode is not the one position stitch mode, the CPU 221 sets the buffer counter to 3 (S1613) and sets the number of sheets to be subjected to buffering to 3 which is the number of sheets to be set usually.

In this way, by changing the number of sheets to be subjected to buffering according to the number of positions for stitching sheets, there is no fear of the sheet storing action being continued despite the fact that a stitching action has ended, and sheet processing efficiency can be improved. In addition, a sheet does not have to be stored unnecessarily, with the result that positional deviation of a sheet stack at the time when sheets are stacked on a processing tray can be reduced to improve a return alignment property of sheets.

On the other hand, if it is judged in S1601 that the sheet is not the last sheet of the sheet stack, the CPU 221 judges whether or not the sheet is a sheet of a buffer possible size (S1602). If it is judged in S1602 that the sheet is not a sheet of a buffer possible size, the CPU 221 ends the processing.

On the other hand, if it is judged in S1602 that the sheet is a sheet of a buffer possible size, the CPU 221 judges whether or not the buffer counter is 0 (S1603). If it is judged in S1603 that the buffer counter is 0, the CPU 221 ends the processing.

On the other hand, if it is judged in S1603 that the buffer counter is 0, the CPU 221 judges whether or not the buffer counter is 1. If it is judged in S1604 that the buffer counter is 1, the CPU 221 decrements the buffer counter by one (S1605), designates the sheet as a simultaneous discharge sheet (S1606), and ends the processing.

On the other hand, if it is judged in S1604 that the buffer counter is not 1, the CPU 221 decrements the buffer counter by one (S1607), designates the sheet as the buffer sheet (S1608), and ends the processing.

The above-mentioned sheet processing apparatus is a sheet processing apparatus of a simultaneous discharge system. However, in the sheet processing apparatus 10 of an independent discharge system as shown in FIG. 46, the number of sheets to be subjected to buffering can also be adjusted according to stitching positions.

This sheet processing apparatus 10 is also adapted to be mounted to the apparatus main body 16 of an image forming apparatus, for example, a copying machine and used as a copying machine 15.

This sheet processing apparatus 10 causes sheets fed from the apparatus main body 16 by the discharge roller pair 17 to pass through a strait path 20, sequentially stacks the sheets on the processing tray 11 and, when a predetermined number of sheets have been stacked, stitches the sheets with a stapler unit 19. Thereafter, the sheet stack is nipped by the upper roller 18*a* and the lower roller 18*b* of the oscillation roller pair 18 to be rotated and discharged.

While the sheet stack is being stitched by the stapler unit 19, sheets to be fed are guided to the conveyance path 12, stored in the buffer roller path 14 formed around the buffer roller 13 and, when the stitch processing action ends, discharged to the processing tray 11. The number of sheets to be stored (buffer sheets) is the number of sheets corresponding to a time required of the stapler unit 19 to stitch the sheet stack. The buffer roller 13, the buffer roller path 14, and the like constitute the buffer unit 23.

In such a sheet processing apparatus 10, sheet processing efficiency can also be improved by controlling the number of sheets that are subjected to buffering in the buffer unit 23, with the control portion 24 according to stitching positions for a sheet stack in the stapler unit 19.

Incidentally, in FIG. 25A, the third sheet P3 is slightly projected to further the downstream side than the first and the second sheets P1 and P2. The reason for this will be described below on the basis of FIGS. 47A to 47D, 48 and 49. Note that, in FIGS. 47A to 47D, it is assumed that the upper roller 127*a* and the lower roller 127*b* nips a sheet stack and buffer sheets.

Figure 47A:
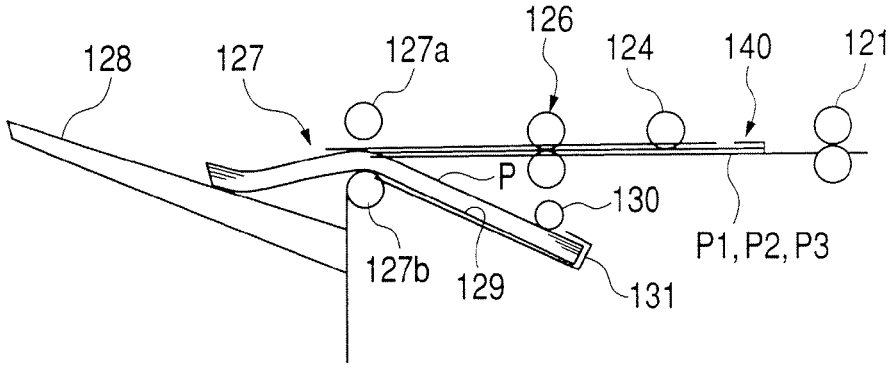
FIG. 47A is a diagram for explaining actions of the sheet processing apparatus at the time when the last buffer sheet is not aligned by a buffer unit and shows a state in which a sheet stack and buffer sheets are being discharged simultaneously.

As shown in FIG. 47A, since the trailing edge of the third buffer sheet P3 is not brought into abutment against the trailing edge receiving portion 136 unlike the first and the second sheets P1 and P2, the third buffer sheet P3 is not aligned with respect to the other sheets.

Figure 47B:
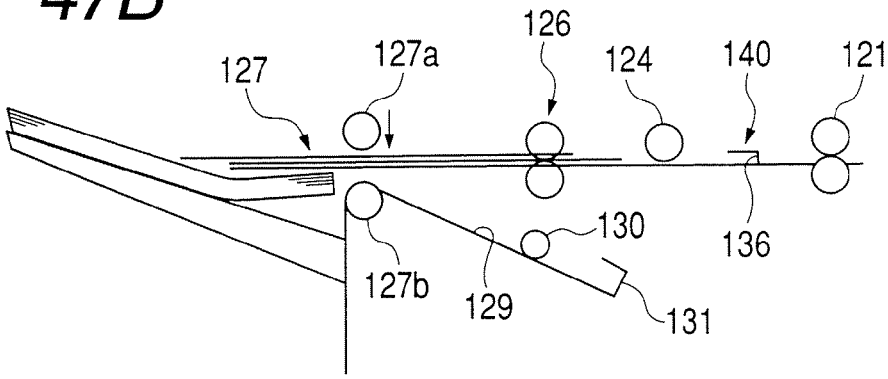
FIG. 47B is a diagram for explaining actions of the sheet processing apparatus at the time when the last buffer sheet is not aligned by the buffer unit and shows a state in which the sheet stack has been discharged from the state of FIG. 47A.

From this state, the sheet stack P stacked on the processing tray 129 and the three buffer sheets P1, P2 and P3 are simultaneously discharged by the oscillation roller pair 127 and the first discharge roller pair 128. Then, as shown in FIG. 47B, when the sheet stack P falls on the stack tray 128, the upper roller 127*a* moves down by a thickness of the sheet stack P. At this point, there is a fear that alignment between the first and the second sheets P1 and P2, the trailing edges of which are aligned by the trailing edge receiving portion 136, is collapsed. In that state, the buffer sheets fall on the processing tray 129 and are conveyed by the oscillation roller pair 127 and the return roller 130 until the buffer sheets come into abutment against the stopper 131.

Figure 47C:
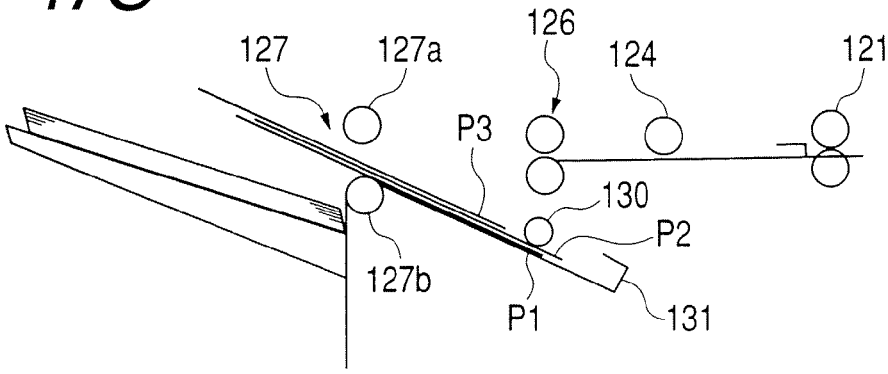
FIG. 47C is a diagram for explaining actions of the sheet processing apparatus at the time when the last buffer sheet is not aligned by the buffer unit and shows a state in which the buffer sheets are being returned and aligned on the processing tray.
Figure 48:
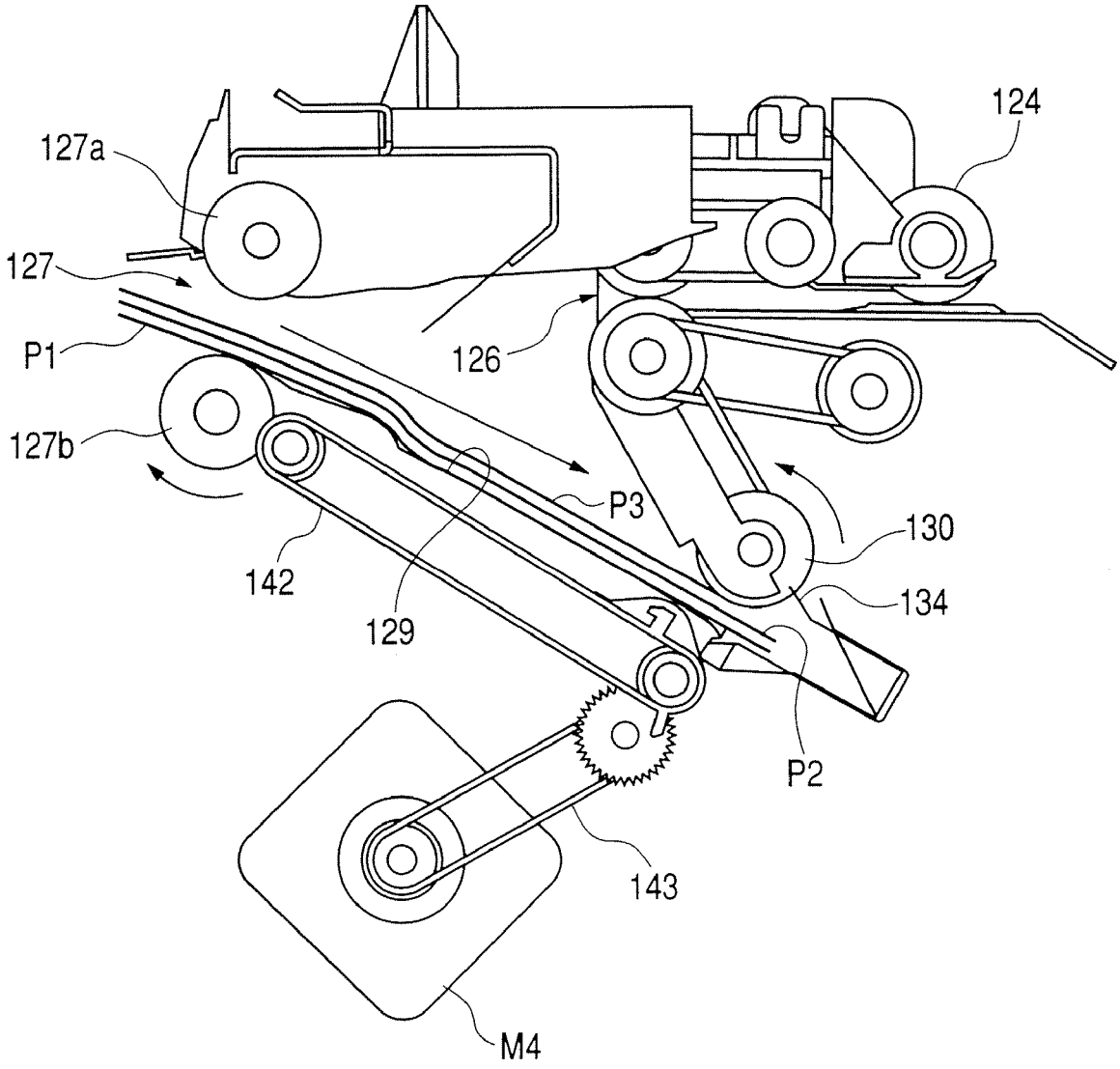
FIG. 48 is a detailed view corresponding to FIG. 47B.

At this point, as shown in FIGS. 47C and 48, the lowermost first sheet P1 is conveyed by the lower roller 127*b* and brought into abutment against the stopper 131. Then, the second sheet P2 is brought into abutment against the stopper 131 by the return roller 130. The third sheet P3 is brought into abutment against the stopper 131 by the upper roller 127*a*. Therefore, since the three sheets are brought into abutment against the stopper 131 by the respective rollers and aligned, the three sheets are stitched by the stapler unit surely.

Here, if the trailing edge of the third sheet P3 is aligned with the trailing edges of the first and the second sheets P2 and P3, in FIG. 47C, it is possible that the return roller 130 does not come into contact with the second sheet P2, and the second sheet P2 cannot be aligned. In particular, in the case in which the second sheet P2 is dislocated further in a direction apart from the stopper 131 than the other sheets, there is a fear that the second sheet P2 cannot be aligned.

Therefore, the sheet processing apparatus 119 of this embodiment can perform return alignment of sheets on the processing tray 129 satisfactorily and improve processing accuracy by dislocating the third sheet P3 further to the stack tray 128 side than the other sheets. In other words, since the last sheet to be fed is dislocated further to the downstream side than the other sheets, sheet conveying means comes into contact with the respective sheets surely to convey the sheets to a receiving stopper and bring the sheets into abutment against the stopper, and accuracy of return alignment can be improved. Thus, processing accuracy with respect to the sheets after that can be improved. In addition, since the third sheet is not aligned by the buffer unit 140, a conveying time of the sheets can be reduced to improve processing efficiency of the sheets so much more for that.

Figure 47D:
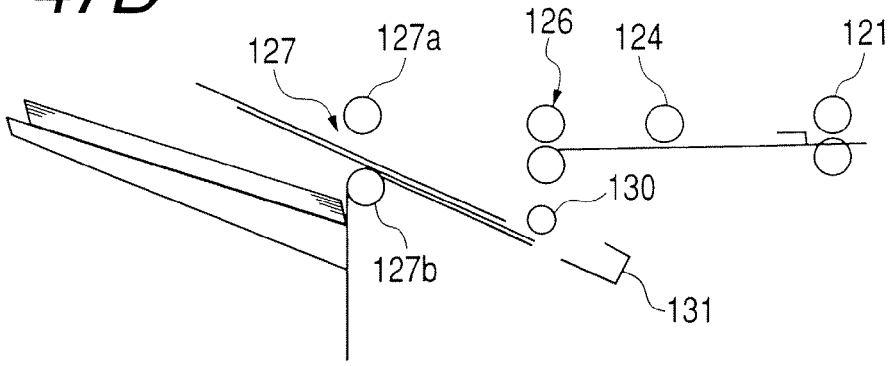
FIG. 47D is a diagram for explaining actions of the sheet processing apparatus at the time when the last buffer sheet is not aligned by the buffer unit and shows a state in which return alignment is being performed in the case of using two buffer sheets.
Figure 49:
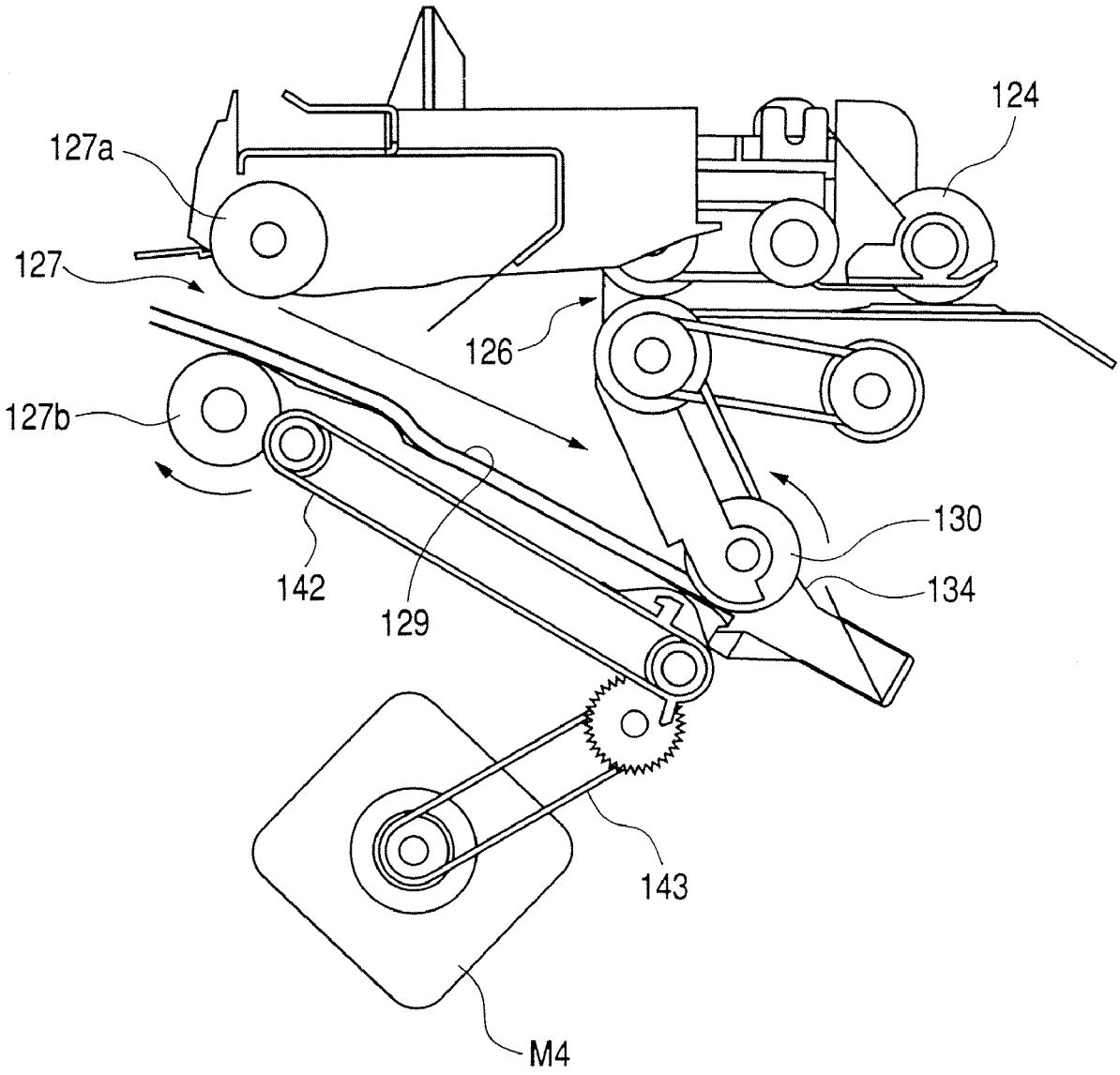
FIG. 49 is a detailed view corresponding to FIG. 47D.

Note that, as shown in FIGS. 47D and 49, when there are two buffer sheets, the sheets are brought into abutment against the stopper 131 more surely than at the time when there are three buffer sheets. Moreover, if the sheet processing apparatus 119 is adapted to obtain an effect of return alignment with an own weight of buffer sheets by utilizing inclination of the processing tray 129, it becomes possible to handle any number of buffer sheets.

In the above description, a position of a sheet is detected by a sensor. However, a position of a sheet may be judged according to sheet holding information (memory information) managed in the CPU 221.

In addition, the sheet processing apparatus 119 performs the width alignment for aligning a sheet stack on the processing tray 129 from both sides thereof and the trailing edge alignment, and then stitches the sheet stack. However, the sheet stack may be discharged to the stack tray 128 in a state in which the sheet stack has been subjected to the width alignment and the trailing edge alignment without being stitched.

What is claimed is:

1. A sheet processing apparatus, comprising:

a processing tray on which the sheets are stacked;

a sheet holding portion which stores supplied subsequent sheets while a preceding sheet bundle is stacked on the processing tray; and a discharging rotary member which conveys the subsequent sheets from the sheet holding portion to the processing tray after the preceding sheet bundle is discharged from the processing tray;

wherein edges in a sheet conveying direction of the subsequent sheets other than the last sheet in the subsequent sheets to be stored in the sheet holding portion, are aligned by abutting against an edge receiving portion provided in the sheet holding portion, and the discharging rotary member conveys the aligned sheets and the last sheet to the processing tray.

2. A sheet processing apparatus according to claim 1, further comprising:

stopper which is provided on the processing tray, wherein the subsequent sheets conveyed to the processing tray are aligned by abutting their edges in the sheet conveying direction against the stopper.

3. A sheet processing apparatus according to claim 1, wherein the edge receiving portion abuts upstream edges in the sheet conveying direction of the sheets supplied on the sheet holding portion, and the subsequent sheets are aligned by abutting the upstream edges in the sheet conveying direction of the sheets other than the last sheet against the edge receiving portion in a switch-back manner.

4. A sheet processing apparatus according to claim 3, further comprising:

a stopper which is provided on the processing tray, wherein the subsequent sheets conveyed to the processing tray are aligned by abutting their upstream edges in the sheet conveying direction against the stopper in a switch-back manner.

5. A sheet processing apparatus according to claim 1, further comprising:

a stacker on which the sheets are stacked;

wherein the discharging rotary member conveys the preceding sheet bundle stacked on the processing tray together with the subsequent sheets stored in the sheet holding portion, in a state where the preceding sheet bundle precedes the subsequent sheets, and after discharging the preceding sheet bundle to the stacker, conveys the subsequent sheets to the processing tray.

6. A sheet processing apparatus according to claim 5, wherein the edge receiving portion abuts upstream edges in the sheet conveying direction of the sheets supplied on the sheet holding portion, and the subsequent sheets are aligned by abutting the upstream edges in the sheet conveying direction of the sheets other than the last sheet against the edge receiving portion in a switch-back manner.

7. A sheet processing apparatus according to claim 6, further comprising:

a stopper which is provided on the processing tray, wherein the discharging rotary member rotates in reverse after conveying the subsequent sheets to the processing tray, thereby abutting the upstream edges against the stopper in a switch-back manner.

8. An image forming apparatus, comprising:

an image forming unit which forms an image on a sheet; and a sheet processing apparatus which applies processing to the sheet on which the image is formed by the image forming unit, wherein the sheet processing apparatus is a sheet processing apparatus according to claim 1.

* * * * *

UNITED STATES PATENT AND TRADEMARK OFFICE

CERTIFICATE OF CORRECTION

PATENT NO. : 7,354,036 B2
APPLICATION NO. : 11/560466
DATED : April 8, 2008
INVENTOR(S) : Hayashi et al.

It is certified that error appears in the above-identified patent and that said Letters Patent is hereby corrected as shown below:

COLUMN 3:
Line 12, “further” should read --yet--.
Line 25, “further” should read --yet--.
Line 30, “further” should read --yet--.

COLUMN 9:
Line 3, “two-side” should read --two-sided--.
Line 24, “process” should read --processes--.
Line 25, “seud” should read --seudo--.

COLUMN 11:
Line 67, “arrow” should read --the arrow--.

COLUMN 12:
Line 31, “arrow,” should read --the arrow,--.

COLUMN 16:
Line 37, “long time.” should read --a long time.--.

COLUMN 17:
Line 37, “an” should read --a--.

COLUMN 24:
Line 14, “stopper” should read --a stopper--.

Signed and Sealed this

Thirtieth Day of September, 2008

JON W. DUDAS
*Director of the United States Patent and Trademark Office*